US012449238B2

(12) United States Patent
Hong

(10) Patent No.: US 12,449,238 B2
(45) Date of Patent: Oct. 21, 2025

(54) METHOD FOR PROVIDING DART GAME IMAGE

(71) Applicant: PHOENIXDARTS CO., LTD., Seoul (KR)

(72) Inventor: Sang Uk Hong, Seoul (KR)

(73) Assignee: PHOENIXDARTS CO., LTD., Seoul (KR)

( * ) Notice: Subject to any disclaimer, the term of this patent is extended or adjusted under 35 U.S.C. 154(b) by 62 days.

(21) Appl. No.: 18/696,305

(22) PCT Filed: Sep. 27, 2022

(86) PCT No.: PCT/KR2022/014416
§ 371 (c)(1),
(2) Date: Mar. 27, 2024

(87) PCT Pub. No.: WO2023/055018
PCT Pub. Date: Apr. 6, 2023

(65) Prior Publication Data

US 2024/0401918 A1 Dec. 5, 2024

(30) Foreign Application Priority Data

Sep. 28, 2021 (KR) ..... 10-2021-0127908
Sep. 28, 2021 (KR) ..... 10-2022-0038914
May 2, 2022 (JP) ..... 2022-076030

(51) Int. Cl.
*F41J 3/02* (2006.01)
*F41J 3/00* (2006.01)

(52) U.S. Cl.
CPC ..... *F41J 3/02* (2013.01); *F41J 3/0028* (2013.01)

(58) Field of Classification Search
CPC ..... F41J 5/04; F41J 5/18; F41J 3/00; F41J 3/0009; F41J 3/0028; F41J 3/0042
See application file for complete search history.

(56) References Cited

U.S. PATENT DOCUMENTS 8,740,222 B1 * 6/2014 Krzewicki ..... F41J 5/052 463/16
10,905,941 B2 * 2/2021 Hong ..... A63F 13/837
12,247,812 B1 * 3/2025 Shi ..... F41J 5/04
(Continued)

FOREIGN PATENT DOCUMENTS

JP 2007526780 A 9/2007
JP 2010220784 A 10/2010
KR 101142136 B1 5/2012
(Continued)

*Primary Examiner* — Omkar A Deodhar
(74) *Attorney, Agent, or Firm* — Moore & Van Allen PLLC; Anup Iyer

(57) ABSTRACT

Disclosed is a method for providing a dart game image, which is performed by a dart game device for participating in a play session assigning a play time constraint to two or more devices according to some embodiments of the present disclosure. The method for providing a dart game image may include: receiving play related data of another device which participates in the play session in which the dart game device participates, wherein the play related data includes non-image play result data; determining a display image related to the play related data based on the play related data; and displaying the determined display image.

20 Claims, 28 Drawing Sheets

(56) References Cited

U.S. PATENT DOCUMENTS

| | | | | |
|---|---|---|---|---|
| 2005/0075153 | A1* | 4/2005 | Valero Moreno ... | G07F 17/3202 463/1 |
| 2018/0238662 | A1* | 8/2018 | Oh ..... | F41J 3/0066 |

FOREIGN PATENT DOCUMENTS

| | | | |
|---|---|---|---|
| KR | 1020170098629 | | 8/2017 |
| KR | 1020180006232 | | 1/2018 |
| KR | 101935890 | B1 | 1/2019 |
| KR | 1020200042119 | | 4/2020 |
| KR | 102136813 | | 7/2020 |
| KR | 1020210039084 | | 4/2021 |
| KR | 102387031 | B1 | 4/2022 |

* cited by examiner (a)

(b)

(a)

(b)

(a)

(b)

(b)

(a)

METHOD FOR PROVIDING DART GAME IMAGE

CROSS-REFERENCE TO RELATED APPLICATIONS

This application is a national stage entry of International PCT Application No. PCT/KR2022/014416 filed Sep. 27, 2022, and claims priority to and the benefit of Korean Patent Application No. 10-2021-0127908 filed in the Korean Intellectual Property Office on Sep. 28, 2021: Korean Patent Application No. 10-2022-0038914 filed in the Korean Intellectual Property Office on Sep. 28, 2021; and Japanese Patent Application No. 2022-076030 filed in the Japan Patent Office on May 2, 2022, the entire contents of which are incorporated herein by reference.

FIELD OF THE DISCLOSURE

The present disclosure relates to a method for providing a dart image, and particularly, a method for providing an image of a real-time online dart game.

BACKGROUND

In general, a dart refers to a 'small arrow' and is a game that makes marks by throwing an arrow-shaped dart to a centrifugal target marked with figures. The dart game has an advantage in that anybody can enjoy the dart game anytime and anywhere if an arrow-headed dart and the dart game device are provided. In recent years, as various game modes have been developed and scoring modes have been organized, the dart game has been developed as worldwide leisure, and therefore, men and women of all ages have conveniently enjoyed the dart game.

In general, a game mode of the dart game is a mode in which a first player throws several darts, and then when a score is counted, thrown darts are removed, and then a second player throws the dart. In addition, when the score is counted after throwing several darts, the second player also removes the thrown darts, and allows the first player to throw the dart again. In this case, the player must wait for a dart play of the another opponent player when the player is not his/her turn in the same round. In this regard, Korean Patent Registration No. 10-2136813 is disclosed.

SUMMARY OF THE DISCLOSURE

The present disclosure is contrived in response to the above-described background art, and has been made in an effort to provide a dart game device providing a new-concept dart game mode.

Technical objects of the present disclosure are not restricted to the technical object mentioned as above. Other unmentioned technical objects will be apparently appreciated by those skilled in the art by referencing the following description.

Technical Solution

In order to achieve the object, according to an embodiment of the present disclosure, disclosed is a method for providing a dart game image, which is performed by a dart game device for participating in a play session assigning a play time constraint to two or more devices. The method for providing a dart game image may include: receiving play related data of another device which participates in the play session in which the dart game device participates, wherein the play related data includes non-image play result data: determining a display image related to the play related data based on the play related data; and displaying the determined display image.

Further, the non-image play result data may include at least one of information on a score which a player of another device acquires by throwing the dart pin, information on a score acquired in a round which permits dart pin throwing of N times, or information on a score acquired in a set including K rounds.

In addition, the determining of the display image related to the play related data based on the play related data may include determining a score acquired by throwing the dart pin by the player of the another device based on the non-image play result data, and determining a prestored image related to a dart target unit corresponding to the score as the display image.

Further, the determining of the display image related to the play related data based on the play related data may include determining a location at which the dart pin of the player of the another device is thrown based on the non-image play result data, and determining the prestored image related to the dart target unit corresponding to the location as the display image.

Further, the image related to the dart target unit may include one of a prestored dart target unit related virtual image or a prestored actual image in which the dart pin hits a region related to the dart target unit.

Further, the determining of the display image related to the play related data based on the play related data may further include determining the score acquired by throwing the dart pin by the player of the another device or the location at which the dart pin of the player of the another device is thrown based on the play related data, and additionally determining a prestored event image corresponding to the score or location as the display image, and the displaying of the determined display image may include displaying the prestored dart target unit related image and the prestored event image.

Further, the display image may include a prestored previous play image in which the player of the another device throws the dart pin, and the determining of the display image related to the play related data based on the play related data may include determining the prestored previous play image as the display image.

In addition, the determining of the display image related to the play related data based on the play related data may include determining a score acquired by throwing the dart pin by the player of the another device based on the non-image play result data, and determining the prestored previous play image corresponding to the score in the prestored previous play image as the display image, and the prestored previous play image may include an image in which the player throws the dart pin.

In addition, the determining of the display image related to the play related data based on the play related data may include determining a location at which the dart pin of the player of the another device is thrown based on the non-image play result data, and determining the prestored previous play image corresponding to the location in the prestored previous play image as the display image, and the prestored previous play image may include an image in which the player throws the dart pin.

In addition, the prestored previous play image is stored in a mode of being grouped into a plurality of groups based on score information included in the non-image play result data, and the determining of the display image related to the play related data based on the play related data may include determining a prestored previous play image included in a group to which the score information corresponding to the play related data belongs among the plurality of groups as the display image.

Further, the method may include determining whether to display a play image in which the player of another device throws the dart pin by comparing the play related data of the another device participating in the play session in which the dart game device participates and prestored previous play related data of the another device.

In addition, the play related data may be received again at a time when the play session is changed, and the play session may include at least one of a first sub play session including a time constraint for dart pin throwing, a second sub play session including a time constraint for a round which permits dart pin throwing of N times, or a third sub play session including a time constraint for a set including K rounds, and the N and the K may be natural numbers.

Further, the display image may include at least one of a character image for identifying the player of the another device or an image including a text for identifying the player.

Further, a method for providing a dart game image to a dart game device participating in a play session assigning a play time constraint to two or more devices, which are performed by a dart game server may include: receiving play related data of another device which participates in the play session in which the dart game device participates, wherein the play related data includes non-image play result data: determining a display image related to the play related data based on the play related data; and transmitting the determined display image to the dart game device.

Further, a dart game device participating in a play session assigning a play time constraint to two or more devices may include: a network communication unit receiving play related data of another device which participates in the play session in which the dart game device participates, wherein the play related data includes non-image play result data: a control unit determining a display image related to the play related data based on the play related data; and a display unit displaying the determined display image.

In addition, in a computer program stored in a computer-readable storage medium, when the computer program is executed by one or more control units, the program performs the following operations for providing a dart game, and the operations may include: an operation of receiving play related data of another device which participates in the play session in which the dart game device participates, wherein the play related data includes non-image play result data: an operation of determining a display image related to the play related data based on the play related data; and an operation of displaying the determined display image.

Advantageous Effects

According to some exemplary embodiments of the present disclosure, interests of dart game users can be inspired.

Effects which can be acquired in the present disclosure are not limited to the aforementioned effects and other unmentioned effects will be clearly understood by those skilled in the art from the following description.

BRIEF DESCRIPTION OF THE DRAWINGS

Various aspects are now described with reference to the drawings and like reference numerals are generally used to designate like elements. Various aspects are now described with reference to the drawings and like reference numerals are generally used to designate like elements. However, it will be apparent that the aspect(s) can be executed without the specific detailed matters. In other examples, known structures and apparatuses are illustrated in a block diagram form in order to facilitate description of the one or more aspects.

DETAILED DESCRIPTION OF EMBODIMENTS OF THE DISCLOSURE

Figure 1:
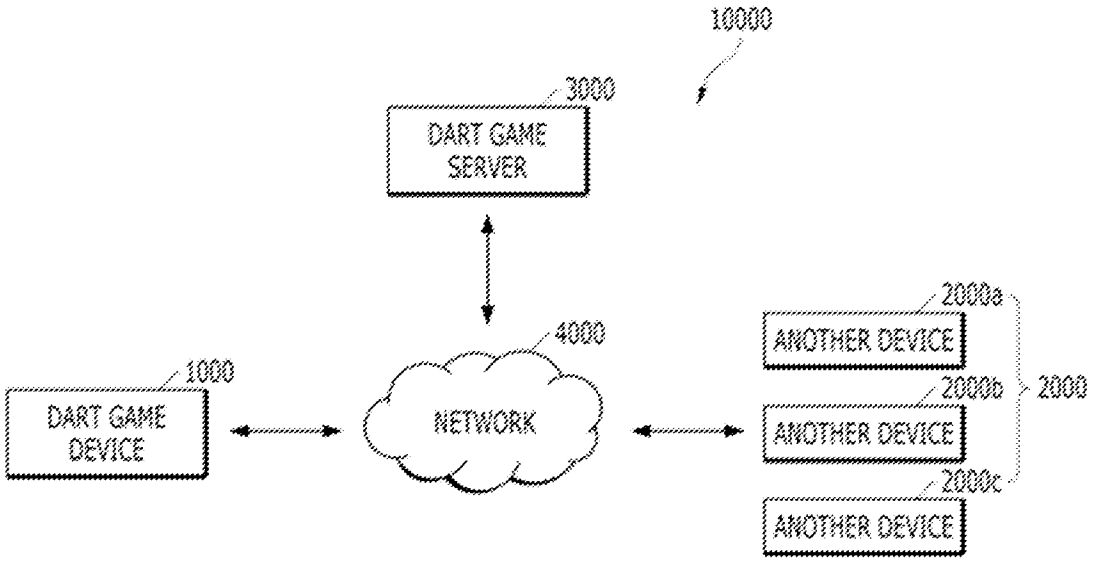
FIG. 1 is a block diagram describing an example of a dart game system according to some embodiments of the present disclosure.

Various embodiments and/or aspects will be now disclosed with reference to drawings. In the following description, for the purpose of a description, multiple detailed matters will be disclosed in order to help comprehensive appreciation of one or more aspects. However, those skilled in the art of the present disclosure will recognize that the aspect(s) can be executed without the detailed matters. In the following disclosure and the accompanying drawings, specific exemplary aspects of one or more aspects will be described in detail. However, the aspects are exemplary and some of various methods in principles of various aspects may be used and the descriptions are intended to include all of the aspects and equivalents thereof. Specifically, in "embodiment", "example", "aspect", "illustration", and the like used in the specification, it may not be construed that a predetermined aspect or design which is described is more excellent or advantageous than other aspects or designs.

Hereinafter, like reference numerals refer to like or similar elements regardless of reference numerals and a duplicated description thereof will be omitted. Further, in describing an embodiment disclosed in the present disclosure, a detailed description of related known technologies will be omitted if it is determined that the detailed description makes the gist of the embodiment of the present disclosure unclear. Further, the accompanying drawings are only for easily understanding the exemplary embodiment disclosed in this specification and the technical spirit disclosed by this specification is not limited by the accompanying drawings.

Although the terms "first", "second", and the like are used for describing various elements or components, these elements or components are not confined by these terms, of course. These terms are merely used for distinguishing one element or component from another element or component. Therefore, a first element or component to be mentioned below may be a second element or component in a technical spirit of the present disclosure.

Unless otherwise defined, all terms (including technical and scientific terms) used in the present specification may be used as the meaning which may be commonly understood by the person with ordinary skill in the art, to which the present disclosure pertains. Terms defined in commonly used dictionaries should not be interpreted in an idealized or excessive sense unless expressly and specifically defined.

Moreover, the term "or" is intended to mean not exclusive "or" but inclusive "or". That is, when not separately specified or not clear in terms of a context, a sentence "X uses A or B" is intended to mean one of the natural inclusive replacements. That is, the sentence "X uses A or B" may be applied to any of the case where X uses A, the case where X uses B, or the case where X uses both A and B. Further, it should be understood that the term "and/or" used in this specification designates and includes all available combinations of one or more items among enumerated related items.

In addition, the word "comprises" and/or "comprising" means that the corresponding feature and/or component is present, but it should be appreciated that presence or addition of one or more other features, components, and/or a group thereof is not excluded. Further, when not separately specified or it is not clear in terms of the context that a singular form is indicated, it should be construed that the singular form generally means "one or more" in this specification and the claims.

Further, the terms "information" and "data" used in the specification may also be often used to be exchanged with each other.

Elements or layers of different layers or layers being referred to as being "on" or "on" other components or layers includes both a case where the elements or layers are directly on other components or layers, and a case where the elements or layers are interposed in the middle with other layers or other components. On the contrary, the component being referred to as being "directly on" or "just on" indicates that another component or layer is not interposed therebetween.

"Below", "beneath", "lower", "above", "upper", etc., which are spatially relative terms may be used for easily describing a correlation between one component or other components as illustrated in the drawings. The spatially relative terms should be appreciated as terms including different directions of elements upon using or operating in addition to directions illustrated in the drawings.

For example, when the components illustrated in the drawings are overturned, the components described as "below" or "beneath" the other components may be placed "above" the other components. Thus, the exemplary term "below" may include both the below direction and the above direction. The components may be oriented even in different directions, and thus, the spatially relative terms may be interpreted according to the orientation.

It should be understood that, when it is described that a component is "connected to" or "accesses" another component, the component may be directly connected to or access the other component or a third component may be present therebetween. In contrast, it should be understood that, when it is described that a component is "directly connected to" or "directly access" another component, no component is present therebetween.

Suffixes "module" and "unit" for components used in the following description are given or mixed in consideration of easy preparation of the specification only and do not have their own distinguished meanings or roles.

The objects and effects of the present disclosure, and technical constitutions for accomplishing these will become obvious with reference to exemplary embodiments to be described below in detail along with the accompanying drawings. In describing the present disclosure, a detailed description of known function or constitutions will be omitted if it is determined that it unnecessarily makes the gist of the present disclosure unclear. In addition, terms to be described below as terms which are defined in consideration of functions in the present disclosure may vary depending on the intention or a usual practice of a user or an operator.

However, the present disclosure is not limited to exemplary embodiments disclosed below but may be implemented in various different forms. However, the exemplary embodiments are provided to make the present disclosure be complete and completely announce the scope of the present disclosure to those skilled in the art to which the present disclosure belongs and the present disclosure is just defined by the scope of the claims. Accordingly, the terms need to be defined based on contents throughout this specification.

In the present disclosure, a player who plays a dart game may participate in a play session to which a play time constraint is assigned using a dart game device. Specifically, the play session may a game unit which one or more devices may play jointly. In an embodiment, the play session may mean a game unit in which two or more players who alternately play using one device participate. In another embodiment, the play session may mean a game unit in which two or more players who alternately play using each of two or more devices participate.

The game unit may mean a minimum event unit for comparing, when two or more players participate in a dart game, game results of respective players. In an embodiment, the game unit may mean an event unit for determining the win or loss of the game played by two or more players.

In a dart game system according to an embodiment of the present disclosure, a time constraint may be assigned to the play session. The time constraint may mean a time condition in which two or more players who participate in the same play session should perform a specific play in the dart game. In an embodiment, the time constraint may mean a time condition for two or more players who participate in the same play session to play one dart game. For example, the play session may include a time constraint including, as the time condition, a case where two or more dart players are to play from 10 a.m. to 10:10 a.m. on Oct. 1, 2021.

In an embodiment, the time constraint may be commonly applied to all players who participate in the same play session. Specifically, all players may participate in a play session to which a time constraint including, as the time condition, the same play session start time and end time is assigned. For example, there may be a play session in which all players should play from 10 a.m. to 10:10 a.m. on Oct. 1, 2021.

In another embodiment, the time constraint may assign different time conditions to two or more players among the players who participate in the same play session. For example, player A who participate in the same play session may participate in the play session to which the time constraint including, as the time condition, the case of playing from 10 a.m. to 10:10 a.m. on Oct. 1, 2021 is assigned, and player B may participate in a play session to which a time constraint including, as the time condition, a case of playing from 10:05 a.m. to 10:15 a.m. on Oct. 1, 2021 assigned. Time conditions assigned to respective participants included in the same play session may be set to have the same period, and set to have different periods. When the time conditions are set to have different periods, the time conditions may be determined by various factors. For example, the time condition may be set based on a relative or absolute skill level of the player who participates in the play session. As another example, the time conditions may be set to have, based on previous play result information of the player who participates in the play session or past play history information of the player, different time periods for players.

In the dart game system according to an embodiment of the present disclosure, when different time constraints are assigned to at least some of the players who participate in the same play session, the dart game system may set the time constraints so that the different time constraints are at least partially overlapped.

In a dart game system according to an embodiment of the present disclosure, a specific play to which the time constraint is assigned in the play session may be variously set. As an example, the specific play may be set as a minimum game unit in which win or loss is determined according to a dart game rule. For example, a period from a start time from an end time of a game such as Count Up Game, Cricket Game, etc., may be set as the specific play. In another example, the specific play may be a unit having a lower granularity therethan. For example, the specific play may be set as a play round in one game. In another example, the specific play may be set as a dart throw constituting each of a plurality of rounds in one game. For example, the specific play may be set as each of a plurality of rounds constituting a count up play. Alternatively, the specific play may be set as three dart throws constituting respective rounds constituting the count up play.

In the dart game system according to an embodiment of the present disclosure, when the specific play is set as one round, two or more players who participate in the play session should be able to play one round according to the time condition. For example, the players may be requested to complete a fifth round of the count up which is being conducted in the same play session for 30 seconds from 10:01 on Oct. 1, 2021. In another example, when the specific play is set as one dart throw, for example, the player may be requested to complete a first dart throw of the fifth round of the count up which is being conducted in the same play session for 10 seconds from 10:05 on Oct. 1, 2021. This is exemplary, and the players who participate in the same play session may be assigned with time constraints in which start times or time periods of the time condition in which the specific play should be completed are different from each other.

The above description exemplarily discloses some of various embodiments for constituting the time constraint included in the play session in the dart game system according to an embodiment of the present disclosure, and the dart game system according to the present disclosure is not limited to the above-described example.

On the other hand, in the present disclosure, the player who participates in the play session online may perform an independent dart game regardless of another player throwing a dart pin through another dart game device. As an example, according to the dart game mode in the related art, a first player throws several dart pins, and then when a score is counted, an opportunity that the dart pin is to be thrown may be provided to a second player. However, according to the game mode in the related art, players should wait when the players are not turns thereof. Further, the game mode in the related art may make a game time of the dart game be longer. On the other hand, in the present disclosure each of the players who participate in the play session may throw the dart pin thereof independently regardless of another player's throwing the dart pin. That is, each of the players of the dart game device who participate in the same play session may enjoy the dart game thereof in the play session without a need to wait for a throwing opportunity of an opponent player. Through the play session, players who are positioned remotely from each other may enjoy the real-time dart game play without waiting for the play of the opponent player in the same round, for example.

Hereinafter, a dart game device, a dart game system, and a dart game method using the dart game device according to the present disclosure will be described through FIGS. 1 to 18. Meanwhile, in the present disclosure, for convenience of description, it is to be understood that a player who performs a dart game and a dart game device who plays the dart game are not distinguished and disclosed, but used mixedly with each other, and the accompanying drawings are just used for easily understanding the embodiments disclosed in the present disclosure and a technical spirit disclosed in the present disclosure is not limited by the accompanying drawings and all changes, equivalents, or substitutes included in the spirit and the technical scope of the present disclosure are included.

FIG. 1 is a block diagram describing an example of a dart game system according to some embodiments of the present disclosure.

Referring to FIG. 1, the dart game system 10000 may include a dart game device 1000, at least one another device 2000, a dart game server 3000, and a network 4000. However, components described above are not required in implementing the dart game system 10000 and the dart game system 10000 may thus have components more or less than components listed above.

The dart game device 1000 may provide a dart game to a player who participates in a play session. Here, the play session may a game unit in which one or more devices may play jointly as described above. That is, the player participates in the play session through the dart game device 1000 to enjoy a real-time online dart game within the same time period with players of a plurality of other devices. However, the dart game device 1000 may not provide only an online dart game to the player, but also provide an offline dart game. Hereinafter, an example of the dart game device 1000 according the present disclosure will be described through FIGS. 2 to 7.

Another device 2000 may be at least one of the devices related to the player other than the dart game device 1000. For example, another device 2000 may be another dart game device other than the dart game device 1000, a mobile device (e.g., a smartphone of a user in which dart game related software is installed) related to the dart game device 1000, or a server.

As an example, another device 2000*a* may be at least one dart game device which is participating in the same play session as the dart game device 1000 or is waiting for participating in the same play session.

As another example, another device 2000*b* may be a mobile device interlocking with the dart game device 1000, and expressing information related to the play session in which the dart game device 1000 participates to the player.

As yet another example, another device 2000*c* may also be a server for providing the same play session to a plurality of dart game devices. Here, the server may be the same device as the dart game server 3000 illustrated in FIG. 1, or also be another server physically separated from the dart game server 3000. However, the present disclosure is not limited thereto.

The dart game server 3000 may include a predetermined type computer system or computer device such as a microprocessor, a main frame computer, a digital processor, a portable device, or a device controller.

In the present disclosure, the dart game server 3000 may determine a dart game player who is to participate in the play session.

Specifically, the dart game server 3000 may receive first play result information from a plurality of devices who participates in a first play session which is conducted during a first time period. In addition, the dart game server 3000 may determine a plurality of players who is to participate in a second play session during a second time period after the first time period based on the first play result information. Here, the play result information may be information on a result of the dart game generated as the players who participate in the play session conduct the dart game. The play result information may include any type of result information generated according to the play of the dart game.

As an example, the play result information may include at least one of information on a ranking related to a dart game result of each player, information on a score related to a dart game result of each player, information on an image in which the player plays the dart game, information on a prestored image representing the player, information on a time when each player ends the dart game, or identification information of each player who participates in the play session. However, the present disclosure is not limited thereto.

For example, the dart game server 3000 may determine a plurality of players having predetermined rankings as the player who is to participate in the second play session based on the information on the ranking included in the first play result information. However, the present disclosure is not limited thereto. Hereinafter, an example of a method for determining a dart game player which is to participate in the play session by the dart game server 3000 according to the present disclosure will be described through FIGS. 8 to 11.

In the present disclosure, there may be a plurality of dart game servers 3000. In addition, each of the plurality of dart game servers may distribute at least one play session to the dart game device 1000 or each another device 2000.

Specifically, in a tournament mode dart game, the dart game server 3000 may provide a 1-1$^{st}$ play session to a 1-8$^{th}$ play session. Here, it may be possible for eight players to participate in the 1-1$^{st}$ to a 1-8$^{th}$ play sessions, respectively. The 1-1$^{st}$ to a 1-8$^{th}$ play sessions may be sub sessions of the first play session. The first play session may include the 1-1$^{st}$ to a 1-8$^{th}$ play sessions. The 1-1$^{st}$ to a 1-8$^{th}$ play sessions may assign corresponding play time constraints to two or more devices, respectively. In this case, the dart game server 3000 may determine the plurality of players who is to participate in the second play session based on the play result information of the first play session.

The dart game system 10000 constituted by one dart game server 3000 may also be difficult to provide a pleasant dart game to the players due to a limitation such as a network. Accordingly, in an embodiment of the present disclosure, there may be a plurality of dart game servers 3000. Each of the plurality of dart game servers may distribute at least one play session or at least one sub session to the players. However, the present disclosure is not limited thereto.

The network 4000 may be configured regardless of communication modes such as wired and wireless modes and constituted by various communication networks including a local area network (LAN), a wide area network (WAN), and the like.

In the present disclosure, the network 4000 or the dart game server 3000 may be a cloud based system. Here, the cloud based system as a system in which a user (dart game device) shares a network resource may be a computing environment in which the user rents and uses cloud based systems of a desired number as many as needed at a desired time through the network. The cloud based system may include a deployment model such as Public Cloud, a Private Cloud, a Hybrid Cloud, or a Community Cloud, or a service model such as Infrastructure as a Service (IaaS), Platform as a Service (PaaS), or Software as a Service (SaaS). However, the network 4000 or the dart game server 3000 in the present disclosure is not limited to the cloud based system, and a centralized mode or edge computing mode network 4000 or dart game server 3000 will also be able to be implemented according to the embodiment of the present disclosure.

In the present disclosure, the play session may also be generated by the dart game device 1000. In addition, another device 2000 may participate in the play session generated by the dart game device 1000. Further play result information related to participating in the play session generated by the dart game device 1000 may be collected by the dart game server 3000. The play result information may be transmitted to the dart game server 3000 by at least one of the dart game device 1000 or another device 2000. However, it may also be appropriate that the dart game device 1000 and another device 2000 transmit the play result information to the dart game server 3000 in order to validate the play result information. In this case, a traffic or a load of a resource burdened to generate the play session by the dart game server 3000 may be reduced.

According to the above-described configuration, the dart game system 10000 is constituted by the dart game device 1000, another device 2000, and the dart game server 3000 to provide a real-time dart game to the plurality of players who participates in the play session.

Meanwhile, the dart game device 1000 or another device 2000 may include a component which allows the player to perform the dart game. Hereinafter, the components of the dart game device 1000 according to the present disclosure will be described through FIGS. 2 to 3.

Figure 2:
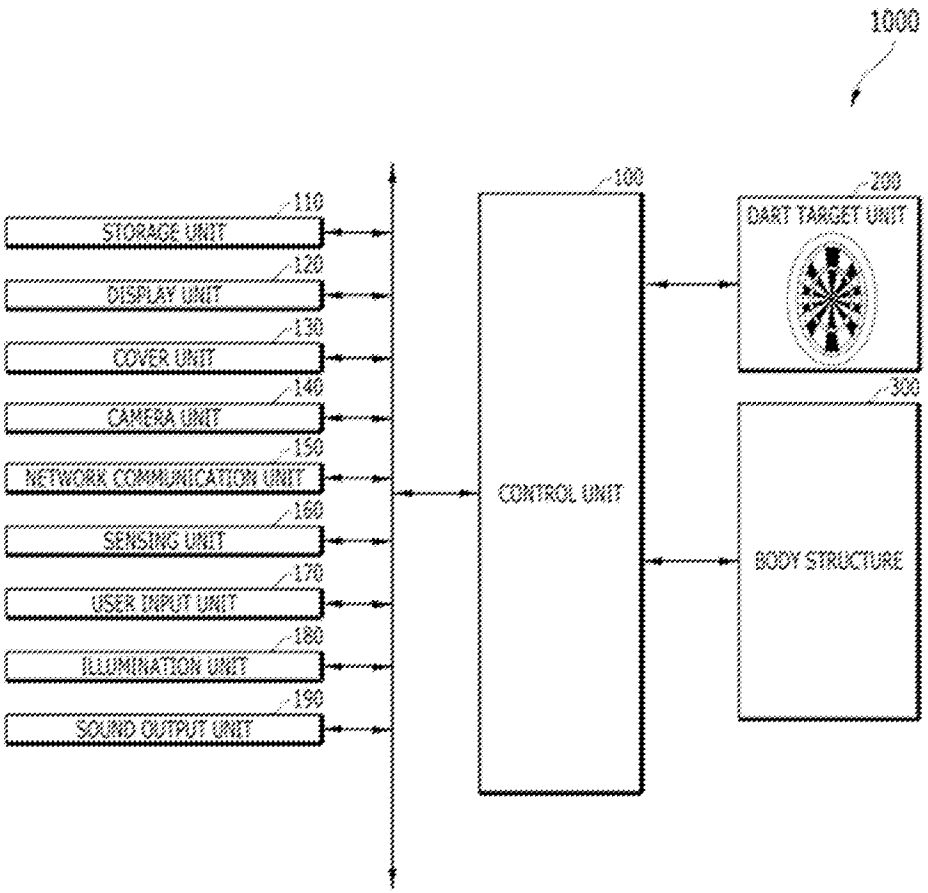
FIG. 2 is a block diagram describing an example of a dart game device according to some embodiments of the present disclosure.

FIG. 2 is a block diagram describing an example of a dart game device according to some embodiments of the present disclosure. FIG. 3 is a diagram describing an example of a dart game device according to some embodiments of the present disclosure.

Referring to FIG. 2, the dart game device 1000 may include at least one of a control unit 100, a display unit 120, a storage unit 110, a cover unit 130, a camera unit 140, a network communication unit 150, a sensing unit 160, a user input unit 170, an illumination unit 180, a sound output unit 190, a dart target unit 200, and a body structure 300. However, the present disclosure is not limited thereto.

The control unit 100 may generally process an overall operation of the dart game device 1000. The control unit 100 processes a signal, data, information, and the like input or output through the components included in the dart game device 1000 or drives an application program stored in the storage unit 110 to provide or process information or a function appropriate for a user.

For example, in the case of the dart game, the control unit 100 may determine a score for dart pin throwing of a player sensed by the sensing unit 160. Further, the control unit 100 may transmit the determined score to another device 2000 through the network communication unit 150. In addition, the control unit 100 may receive play related data including a score related to the dart game from another device 2000 through the network communication unit 150. In addition, the control unit 100 may control the display unit 120 to display information related to the play session in the display unit 120 based on play related data including a score of another player and a score determined in the dart game device. Here, the play related data may be data including all information which may be generated as the player who participates in the play session conducts the dart game or used for participating in the play session. In addition, the play related data may be received again at the time when the play session is changed.

For example, the play related data may include at least one of identification information of each player who participates in the play session, information on a ranking of each player who participates in the play session related the dart game, information on an image in which the player plays the dart game, play result data for the dart game for each player who participates in the play session, information on a prestored image representing the player, or information on a score related to the dart game of each player who participates in the play session.

The storage unit 110 may include a memory and/or a persistent storage. The memory may include at least one type storage of a flash memory type storage, a hard disk type storage, a multimedia card micro type storage, a card type memory (for example, an SD or XD memory, or the like), a random access memory (RAM), a static random access memory (SRAM), a read-only memory (ROM), an electrically erasable programmable read-only memory (EEPROM), a programmable read-only memory (PROM), a magnetic memory, a magnetic disk, and an optical disk.

The storage unit 110 may prestore at least one image related to the dart game. In this case, as the control unit 100 receives the play related data of another device 2000 through the network communication unit 150, the control unit 100 may determine a display image related to the play related data among one or more prestored images. In addition, the display unit 120 may display the determined display image.

Specifically, the information related to the play session displayed by the display unit 120 may be a play related image of a player of another device 2000. When the network communication unit 150 directly receives an image photographed by the camera unit through another device 2000, the display unit 120 may display the received image.

However, according to a traffic situation between the dart game device 1000 and another device 2000, the network communication unit 150 may also receive only play related data not including the play related image from another device 2000. For example, the control unit 100 may determine, as the display image to be displayed by the display unit 120, the display image related to the play related data among one or more images prestored in the storage unit 110.

For example, the control unit 100 may determine that the player of another device 2000 hits a score corresponding to a triple region based on the play related data of another device 2000 received through the network communication unit 150. In this case, the control unit 100 may determine, as the display image to be displayed by the display unit 120, a display image related to a triple score among a plurality of display images prestored in the storage unit 110. Hereinafter, an example of a method for determining the display image based on the play related data of another device 2000 by the control unit 100 according to the present disclosure will be described through FIG. 4.

The display unit 120 may display (output) information processed by the dart game device 1000.

For example, the display unit 120 may display that information related to the play session based on the play related data of another device 2000 received through the network communication unit 150. Here, the information related to the play session may be the play related image of the player of another device 2000 or an image generated based on dart game play result information of another device 2000. Hereinafter, the information related to the play session displayed by the display unit 120 will be described through FIGS. 11 to 13.

The display unit 120 may be provided on a front surface of the dart game device 1000.

Figure 3A:
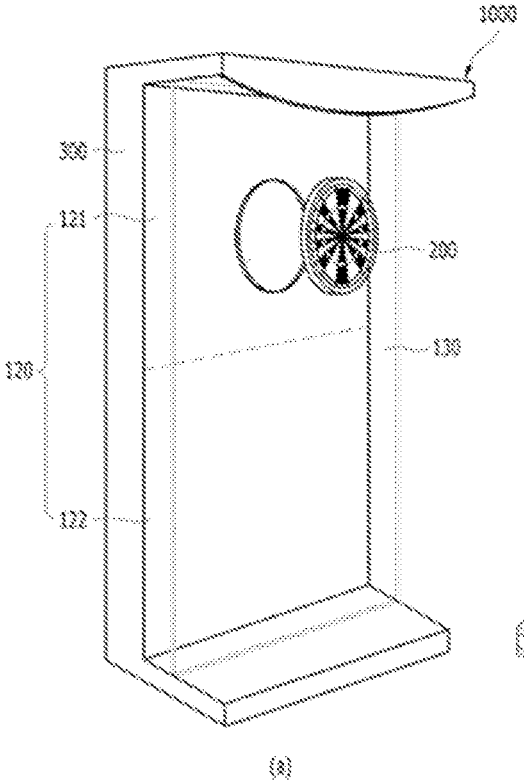
FIG. 3A is a diagram describing an example of a dart game device according to some embodiments of the present disclosure.

As an example, referring to FIG. 3A, the display unit 120 may be provided on the front surface of the dart game device 1000, and display the information related to the play session.

In the present disclosure, the display unit 120 may include a plurality of display regions. For example, the display unit 120 may include a first display region 121 and a second display region 122. Each of the first display region 121 and the second display region 122 may also be independently controlled by the control unit 100. Alternatively, each of the first display region 121 and the second display region 122 may be controlled by the control unit 100 so that a single image is implemented throughout the first display region 121 and the second display region 122. As an example, the first display region 121 and the second display region 122 may operate in the form of independent display modules from each other. As another example, the first display region 121 and the second display region 122 may be not a separate independent module but one module.

Figure 3B:
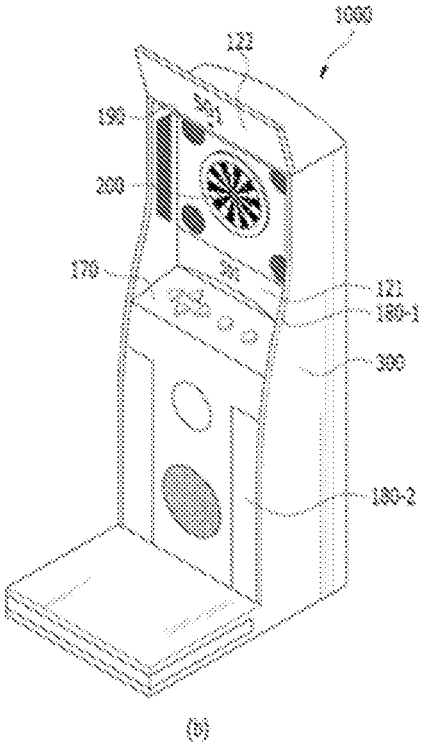
FIG. 3B is a diagram describing an example of a dart game device according to other embodiments of the present disclosure.

Referring to FIG. 3B, the display unit 120 may be implemented by one or more display units. Further, each of one or more display units may be independently controlled by the control unit 100.

For example, the display unit 120 may include a first display unit positioned below the dart target unit 200 and including the first display region 121, and a second display unit positioned above the dart target unit 200 and including the second display region 122. In addition, each of the first display unit and the second display unit may be independently controlled by the control unit 100.

The cover unit 130 may be provided adjacent to the display unit 120 to protect the display unit 120.

For example, referring to FIG. 3A, the cover unit 130 may be positioned between a virtual surface extending upward from a throw line and the display unit 120. In this case, since the cover unit 130 is positioned adjacent to the display unit 120, a risk of damage to the display unit 120 may be reduced.

Referring back to FIG. 2, the camera unit 140 may include one or more cameras. An image frame processed by the camera unit 140 may be stored in the storage unit 110 or transmitted to the outside through the network communication unit 150. Two or more camera units 140 may be provided according to a use environment.

In the present disclosure, the control unit 100 of the dart game device 1000 may accept or reject a log-in request of the player for the dart game device 1000 based on an image including the player photographed by the camera unit 140.

As an example, the control unit 100 may receive an input for logging in the dart game device 1000 from the player through the user input unit 170. In this case, the control unit 100 may control the camera unit 140 to photograph an image including a player who currently manipulates the user input unit 170. The control unit 100 may accept or reject the log-in request of the player based on a comparison between facial information included in prestored identification information of the player and facial information recognized from the photographed image.

As another example, the control unit 100 may request a log-in input of the user through the display unit 120. The display unit 120 may output required information to allow the user to conduct log-in through camera photographing or log-in through the user input unit 170 according to the control by the control unit 100.

As another example, the control unit 100 may also permit user log-in to the dart game device 1000 through communication with another device 2000. In this case, the control unit 100 may control the network communication unit 150 to transmit/receive information for user authentication with another device 2000.

In the present disclosure, the control unit 100 may compare the facial information included in the prestored identification information of the player and the facial information recognized from the photographed image even after an initial log-in operation of the player.

Specifically, the control unit 100 may photograph a play image through the camera unit 140 in order to transmit a play image related to the player of the dart game device 1000 to another device 2000. The control unit 100 may compare facial information recognized from a new photographed play image and facial information included in the identification information used upon log-in. The control unit 100 may determine whether a current player is the same as a player upon the log-in based on a comparison result. In this case, cheating may prevented, such as participation of a surrogate player, which may occur as the dart game device 1000 and another device 2000 participate in the play session online. Here, the surrogate player may be another player other than the player who logs in to the dart game device 1000. Hereinafter, an example of a method for using the facial information by the control unit 100 according to the present disclosure will be described through FIG. 16.

As another example, the control unit 100 compares a prestored play image including a play operation of a player and a current play image of the corresponding player to determine whether the dart game player cheats. For example, when a dart pin throwing image of the player included in the current play image is different from a past dart pin throwing image of the corresponding player by a predetermined threshold or more, the control unit 100 may determine that there is a high cheating possibility of the current dart pin throwing image. In comparing two or more images, any deep learning algorithm related to image processing or image analysis may be used.

The network communication unit 150 may be configured regardless of communication modes such as wired and wireless modes and constituted by various communication networks including a local area network (LAN), a wide area network (WAN), and the like.

The network communication unit 150 may sense a connection state of the network and a transceiving speed of the network with another device 2000 or the dart game server 3000. However, the present disclosure is not limited thereto, and traffic information related to the transceiving speed of the network may also be received from the dart game server 3000.

The data received through the network communication unit 150 may be displayed in the display unit 120 or transmitted to another device 2000.

As an example, when the network communication unit 150 receives the data related to the play session from another device 2000 or the dart game server 3000, the network communication unit 150 may also transmit the received data to another device such as a mobile device. The dart game providing method according to the present disclosure may allow two or more devices to participate in the same play session. As a result, the player of the dart game device 1000 may have to wait until, one, two, or more plurality of players participate in the same play session. Accordingly, the network communication unit 150 may transmit the data related to the play session to the mobile device of the player. In this case, the player may check whether matching with another player is made through the mobile device while taking a break.

According to some embodiments of the present disclosure, the control unit 100 may provide an offline dart game to the player of the dart game device 1000 when there is a situation of waiting for another player because the number of players who participate in the play session is not satisfied.

Specifically, the control unit 100 may receive an input for participating in the play session from the player through the user input unit 170. In this case, the control unit 100 may generate the play session or participate in one of a plurality of play sessions generated previously. However, when the number of players of another device 2000 is insufficient, the player of the dart game device 1000 may have to wait until the matching is made. In this case, the control unit 100 may provide the offline dart game to the player of the dart game device 1000 by interlocking with searching for another player so that the matching with another player may be made.

According to some embodiments of the present disclosure, when the number of players who are to participate in the play session is insufficient, a dummy player may also be generated by the dart game server 3000. Here, the dummy player may be a virtual player other than an actual player. In addition, the dart game server 3000 may make the generated dummy player participate in at least one play session in which the number of players is insufficient. As an example, the dummy player may be generated based on play result data of the actual player, so the dummy player may perform a similar type of play to any actual player as if the actual player who plays with the dummy player conducts the real-time dart game with an actual opponent player. Hereinafter, an example of a method for generating the dummy player by the dart game server 3000 according to the present disclosure will be described through FIG. 10.

The sensing unit 160 may sense a play of a player performed with respect to the dart target unit 200. For example, the sensing unit 160 may sense the hit location of the dart pin. The sensing unit 160 may electrically convert a score corresponding to the region which the dart hits to transmit the converted score to the control unit 100. Further, the sensing unit 160 may transmit information on the region hit by the dart pin to the control unit 100 and the control unit 100 may acquire the score based on the information on the hit location of the dart acquired from the sensing unit 160.

The user input unit 170 receives an input of the user for controlling the dart game device 1000.

For example, referring to FIG. 3B, the user input unit 170 may be implemented by at least one of a keypad, a dome switch, a touch pad (resistive/capacitive), a jog wheel, and a jog switch. However, the present disclosure is not limited thereto.

Further, the user input unit 170 may include a short-range communication unit (not illustrated). When the user input unit 170 includes the short-range communication unit of the network communication unit 150, the user input unit 170 may be configured to receive the user input which is input by an external console device. As short-range communication technology, Bluetooth, radio frequency identification (RFID), infrared data association (IrDA), ultra wideband (UWB), ZigBee, or the like may be used.

The illumination unit 180 may be disposed at various parts of the dart game device 1000 to transfer a visual effect to the player of the dart game device 1000.

For example, referring to FIG. 3A, a first illumination unit 180-1 may be formed to extend in a vertical direction along a front-direction protrusion of the body structure 300. In addition, a second illumination unit 180-2 may be disposed at a front lower portion of the body structure 300. In addition, the first illumination unit 180-1 and the second illumination unit 180-2 may output a signal for notifying the occurrence of the event of the dart game device 1000. Examples of the event which occurs from the dart game device 1000 may include identification of the dart game player, direct hit of the dart, a change of the dart game player, game over, and the like.

Further, the illumination units 180-1 and 180-2 may include a light emission diode (LED) and notify the occurrence of the event to the user by flickering the LED. Additionally, the illumination unit 180 may vary and output the type of light emission, the intensity of light emission, and/or the flicker cycle depending on the position at which the dart pin reaches the dart target unit.

Additionally, the illumination units 180-1 and 180-2 may also output a predetermined pattern of illumination by interlocking with the acceptance of the log-in request of the player determined by the control unit 100. Here, the predetermined pattern of illumination may be determined in advance by the player of the dart game device 1000.

Referring back to FIG. 2, the sound output unit 190 may output audio data such as a game sound effect, a game motion guide, and a game method description, which is stored in the storage unit 110. Further, the sound output unit 190 may also output a sound signal related to a function (e.g., the game sound effect) performed by the dart game device 1000. The sound output unit 190 may include a receiver, a speaker, a buzzer, and the like. Additionally, the sound output unit 190 may vary and output a volume/a type of music depending on the location where the dart pin reaches the dart target.

In the present disclosure, the sound output unit 190 may output a sound, music, or a voice corresponding to the play related data among a plurality of sounds, music, or voices which are prestored based on dart game play related data of the player of the dart game device 1000.

Specifically, when the control unit 100 of the dart game device 1000 accepts the log-in request of the player, the control unit 100 may recognize previous play related data of the player. The control unit 100 may control the sound output unit 190 so as to output a predetermined sound based on the previous play related data. Alternatively, when the control unit 100 accepts the log-in request of the player, the control unit 100 may determine whether there is a prestored sound, music, or voice message based on identification information of the player. In addition, when it is determined that there is at least one of the prestored sound, music, or voice message, the control unit 100 may control the sound output unit 190 so as to output a corresponding sound.

Additionally, the control unit 100 of the dart game device 1000 may generate a personalized guidance message for the player based on history information related to the dart game play result of the player when log-in of the player is completed. For example, when a previous play time of the player is a time before a week, the control unit 100 may generate a guidance message, "You log in within a week. Welcome". As another example, when the player has a career of winning the dart game tournament, the control unit 100 may generate a guidance message, "Welcome to a winner in an XX competition". Like this, the control unit 100 generates a personalized message suitable for the player in history information of the player to provide a more entertainment effect to the player.

The dart target unit 200 may include a score board in which a bull's eye is positioned at the center and there are regions segmented by a concentric circle centering the bulls' eye and straight lines extended radially from the bull's eye and assigned with individual scores, respectively. Multiple receiving grooves into which a tip of a dart may be inserted may be formed on the score board. In this case, shapes of regions at which the scores are arranged and to which the scores are granted in the dart target unit 200 may be variably changed. Further, the dart target unit 200 may be implemented in the form of a touch screen.

The body structure 300 is formed to extend in a vertical direction to a ground to form an exterior of the dart game device 1000. In addition, the body structure 300 may include the display unit 120, the user input unit 170, the dart target unit 200 and other components. However, the present disclosure is not limited thereto.

Information related to the play session may be displayed in the display unit 120 provided on a front surface of the body structure 300. Here, the information related to the play session may include a play image of another player, an image generated based on play related data of another player, or information related to a play time constraint. Hereinafter, an example of a method for generating the information related to the play session by the control unit 100 of the dart game device 1000 according to the present disclosure will be described through FIG. 4.

Figure 4:
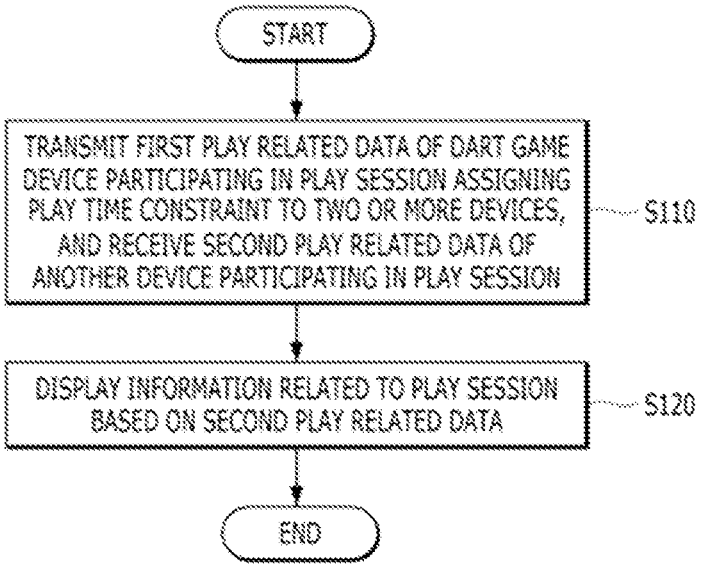
FIG. 4 is a flowchart describing an example of a method for displaying information related to a play session by a dart game device according to some embodiments of the present disclosure.

FIG. 4 is a flowchart describing an example of a method for displaying information related to a play session by a dart game device according to some embodiments of the present disclosure.

Referring to FIG. 4, the network communication unit 150 of the dart game device 1000 may transmit first play related data of the dart game device 1000 which participates in the play session to another device 2000 or the dart game server 3000. Further, the network communication unit 150 may receive, from another device 2000 or the dart game server 3000, second play related data of another device 2000 which participates in the play session.

According to an embodiment of the present disclosure, the play session may a game unit which one or more devices may play jointly. In an embodiment, the play session may mean a game unit in which two or more players who alternately play using one device participate. In another embodiment, the play session may mean a game unit in which two or more players who alternately play using each of two or more devices participate. The play session is assigned to one or more devices, so the dart game device 1000 and another device 2000 which participates in the same play session may allow a plurality of players to enjoy the dart game in real time at the same time.

In a dart game system according to an embodiment of the present disclosure, a time constraint may be assigned to the play session. The time constraint may mean a time condition in which two or more players who participate in the same play session should perform a specific play in the dart game. In an embodiment, the time constraint may mean a time condition for two or more players who participate in the same play session to play one dart game.

The play session may include a plurality of sub play sessions. The time constraint may be assigned to each of the plurality of sub play sessions. As an example, the play session may include at least one of a first sub play session, a second sub play session, and a third sub play session, and each sub play session may include the time constraint.

The first sub play session may include a time constraint for dart pin throwing. In addition, the second sub play session may include a time constraint for a round which permits dart pin throwing of N times. Further, the third sub play session may include a time constraint for a set including K rounds. Here, N and K may be natural numbers. Accordingly, the play session may assign the time constraint to each of the dart pin throwing, the round, and the set to plurality of players who participate in the dart game. In this case, the plurality of players may participate in dart games having the same time constraint in real time by using dart game devices 1000 thereof.

In an embodiment, the time constraint may be commonly applied to all players who participate in the same play session or the same sub play session. Specifically, all players may participate in a play session to which a time constraint including, as the time condition, the same play session start time and end time is assigned.

For example, there may be a play session in which all of two or more players should play from 10 a.m. to 10:10 a.m. on Oct. 1, 2021. In this case, the play session may include a first sub play session in which all players should throw one dart pin from 10 a.m. to 10:00:10 a.m. on Oct. 1, 2021. Alternatively, the play session may include a second sub play session in which all players should end a round by throwing the dart pin three times from 10 a.m. to 10:00:30 a.m. on Oct. 1, 2021. Alternatively, the play session may include a third sub play session in which all players should end one set by performing 10 rounds from 10 a.m. to 10:10 a.m. on Oct. 1, 2021. As a result, the play session and each of one or more sub play sessions included in the play session may assign the same time constraint to all players.

In another embodiment, the time constraint may assign different time conditions to two or more players among the players who participate in the same play session. Specifically, one or more players may participate in a play session to which a time constraint including, as the time condition, at least one of different play session start times or different play session end times is assigned.

For example, there may be a play session in which the first player of the dart game device 1000 should play from 10 a.m. to 10:10 a.m. on Oct. 1, 2021, and the second player of another device 2000 should play from 09:50 a.m. to 10:10 a.m. on Oct. 1, 2021. As another example, there may be a play session in which the first player of the dart game device 1000 should play from 10 a.m. to 10:10 a.m. on Oct. 1, 2021, and the second player of another device 2000 should play from 10 a.m. to 10:20 a.m. on Oct. 1, 2021. As yet another example, there may be a play session in which the first player of the dart game device 1000 should play from 10 a.m. to 10:10 a.m. on Oct. 1, 2021, and the second player of another device 2000 should play from 09:50 a.m. to 10:20 a.m. on Oct. 1, 2021.

According to an embodiment, the play session to which the time constraint including different play session start times as the time condition is assigned may include a sub play session to which the time constraint including different sub play session start times as the time condition is assigned. That is, the sub play session included in the play session may assign different time constraints to players.

For example, the play session may include a first sub play session in which the first player should throw one dart pin from 10 a.m. to 10:00:10 a.m. on Oct. 1, 2021, and the second player should throw one dart pin from 09:50 a.m. to 09:50:10 a.m. on Oct. 1, 2021. As another example, the play session may include a first sub play session in which the first player should throw one dart pin from 10 a.m. to 10:00:10 a.m. on Oct. 1, 2021, and the second player should throw one dart pin from 09:50 a.m. to 09:50:20 a.m. on Oct. 1, 2021. As yet another example, the play session may include a first sub play session in which the first player should throw one dart pin from 10 a.m. to 10:00:10 a.m. on Oct. 1, 2021, and the second player should throw one dart pin from 10 a.m. to 10:00:20 a.m. on Oct. 1, 2021.

In the above-described example, it is described that one dart pin should be thrown in the sub play session, but an embodiment in which one round is ended in the sub play session or an embodiment in which one dart game is ended in the sub play session may also be included in the scope of the present disclosure.

According to an embodiment of the present disclosure, when time conditions are set to have different periods, the time conditions may be determined by various factors. In an embodiment, the time condition may be set based on a relative or absolute skill level of the player who participates in the play session.

For example, when the dart game device 1000 generates the play session, the second player of another device 2000 may participate in the play session generated by the dart game device 1000. The network communication unit 150 may receive second previous play related data of the second player from another device 2000 as the second player participates in the play session. In an embodiment, the second previous play related data of the second player may be data related to the first player of the dart game device 1000. For example, the second previous play related data may be data related to the dart game result in a previous play session in which the first player and the second player participate jointly. In this case, the second previous play related data may include a dart game ranking or score in the previous play session. The control unit 100 may determine a difference between relative skill levels of the first player and the second player based on the second previous play related data of the second player and the first previous play related data of the first player of the dart game device 1000. The control unit 100 may set the time condition of the play session so that the first player and the second player have different periods based on the determined difference of the skill level.

In another embodiment, the second previous play related data of the second player may include information on a rating accumulated and generated as the second player participates in the play sessions and perform the dart game. Here, the rating may be an absolute indicator that may indicate skills of players for the dart game. For example, the rating may be an evaluation index for absolute skills of dart game players determined based on an Elo rating system. In this case, the control unit 100 may set the time condition of the play session so that the first player and the second player have different periods based on information on ratings of the first player and the second player.

According to some embodiments of the present disclosure, the first play related data of the first player and the second play related data of the second player may include result data of playing during at least partially overlapped time period according to the time constraint assigned in the play session. Here, the overlapping may be in the same part between a time period of the dart game conducted by the first player and a time period of the dart game conducted by the second player. Accordingly, at least partially overlapped time period may mean a case where a part of the time period of the dart game conducted by the first player and a part of the time period of the dart game conducted by the second player are conducted during the same time period. In other words, the time period of the dart game conducted by the first player and the time period of the dart game conducted by the second player may be at least partially overlapped.

Specifically, according to an embodiment of the present disclosure, different time constraints may be assigned to players who participate in the same play session. As an example, when the play session is generated by the dart game server 3000, the dart game server 3000 may assign different time constraints even to the players who participate in the same play session based on the relative or absolute skill levels of the players who participate in the play session. For example, the dart game server 3000 may assign, to the first player who participates in the play session, a time constraint in which the first player should play from 10 a.m. to 10:10 a.m. on Oct. 1, 2021. The dart game server 3000 may assign, to the second player who participates in the same play session, a time constraint in which the second player should play from 10 a.m. to 10:20 a.m. on Oct. 1, 2021. That is, the dart game server 3000 may assign the time constraints to the first player and the second player so that the time period from 10 a.m. to 10:10 a.m. on Oct. 1, 2021 is overlapped. Accordingly, the first play related data and the second play related data generated as the first player and the second player participate in the same play session may include result data of playing during at least partially overlapped time period. In addition, the dart game server 3000 may determine a player who is to perform a next play session by using the result data or store the result data.

According to the existing dart game system, when an online match play is conducted, after throwing of three dart pins by the first player is completed in the same round, throwing of three dart pins by the second player should be conducted. As such, according to the existing dart game system, since players using different dart game devices, which are positioned remotely should wait for the play of another player in one round, there is a possibility that a conducting process of the dart game will be slightly slow and boring. An online dart game system 10000 according to an embodiment of the present disclosure assigns the play session to a plurality of devices in the process of conducting the online dart game to enable a real-time online play.

The dart game device 1000 may display information related to a play time constraint of the play session in the display unit 120 as the player conducts the real-time online play. Here, the information related to the play time constraint may be information for showing the time constraint assigned to the play session to the player.

In an embodiment, the time constraint may mean a time condition in which two or more players who participate in the same play session should perform a specific play in the dart game. Specifically, all players may participate in a play session to which a time constraint including, as the time condition, the same play session start time and end time is assigned. For example, there may be a play session in which all players should play from 10 a.m. to 10:10 a.m. on Oct. 1, 2021. In this case, the control unit 100 may display information related to a play time constraint for a play session start time and a play session end time. For example, the control unit 100 may display a time from a start time to an end time of a game such as a count up game, a cricket game, etc.

Further, the time constraint may be present for a unit having lower granularity in addition a constraint for the play session start time and the play session end time. For example, the tine constraint may include a time constraint of a unit smaller than a play session unit like a time constraint for dart pin throwing. In this case, the information related to the play time constraint may include a time constraint having lower granularity, and the display unit 120 may display information related to the time constraint.

Specifically, the information related to the play time constraint may include at least one of a first play constraint time period including the time constraint for the dart pin throwing, a second play constraint time period including a time constraint for a round which permits dart pin throwing of N times, a third play constraint time period including a time constraint for a set including K rounds, or a waiting time period predetermined between two sets. That is, the dart game device 1000 may display, in the display unit 120, information on time constraints for each of the dart pin throwing, the round, and the set similarly assigned to a plurality of players who participate in the dart game, and a waiting time assigned between the sets.

The dart game device 1000 may also allow the information related to the play time constraint of the play session to be displayed in another device 2000*a* as the player conducts the online play in real time. Here, another device 2000*a* may be a mobile device interlocking with the dart game device 1000, and expressing information related to the play session in which the dart game device 1000 participates to the player.

The information related to the play time constraint may further include information on a time which remains until the play session starts. For example, the first player of the dart game device 1000 may participate in the play session which is conducted for 10 minutes from 10 a.m. on Oct. 1, 2021 from 09:55 a.m. on Oct. 1, 2021. In this case, the dart game device 1000 may display the information on the time which remains until the play session starts in the display unit 120. The dart game device 1000 may also allow the information on the time which remains until the play session starts to be displayed in another device 2000*a*.

The control unit 100 of the dart game device 1000 may control the sound output unit 190 to output a prestored sound or voice based on the information related to the play time constraint.

Specifically, the control unit 100 may control the sound output unit 190 to output the prestored sound or voice based on a comparison between one or more constraint time periods included in the play related data of the first player of the dart game device 1000 and the information related to the play time constraint.

For example, a time constraint for dart pin throwing set during the first play constraint time period included in the information related to the play time constraint may be 10 seconds. The control unit 100 may determine that the time constraint for the dart pin throwing of the first player remains as 5 seconds or less based on the play related data of the first player. In this case, the control unit 100 may control the sound output unit 190 or the display unit 120 to output a prestored voice or a prestored image such as "5 seconds, 4 seconds, 3 seconds, 2 seconds, and 1 second".

As another example, a time constraint for a round set during the first play constraint time period included in the information related to the play time constraint may be 1 minute. The control unit 100 may control a remaining time or the remaining number of dart pin throwing times up to a round end time of the first player to be output as the voice or image based on the play related data of the first player.

As another example, a time constraint for dart game end set during the first play constraint time period included in the information related to the play time constraint may be 5 minutes. The control unit 100 may control a remaining time, the remaining number of rounds, or the remaining number of dart pin throwing times up to a dart game end time of the first player to be output as the voice or image based on the play related data of the first player.

Additionally, the control unit 100 may determine delivering the information related to the play time constraint to an external device including a terminal of a user through the network communication unit 150. As a result, the information related to the play time constraint may be output through the user terminal, and furthermore, the dart game device 1000 may also confirm information related to play time constraints of one or more another players who participate in the play session.

The control unit 100 of the dart game device 1000 may also allow another device 2000*a* to output the prestored sound or voice based on the information related to the play time constraint.

Specifically, the control unit 100 may also allow another device 2000*a* to output the prestored sound or voice based on a comparison between one or more constraint time periods included in the play related data of the first player of the dart game device 1000 and the information related to the play time constraint.

For example, when the control unit 100 determines that a start time of a next set is adjacent based the information on the waiting time assigned between the sets, the control unit 100 may allow another device 2000*a* to output the prestored sound or voice.

The control unit 100 of the dart game device 1000 may also allow another device 2000*a* to generate vibration with a predetermined pattern based on the information related to the play time constraint.

For example, when the control unit 100 determines that the start time of the next set is adjacent based the information on the waiting time assigned between the sets, the control unit 100 may allow another device 2000*a* to output the vibration with the predetermined pattern.

In the present disclosure, the network communication unit 150 of the dart game device 1000 may transmit first play related data including a first play image and first play result data of the first player of the dart game device 1000 in transmitting the first play related data to another device 2000. Here, the first play image may be an image photographed through the camera unit 140 by the dart game device 1000. For example, the first play image may be an image acquired by photographing a case where the first player throws the dart pin during a time period included in the play session.

The first play result data may be data generated as the first player conducts the dart game. The first play result data may include at least one of information on a score acquired by throwing the dart pin by the first player who participates in the play session, information on a score acquired in the round which permits dart pin throwing of N times, information on a time of ending the round which permits dart pin throwing of N times, information on a score acquired in the set including K rounds, and information on a time of ending the set including K rounds.

The first play related data may be data including both information related to the first player and information related to the dart game device 1000. Further, the first play related data may include at least one of the first play image and the first play result data. Moreover, the first play related data may include at least one of identification information of the first player, information on a prestored image showing the first player, information on a predetermined character for identifying the first player, information on a predetermined text for identifying the first player, information on a score related to the dart game of the first player who participates in the play session, information on a ranking related to the dart game of the first player who participates in the play session, information on an image of playing the dart game of the player, and network traffic information. Here, the network traffic information may include any type of factors which influence a performance or a speed of the network, such as an amount of data which flows for a specific time of a network equipment, a network bandwidth, hardware information which influences the network speed, etc.

According to some embodiments of the present disclosure, the control unit 100 of the dart game device 1000 may also determine whether to transmit the first play image based on a comparison result of a previous play and a current play.

Specifically, when the first play image is photographed through the camera unit 140, the control unit 100 may compare the previous play image and the first play image of the first player prestored in the storage unit 110. In addition, the control unit 100 may determine whether to transmit the first play image based on the comparison result.

For example, the control unit 100 may determine transmitting the first play image when there is a large difference from a predetermined threshold according to the comparison result. For example, when the first play image is photographed through the camera unit 140, the control unit 100 compares the previous play image and the first play image of the first player prestored in the storage unit 110 to generate a difference value indicating a difference between the first play image and the previous play image. The control unit 100 may determine transmitting the first play image when the generated difference value is larger than the predetermined threshold according to the comparison result. That is, the control unit 100 may determine transmitting a new photographed first play image only when the first play image and the previous play image are different to have a large difference from the predetermined threshold.

According to some other embodiments of the present disclosure, the control unit 100 of the dart game device 1000 may also determine whether to transmit the first play image based on the first play related data of the first player. That is, the control unit 100 may also determine whether to transmit the first play image by using data other than the play image.

Specifically, when the first play image is photographed through the camera unit 140, the control unit 100 may compare the previous play related data and the first play related data of the first player prestored in the storage unit 110. In addition, the control unit 100 may determine whether to transmit the first play image based on the comparison result.

For example, the control unit 100 may determine transmitting the first play image when there is a large difference from a predetermined threshold according to the comparison result between the previous play related data and the first play data of the first player which are prestored. As a specific example, the control unit 100 may generate a difference value indicating a difference by comparing the previous play related data and the first play related data of the first player prestored in the storage unit 110. The control unit 100 may determine transmitting the first play image when the generated difference value is larger than the predetermined threshold according to the comparison result between the previous play related data and the first play data of the first player which are prestored. The control unit 100 may determine transmitting a new photographed first play image only when the first play related data and the previous play related data are different to have a large difference from the predetermined threshold.

When the network communication unit 150 transmits the play image whenever the play image is photographed through the camera unit 140, a load of the network traffic may increase. Accordingly, the control unit 100 compares the previous play related data and the current play related data, or compares the previous play image and the current play image to determine whether to transmit the current play image. By such a mode, a network load may decrease, and as a result, a real-time dart game play which increases a user experience may be implemented.

The display unit 120 may display information related to the play session based on second play related data (S120).

The play session related information may include a second play image in which the second player of another device 2000 throws the dart pin during a time period included in the play session. Here, the second play image may be an image photographed through the camera unit 140 of another device 2000.

The play session related information may also be an image generated based on dart game play result information of another device 2000. Specifically, when the control unit 100 receives the second play related data of another device 2000 through the network communication unit 150, the control unit 100 may determine a display image related to the second play related data among one or more prestored images. Here, the display image may include at least one of a prestored image in which the second player throws the dart pin, a predetermined character image for identifying the second player, and a predetermined text for identifying the second player. In addition, the display unit 120 may display the determined display image.

The play session related information may also include a second play image in which the second player of another device 2000 throws the dart pin during the time period included in the play session, and an actual image in which the dart pin thrown by the second player of another device 2000 is hit on the dart target unit. Specifically, the network communication unit 150 may receive, from another device 2000, the second play image and the actual image in which the dart pin thrown by the second player of another device 2000 is hit on the dart target unit. Here, the actual image may be an image photographed through the camera unit of another device 2000. As the second play image and the actual image are received, the control unit 100 may control the display unit 120 to display the play session related information including the second play image and the actual image.

The play session related information may also include the second play image in which the second player of another device 2000 throws the dart pin during the time period included in the play session, and a prestored dart target unit related virtual image corresponding to the second play related data. Specifically, the network communication unit 150 may receive, from another device 2000, only the second play image and not receive the actual image in which the dart pin thrown by the second player of another device 2000 is hit on the dart target unit, according to the determination of the control unit 100. As an example, the control unit 100 may determine a network grade for another device 2000 based on traffic information of a network constituted by the devices who participate in the play session. According to the determined network grade, the network communication unit 150 may receive only the second play image and not receive the actual image in terms of the dart target in which the dart pin is hit on the dart target unit from another device 2000. In this case, the control unit 100 may determine a prestored dart target unit related virtual image corresponding to the second play related data. For example, the control unit 100 may recognize that the second player acquires 20 points based on the second play related data. In this case, the control unit 100 may determine an image in which the dart pin reaches a 20-point region among one or more images prestored in the storage unit 110. The dart game device or the dart game server may store images in which the dart pin reaches each segment of the dart target unit. As the dart target unit related virtual image is determined, the display unit 120 may display the play session related information including the dart target unit related virtual image and the second play image.

The play session related information may include the display image related to the second play related data and the actual image in which the dart pin thrown by the second player of another device 2000 is hit on the dart target unit among one or more prestored images. Specifically, the network communication unit 150 may receive only the actual image in which the dart pin thrown by the second player of another device 2000 is hit on the dart target unit, and not receive the second play image in which the second player throws the dart pin, according to the determination of the control unit 100. In this case, the control unit 100 may determine the display image based on the second play related data among one or more prestored images (e.g., any type of image of throwing the dart pin). As the display image is determined, the display unit 120 may display the play session related information including the actual image and the display image.

The play session related information may include the display image related to the second play related data and the prestored dart target unit related virtual image corresponding to the second play related data among one or more prestored images. Specifically, the network communication unit 150 may not receive, from another device 2000, the second play image and the actual image in which the dart pin thrown by the second player of another device 2000 is hit on the dart target unit, and receive only the second play related data, according to the determination of the control unit 100. In this case, the control unit 100 may determine the prestored dart target unit related virtual image corresponding to the second play related data, and the display image based on the second play related data. In addition, the display unit 120 may display the play session related information including the virtual image and the display image.

The control unit 100 of the dart game device 1000 may determine one of the prestored dart target unit related virtual image corresponding to the second play related data or the actual image in which the dart pin thrown by the second player of another device 2000 is hit on the dart target unit to be included in the play session related information.

Specifically, the control unit 100 may determine one of the virtual image or the actual image to be included in the play session related information based on communication network information or hardware information of the dart game device. Here, the communication network information may include the amount of data which flows for a specific time of the network equipment or the network bandwidth, The hardware information may include network interface card (NIC), ethernet card, and LAN card information which influence the network speed. The network communication unit 150 may receive the actual image when the control unit 100 determines that the actual image is included in the play session related information. Alternatively, the network communication unit 150 may receive the play result data of the second player when the control unit 100 determines that the prestored dart target unit related virtual image is included in the play session related information. In addition, the display unit 120 may display the play session related information so that the image determined by the control unit 100 is included in the play session related information.

The control unit 100 of the dart game device 1000 may determine a network grade for another device 2000 based on traffic information of a network constituted by the devices who participate in the play session. The network traffic information may include any type of factors which influence a performance or a speed of the network, such as an amount of data which flows for a specific time of a network equipment, a network bandwidth, hardware information which influences the network speed, etc. The network grade may mean a quantitative indicator indicating the performance or speed of the network.

The network communication unit 150 may receive the second play image in which the second player throws the dart pin from another device 2000 having a first grade based on the determined network grade. Alternatively, the network communication unit 150 may receive, from another device 2000 having the first grade, at least one of the second play image and the actual image in which a dart pin thrown by the second player is hit on the dart target unit based on the determined network grade. The network communication unit 150 may directly receive the image photographed through the camera unit of another device 2000 from another device 2000 having a high network grade. The network communication unit 150 may receive second play related data not including the second play image from another device 2000 having the second grade. In other words, the network communication unit 150 may receive only the second play result data of the second player from another device 2000 having the second grade. In this case, the control unit 100 may determine the display image related to the second play related data among one or more prestored images based on the second play related data. The network communication unit 150 may receive only play result data having a relatively smaller size than the play related image from another device 2000 having a low network grade. In this case, the control unit 100 may determine an appropriate image according to traffic of the network constituted by the devices which participate in the play session, and provide the determined image to the player. Hereinafter, an example of a method for determining the network grade for another device 2000 based on traffic information by the control unit 100 according to the present disclosure will be described through FIG. 7.

According to some embodiments of the present disclosure, the display unit 120 of the dart game device 1000 may additionally display information related to the play time constraint when displaying the play session related information.

Here, the information related to the play time constraint may include at least one of a first play constraint time period including the time constraint for the dart pin throwing, a second play constraint time period including a time constraint for a round which permits dart pin throwing of N times, a third play constraint time period including a time constraint for a set including K rounds, or a waiting time period predetermined between two sets. Accordingly, the display unit 120 may display, in the display unit 120, time constraints for each of the dart pin throwing, the round, and the set assigned to a plurality of players who participate in the dart game, and a waiting time assigned between the sets.

When the play time constraint is described more, the play time constraint may be a time constraint similarly assigned to the plurality of players who participate in the same play session.

Specifically, the time constraint for the dart pin throwing may be similarly assigned to the first player and the second player who participate in the first play session.

For example, when the time constraint for the dart pin throwing is assigned to the first player as 5 seconds, the time constraint for the dart pin throwing may also be assigned to the second player as 5 seconds. However, the present disclosure is not limited thereto.

In the present disclosure, a penalty may be given to a player which exceeds the time constraint for the dart pin throwing.

For example, when it is determined that the first player exceeds the time constraint for the dart pin throwing, the control unit 100 of the dart game device 1000 may extinguish an opportunity for the corresponding dart pin throwing. As a specific example, as the dart game, a 01 game (zero one game), a cricket game, a count-up game etc., may be primarily played. In addition, in respective games, three opportunities of dart pin throwing may be given in one round. In this case, the control unit 100 may extinguish a throwing opportunity which exceeds the time constraint among three dart pin throwing opportunities.

As another example, when it is determined that the first player exceeds the time constraint for the dart pin throwing, the control unit 100 of the dart game device 1000 may also subtract a part of a score acquired by the corresponding dart pin throwing. As a specific example, a dart pin which the player throws by exceeding the time constraint for the throwing opportunity may reach a 20-point region. In this case, the control unit 100 may also determine that a score which the player acquires as the dart pin throwing opportunity by subtracting a part from 20 points is 18 points. However, the present disclosure is not limited thereto.

Further, in the present disclosure, the penalty may be given to a player which exceeds the time constraint for the round which permits the dart pin throwing of N times.

As an example, the control unit 100 of the dart game device 1000 may extinguish an opportunity for throwing a third dart pin when the time constraint for the round is exceeded without recognizing the throwing of the third dart pin in a round which permits three dart pin throwing.

As another example, the control unit 100 of the dart game device 1000 may extinguish the score acquired in the corresponding round when the time constraint for the round is exceeded without recognizing the throwing of the third dart pin.

As yet another example, when the time constraint for the round is exceeded, the control unit 100 of the dart game device 1000 may also allow a time given to the player in the next round to be shortened by further increasing a time constraint given in the next round.

Further, in the present disclosure, the penalty may be given to a player which exceeds the time constraint for the set including N rounds.

As an example, when the time constraint for the set is exceeded, the control unit 100 of the dart game device 1000 may also allow a time given to the player in the next set to be shortened by further increasing a time constraint given in the next set.

In displaying the play session related information based on the second play related data by the display unit 120 of the dart game device 1000, the control unit 100 may determine a display mode of the second play related data.

Specifically, the network communication unit 150 may receive the second play related data of the second player of another device 2000. In this case, the control unit 100 may compare previous play related data and the second play related data of the second player prestored in the storage unit 110. In addition, the control unit 100 may determine whether to display the second play image of the second player, or determine the display mode of the second play related data based on the comparison between the previous play related data and the second play related data.

The play session related information displayed in the display unit 120 may be the second play image in which the second player throws the dart pin determined based on the previous play related data. Whenever the second play related data is received through the network communication unit 150, when the control unit 100 generates the play session related information, a load may increase in the control unit 100. Accordingly, the control unit 100 may compare the previous play related data and the second play related data. In addition, the control unit 100 may determine whether to display the second play image of the second player, or determine the display mode of the second play related data based on the comparison result.

For example, when the control unit 100 determines that there is a large change in the score of the second player based on a comparison between previous play result data and second play result data, the control unit 100 may display the second play image of the second player. As an example, the large change may mean a difference between a previous score and a current score, which is larger than a predetermined threshold criterion.

As another example, the control unit 100 determines that there is no large change in the score of the second player based on the comparison between the previous play result data and the second play result data. In this case, the control unit 100 may determine an image such as a character related to the second player, which is currently displayed to be maintained.

As yet another example, the control unit 100 may determine that there is a large change when the second player who acquires only a low score of 1 point to 5 points acquires 20 points based on the previous play result data. In this case, the control unit 100 may determine a prestored image related to acquisition of 20 points to be displayed. However, the present disclosure is not limited thereto.

According to some embodiments of the present disclosure, the network communication unit 150 of the dart game device 1000 may receive third play related data of another device 2000 which participates in another play session other than the play session in which the dart game device 1000 participates. In this case, the display unit 120 may additionally display the third play related data.

Specifically, the dart game device 1000 may participate in one play session among a plurality of play sessions in a tournament-mode dart game. Further, there may be a predetermined player or a specific player in another play session other than the play session in which the dart game device 1000 participates. In this case, the network communication unit 150 may receive the third play related data from another device 2000 of the predetermined player or the specific player. In addition, the display unit 120 may additionally display the third play related data. However, the present disclosure is not limited thereto.

According to the above-described configuration, the dart game device 1000 participates in a play session in which the play time constraint is assigned to two or more devices to provide the real-time online dart game to the player. Further, the dart game device 1000 may display information related to a play session in which the dart game device 1000 participates in the display unit 120. Accordingly, the dart game device 1000 may inspire an interest of the player who participates in the dart game.

According to some embodiments of the present disclosure, the play session related information may include an object that displays information related to another device 2000. In this case, the control unit 100 of the dart game device 1000 may determine a display attribute for the object to be displayed in the display unit 120. Here, the object may mean any type of information displayed in the dart game device 1000 or another device 2000. The display attribute may include information on a region in which the object is to be displayed, a location at which the object is to be displayed, or a size in which the object is to be displayed. Hereinafter, a method for determining the display attribute for the object by the control unit 100 according to the present disclosure will be described through FIG. 5.

Figure 5:
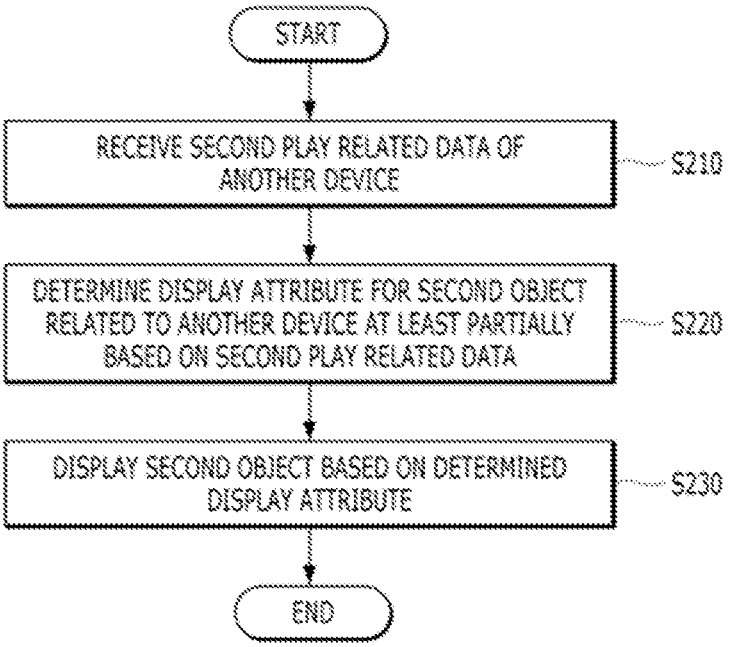
FIG. 5 is a flowchart describing an example of a method for determining a display attribute for an object by the dart game device according to some embodiments of the present disclosure.

FIG. 5 is a flowchart describing an example of a method for determining a display attribute for an object by the dart game device according to some embodiments of the present disclosure.

Referring to FIG. 5, the network communication unit 150 of the dart game device 1000 may receive the second play related data of another device 2000 (S210). Here, another device 2000 may be a device which participates in the same play session as the dart game device 1000.

Additionally, the network communication unit 150 may also receive third play related data of another device 2000 which participates in another play session other than the play session in which the dart game device 1000 participates.

According to some embodiments of the present disclosure, the second play related data may include result data of playing through two or more devices during a time period at least partially overlapped according to the time constraint assigned in the play session.

Specifically, the dart game device 1000 and another device 2000 may participate in a play session which assigns the play time constraints to two or more devices in order to permit the real-time dart game play. As a result, in a dart game conducted during the play session or at least one sub play session included in the play session, the first player and the second player may conduct the dart game during at least partially overlapped time period. Accordingly, the second play related data may include result data of playing during a time period of being at least partially overlapped with the first play related data. However, the present disclosure is not limited thereto.

The control unit 100 of the dart game device 1000 may determine a display attribute for an object related to another device 2000 at least partially based on the second play related data (S220).

Here, the object related to another device 2000 may include at least one of an image in which the second player of another device 2000 throws the dart pin within a time period included in the play session, a predetermined character image for identifying the second player, a predetermined text for identifying the second player, or an image related to the dart target unit of the second player. However, the present disclosure is not limited thereto. Hereinafter, an additional embodiment for the object related to another device 2000 will be described through FIG. 11.

The display attribute may be a property or feature for the object determined by the control unit 100 so as to display the object related to another device 2000 in the display unit 120. In an embodiment, the display attribute may include a first attribute, a second attribute, a third attribute, a fourth attribute, and a fifth attribute related to the object.

The first attribute may be an attribute that indicates a region in which the object is to be displayed.

Specifically, the display unit 120 of the dart game device 1000 may include a first region and a second region provided in a region different from the first region. For example, the first region may be a region more adjacent to the dart target unit 200 of the dart game device 1000 than the second region. Due to characteristics of the dart game, the players may have a relatively higher visual concentration for the dart target unit 200 and a peripheral portion of the dart target unit 200 than another region. In addition, the first region and the second region may be limited in physical space. Accordingly, the control unit 100 may determine a first attribute that indicates in which region of the first region and the second region the object is to be displayed based on the second play related data.

Further, the second attribute may be an attribute that indicates a location at which the object is to be displayed.

Specifically, when the first attribute for the region in which the object is to be displayed is determined, the control unit 100 may determine the second attribute for the location at which the object is to be displayed in the determined region.

For example, objects related to eight other devices 2000 may be displayed in the first region. In this case, the control unit 100 may determine a second attribute for a location at which each of the eight objects is to be displayed in the first region. However, the present disclosure is not limited thereto.

Further, the third attribute may be an attribute that indicates the display size for the object.

Specifically, the first region and the second region may have different sizes. As a result, the control unit 100 may determine the third attribute that indicates the display size for the object to fit the size of each region.

Further, in the dart game device 1000, sizes of display regions 121 and 122 may be different according to the embodiment. In this case, the size of the first region may be different and the size of the second region may also be different according to the dart game device 1000. As a result, the control unit 100 may also determine the third attribute for the object to fit the sizes of the respective display regions 121 and 122.

Further, according to the embodiment, the display size for the object may also be determined based on information other than the display regions 121 and 122.

For example, the control unit 100 may determine an object related to a predetermined player among a plurality of objects related to a plurality of other devices as an object to be displayed in the display unit 120. The control unit 100 may also determine a size of the object related to the predetermined player to be larger than sizes of a plurality of other objects. Hereinafter, an example for the size of the object displayed in the display unit 120 will be described through FIG. 12.

The fourth attribute may be an attribute that indicates whether the object is to be displayed.

As an example, the control unit 100 may determine the fourth attribute so as not to display an object related to another device 2000 having low relevance with the first player of the dart game device 1000 among the plurality of objects. Alternatively, the control unit 100 may determine the fourth attribute so as to display an object related to another device 2000 having high relevance with the first player among the plurality of objects.

As another example, the control unit 100 may also determine the fourth attribute that indicates whether the object related to another device 2000 is to be displayed based on traffic information of the network.

Further, the fifth attribute may be an attribute that indicates a form of the displayed object.

Specifically, the object related to another device 2000 may have various forms according to the display region.

For example, the control unit 100 may determine the fifth attribute so that an object displayed in the first region and an object displayed in the second region have different forms. However, the present disclosure is not limited thereto. Hereinafter, the embodiment for the object according to the present disclosure will be described through FIGS. 11 to 13.

The display unit 120 of the dart game device 1000 may display the object related to another device 2000 based on the determined display attribute (S230).

For example, the display unit 120 may display the object related to another device 2000 in the determined region based on the first attribute. As another example, the display unit 120 may display the object related to another device 2000 at the determined location based on the second attribute. However, the present disclosure is not limited thereto.

According to some embodiments of the present disclosure, the control unit 100 of the dart game device 1000 may also determine the display attribute for the object related to another device 2000 additionally based on the first play related data of dart game device 1000.

Specifically, the control unit 100 compares the first play related data of the dart game device 1000 and the second play related data of another device 2000 to determine the display attribute for the object related to another device 2000.

For example, the control unit 100 may compare first ranking information included in the first play related data and second ranking information included in the second play related data. In addition, the control unit 100 may determine the display attribute for the object related to another device 2000 based on a proximity between a first ranking and a second ranking. Here, the proximity may indicate how close the first ranking and the second ranking are.

As an example, the control unit 100 may determine the first attribute so as to display an object related to another device 2000 determined to have high proximity in the first region of the display unit 120. In addition, the control unit 100 may determine the first attribute so as to display an object related to another device 2000 determined to have a relatively low proximity in the second region of the display unit 120.

According to some embodiments of the present disclosure, the control unit 100 of the dart game device 1000 may compare the first play related data of the dart game device 1000 and the second play related data of another device 2000. In addition, the control unit 100 may determine objects related to devices of a predetermined number among a plurality of other devices which participate in the play session based on a comparison result. In this case, the display unit 120 may display the determined objects.

Specifically, the control unit 100 may determine a proximity between first ranking information included in the first play related data and second ranking information included in the second play related data within the time period included in the play session. In addition, the control unit 100 may determine the objects related to the devices of the predetermined number as the object to be displayed in the display unit 120 according to the determined proximity.

As an example, the control unit 100 may determine objects related to devices of a predetermined number having a high proximity as the object to be displayed in the display unit 120 based on the proximity between the first ranking information and the second ranking information. In this case, objects related to other devices 2000 of a predetermined number having a proximate ranking to the dart game device 1000 among a plurality of other devices may be determined as the object to be displayed in the display unit 120 regardless of a ranking higher or lower than a ranking of the dart game device 1000.

For example, the ranking of the first player of the dart game device 1000 may be $50^{th}$ in the play session. In this case, objects related to other devices 2000 of the second players of which ranking is $46^{th}$ to $49^{th}$ and $51^{st}$ to $54^{th}$ respectively among a plurality of other devices may be determined as the object to be displayed in the display unit 120.

As a specific example, when the ranking of the first player is $50^{th}$ in the play session, the control unit 100 may determine the second players having the rankings of $49^{th}$ and $51^{st}$ having a highest proximity to $50^{th}$. The control unit 100 may determine the second players having the rankings of $48^{th}$ and $52^{nd}$ having a second highest proximity to the ranking of the first player. By such a mode, the control unit 100 may determine a predetermined number, i.e., eight second players of which rankings are $46^{th}$ to $49^{th}$ and $51^{st}$ to $54^{th}$. When the second players of which rankings are $46^{th}$ to $49^{th}$ and $51^{st}$ to $54^{th}$ are determined, the control unit 100 may determine the objects related to the respective second players as the object to be displayed in the first region of the display unit 120. In addition, the control unit 100 may determine objects related to remaining respective players other than $46^{th}$ to $49^{th}$ and $51^{st}$ to $54^{th}$ as the object to be displayed in the second region of the display unit 120. Here, the first region may be a region more adjacent to the dart target unit 200 of the dart game device 1000 than the second region. Due to characteristics of the dart game, the players may have a relatively higher visual concentration for the dart target unit 200 and a peripheral portion of the dart target unit 200 than another region. Accordingly, the control unit 100 may determine the objects related to the second players of which rankings are $46^{th}$ to $49^{th}$ and $51^{st}$ to $54^{th}$ to be displayed in the first region adjacent to the dart target unit 200.

When the second players are determined, the control unit 100 of the dart game device 1000 may also display the objects related to the second players, respectively in the second region of the display unit 120. Information displayed in the second region may be information related to all rankings of play sessions in which players of the dart game device 1000 and another device 2000 participate. Accordingly, the control unit 100 may also determine displaying the objects related to the second players in the second region in addition to the first region. The control unit 100 may determine the object related to the second players displayed in the second region to be displayed in different forms from an object related to the remaining players which are displayed in the second region. For example, the control unit 100 may highlight the object related to the second players so as to emphasize the objects related to the second players rather than the objects related to the remaining players. As another example, the object related to the remaining players other than the second players displayed in the second region may be displayed in a text format including identification information. In this case, the control unit 100 may also display a form in which the object related to the second players occupies only a location in the second region without displaying information. In this case, a location at which the object related to the second players should be displayed in the second region may be displayed as a blank. As a specific example, identification information of each of 100 players may be displayed in the text format based on the ranking in the second region, and a ranking of the first player of the dart game device 1000 may be $50^{th}$. In this case, the control unit 100 may determine the objects related to the second players of which rankings are $46^{th}$ to $49^{th}$ and $51^{st}$ to $54^{th}$ to be displayed as the blank in the second region. The dart game device 1000 or the dart game system 10000 according to the present disclosure may allow numerous players to simultaneously perform the dart game in the same play session. As a result, it may be difficult for the first player of the dart game device 1000 to confirm a location at which an object related to the first player is displayed in the second region. Accordingly, when the second players having a high proximity to the first player of the dart game device 1000 are determined, the control unit 100 may determine the object related to the second players to be emphasized.

According to some embodiments of the present disclosure, the control unit 100 may determine an upper device having a ranking higher than the ranking of the dart game device 1000 among a plurality of other devices based on first ranking information and second ranking information. The control unit 100 may determine objects related to devices of a predetermined number having a high proximity as the object to be displayed in the display unit 120 based on the second ranking information of the upper device and the first ranking information of the dart game device 1000. In this case, devices up to a predetermined number from a ranking immediately higher than the ranking of the dart game device 1000 may be determined as the objects to be displayed in the display unit 120.

As a specific example, the ranking of the first player of the dart game device 1000 may be $50^{th}$ in the play session. In this case, an object related to each of other devices 2000 of the second player of which ranking is $42^{nd}$ to $49^{th}$ among the plurality of other devices may be determined as the object to be displayed in the display unit 120. However, the present disclosure is not limited thereto.

As another example, the control unit 100 may determine the upper device having the ranking higher than the ranking of the dart game device 1000 among the plurality of other devices based on the first ranking information and the second ranking information. The control unit 100 may determine objects related to devices of a predetermined number having low proximity as the object to be displayed in the display unit 120 based on the second ranking information of the upper device and the first ranking information of the dart game device 1000. In this case, devices up to a predetermined number from a highest ranking of the dart game device 1000 may be determined as the objects to be displayed in the display unit 120.

As a specific example, the ranking of the first player of the dart game device 1000 may be $50^{th}$ in the play session. In this case, a ranking having lowest proximity to $50^{th}$ among upper devices may be $1^{st}$. Accordingly, an object related to each of other devices 2000 of the second players of which rankings are $1^{st}$ to $8^{th}$ among the plurality of other devices may be determined as the object to be displayed in the display unit 120. However, the present disclosure is not limited thereto.

As another example, the control unit 100 may determine a lower device having a ranking lower than the ranking of the dart game device 1000 among the plurality of other devices based on the first ranking information and the second ranking information. The control unit 100 may determine objects related to devices of a predetermined number having high proximity as the object to be displayed in the display unit 120 based on the second ranking information of the lower device and the first ranking information of the dart game device 1000. In this case, devices up to a predetermined number from a ranking immediately lower than the ranking of the dart game device 1000 may be determined as the objects to be displayed in the display unit 120.

As a specific example, the ranking of the first player of the dart game device 1000 may be $50^{th}$ in the play session. In this case, an object related to each of other devices 2000 of the second players of which ranking are $51^{st}$ to $59^{th}$ among the plurality of other devices may be determined as the object to be displayed in the display unit 120. However, the present disclosure is not limited thereto.

As another example, the control unit 100 may determine a lower device having a ranking lower than the ranking of the dart game device 1000 among the plurality of other devices based on the first ranking information and the second ranking information. The control unit 100 may determine objects related to devices of a predetermined number having a low proximity as the object to be displayed in the display unit 120 based on the second ranking information of the lower device and the first ranking information of the dart game device 1000. In this case, devices up to a predetermined number from a lowest ranking may be determined as the objects to be displayed in the display unit 120.

As a specific example, the ranking of the first player of the dart game device 1000 may be $50^{th}$ in the play session. In this case, a ranking having a lowest proximity to $50^{th}$ among the lower devices may be $100^{th}$. Accordingly, an object related to each of other devices 2000 of the second players of which rankings are $93^{rd}$ to $100^{th}$ among the plurality of other devices may be determined as the object to be displayed in the display unit 120. However, the present disclosure is not limited thereto.

According to some embodiments of the present disclosure, the control unit 100 of the dart game device 1000 may determine the number of objects to be displayed in the display unit 120 in advance based on traffic information related to a transmission/reception speed of the network.

For example, the control unit 100 may recognize a network transmissions/reception speed between the dart game device 1000 and the plurality of other devices or the dart game server 3000 based on the traffic information. The control unit 100 may determine the number of objects related to other devices 2000 to be displayed in the display unit 120 based on the recognized speed. However, the present disclosure is not limited thereto. Hereinafter, an example of a method for determining the number of objects related to other devices 2000 to be displayed in the display unit 120 in advance based on the traffic information by the control unit 100 will be described through FIG. 7.

When objects related to devices of a predetermined number are determined, the control unit 100 of the dart game device 1000 may determine display attributes of the determined objects.

As an example, the control unit 100 may determine the objects related to the devices of the predetermined number to be displayed in a first form. The control unit 100 may determine objects related to devices other than the devices of the predetermined number among the plurality of other devices who participate in the play session to be displayed in a second form different from the first form. Here, the first form may include at least one of an image in which the second player throws the dart pin, a predetermined character image for identifying the second player, or a predetermined text for identifying the second player. In addition, the second form may include identification information of the second player.

Specifically, the objects related to the devices of the predetermined number may be important information for the first player of the dart game device 1000. Accordingly, the control unit 100 may determine the objects related to the devices of the predetermined number to be displayed in the first form. In addition, the control unit 100 may display the objects related to the devices other than the devices of the predetermined number in the second form. However, the present disclosure is not limited thereto, and the control unit 100 may also display the objects related to the devices other than the devices of the predetermined number in the first form when the size of the display unit 120, utilizable resources, or network traffic is sufficient.

When the objects related to the devices of the predetermined number are determined, the control unit 100 may determine the objects related to the devices of the predetermined number to be displayed in the first region. In addition, the control unit 100 may determine the objects related to devices other than the devices of the predetermined number among the plurality of other devices who participate in the play session to be displayed in a second region different from the first region. Here, the first region may be a region more adjacent to the dart target unit 200 of the dart game device 1000 than the second region.

Specifically, due to characteristics of the dart game, the players may have a relatively higher visual concentration for the dart target unit 200 and a peripheral portion of the dart target unit 200 than another region. Accordingly, the control unit 100 may determine the objects related to the devices of the predetermined number to be displayed in the first region adjacent to the dart target unit 200.

Further, the objects to be displayed in the first region may also be displayed in the second region in a display form different from a display form in which the objects are displayed in the first region.

Specifically, the control unit 100 may determine objects displayed in the first region as a first form including a dart pin throwing image. In addition, objects displayed in the second region may be determined as a second form including identification information of the player. Information displayed in the second region may be information related to rankings of play sessions in which the players of the dart game device 1000 and another device 2000 participate. As a result, the objects displayed in the first region may also be displayed in the second region in the second form including the identification information of the player. However, the present disclosure is not limited thereto. Hereinafter, examples for the first form and the second form will be described through FIG. 13.

The control unit 100 of the dart game device 1000 may determine sizes of the objects related to the devices of the predetermined number displayed in the first region. In addition, the control unit 100 may determine sizes of objects related to devices other than devices of a predetermined number displayed in the second region to be smaller than the sizes of the objects displayed in the first region. However, the present disclosure is not limited thereto.

According to some embodiments of the present disclosure, the control unit 100 of the dart game device 1000 may determine objects related to devices other than devices of a predetermined number not to be displayed.

Specifically, when the objects related to the devices of the predetermined number are determined, the control unit 100 may determine the objects related to the devices of the predetermined number to be displayed. Here, a region in which the objects related to the devices of the predetermined number are displayed may also be the first region and the second region. Alternatively, the objects related to the devices of the predetermined number may also be displayed in both the first region and the second region. In addition, the control unit 100 may determine the objects related to the devices other than the devices of the predetermined number among the plurality of other devices who participate in the play session not to be displayed.

According to some embodiments of the present disclosure, the control unit 100 of the dart game device 1000 may determine the display attribute for the object related to the dart game device 1000 based on the first play related data of dart game device 1000. That is, the control unit 100 may determine a display attribute for the object related to the first player of the dart game device 1000. The display unit 120 may display the object related to the dart game device 1000 based on the determined display attribute. A region in which the object related to the dart game device 1000 is displayed may be different from a region in which the object related to another device 2000 is displayed.

As an example, the control unit 100 may determine the objects related to the plurality of other devices to be displayed in the first and second regions the display unit 120. In addition, the control unit 100 may determine the object related to the dart game device 1000 to be displayed in a third region different from the first and second regions so that the object related to the dart game device 1000 is distinguished and displayed from the objects related to the plurality of other devices.

The control unit 100 of the dart game device 1000 may display the object related to the dart game device 1000 in the second region in a display form different from a display form of the object displayed in the third region. In this case, the player may also determine a ranking thereof through the object displayed in the second region in which information related to the ranking of the play session is displayed.

The control unit 100 of the dart game device 1000 may also display the object related to the dart game device 1000 in a third form different from the second form of objects of another device 2000 displayed in the second region.

Specifically, the third form may be a form in which the object related to the dart game device 1000 is highlighted to be emphasized, or may also be a form in which the identification information is not displayed, and the object occupies one location in the second region.

For example, the dart game device 1000 or the dart game system 10000 according to the present disclosure may allow numerous players to simultaneously perform the dart game in the same play session. In this case, it may be difficult for the player to confirm a location at which an object related to the player is displayed in the second region in which the information related to the ranking of the play session in which the dart game device 1000 participates is displayed. Accordingly, the control unit 100 may also determine the form of the object related to the dart game device 1000 as the third form different from the form of the objects related to the plurality of other devices so as to emphasize the object related to the dart game device 1000.

According to some embodiments of the present disclosure, the control unit 100 of the dart game device 1000 may also determine the number of objects to be displayed in the second region based on the number of plurality of other devices who participate in the play session.

According to the above-described configuration, the control unit 100 of the dart game device 1000 may determine a display attribute for the object related to another device 2000 through various methods. In addition, the display unit 120 may display the object related to another device 2000 based on the determined display attribute. Accordingly, the dart game device 1000 may effectively provide information related to another device 2000 to the player.

According to some embodiments of the present disclosure, the control unit 100 of the dart game device 1000 may also change relative locations of a plurality of objects based on play related data of another device 2000. Hereinafter, an example of a method for changing the relative locations of the plurality of objects by the control unit according to the present disclosure will be described through FIG. 6.

Figure 6:
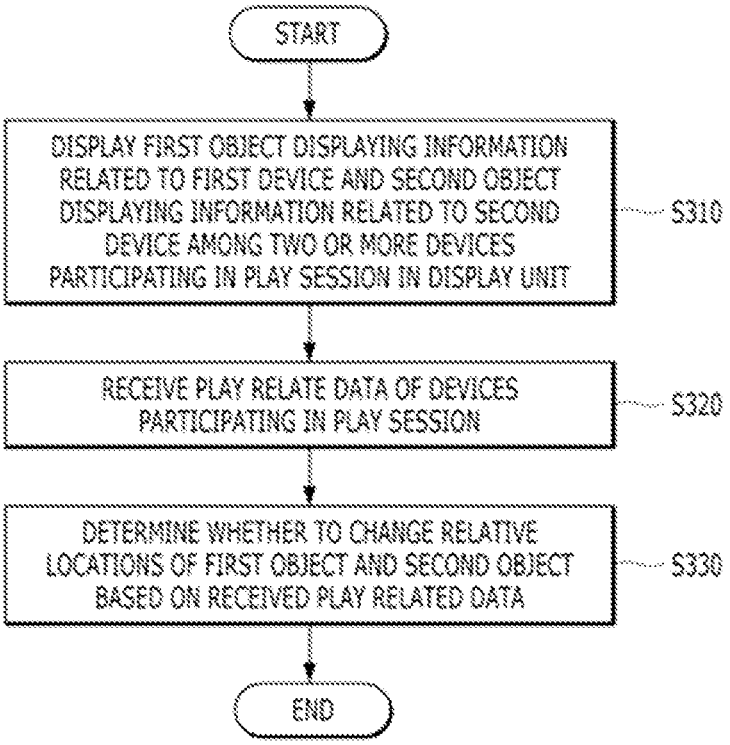
FIG. 6 is a diagram describing an example of a method for changing relative locations of a first object and a second object by the dart game device according to some embodiments of the present disclosure.

FIG. 6 is a diagram describing an example of a method for changing relative locations of a first object and a second object by the dart game device according to some embodiments of the present disclosure.

Referring to FIG. 6, the display unit 120 of the dart game device 1000 may display a first object displaying information related to a first device and a second object displaying information related to a second device among two or more devices which participate in a play session (S310). Here, the first device and the second device may be other devices 2000 other than the dart game device 1000.

Specifically, the control unit 100 may determine a display attribute for each of the first object and the second object based on previous play related data related to the first device and the second device received through the network communication unit 150. In addition, the display unit 120 may display the first object and the second object based on the determined display attribute.

The network communication unit 150 of the dart game device 1000 may receive play related data of devices which participate in the play session (S320).

Specifically, the network communication unit 150 may receive play related data related to the first device and the second device, respectively from the first device and the second device, respectively. Alternatively, the network communication unit 150 may also receive the play related data related to the first device and the second device, respectively from the dart game server 3000.

The control unit 100 of the dart game device 1000 may determine whether to change relative locations of the first object and the second object based on the play related data received through the network communication unit 150 (S330).

Specifically, the control unit 100 may determine whether to change the relative locations of the first object and the second object based on the received play related data and the play related data related to the play session of the dart game device 1000. Here, the change of the relative location may mean an operation in which the locations of the first object and the second object are exchanged with each other.

Figure 13A:
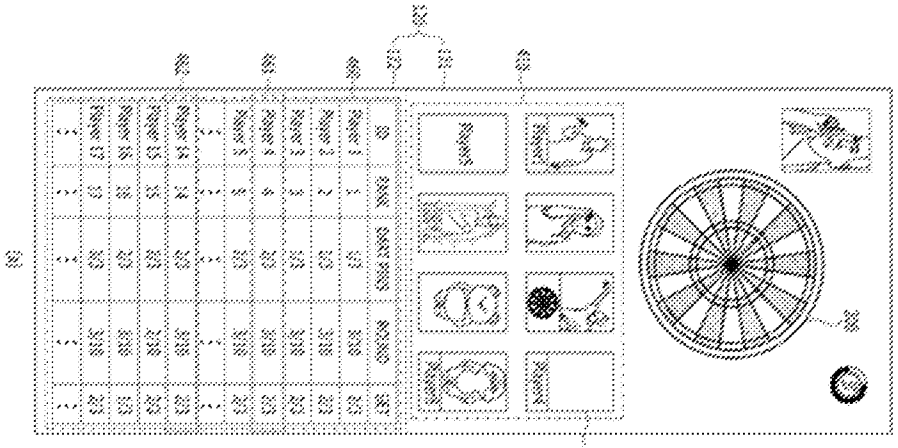
FIG. 13A is a diagram describing an example of a method for changing relative locations of a plurality of objects by the dart game device according to some embodiments of the present disclosure.
Figure 13B:
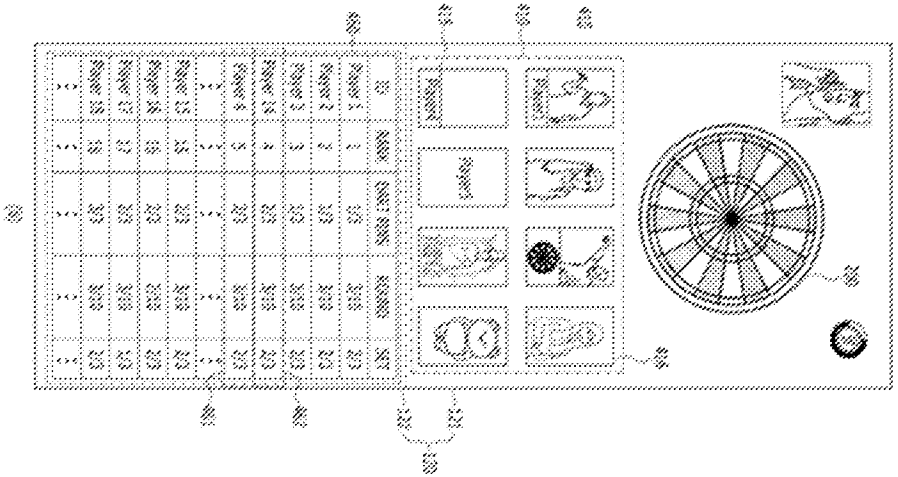
FIG. 13B is a diagram describing another example of a method for changing relative locations of a plurality of objects by the dart game device according to some embodiments of the present disclosure.

For example, referring to FIG. 13A, a first object 415 having a first form may be displayed in a first region 410 of the display unit 120. A second object 462 having a second form different from the first form may be displayed in a second region 460 of the display unit 120. In this case, the control unit 100 may determine whether to change relative locations of a first object 411 positioned in the first region 410 and a second object 412 positioned in the second region 460.

As another example, a first object 461 having a second form may be displayed in the second region 460 of the display unit 120. Further, a second object 462 having the second form may be displayed in the second region 460 of the display unit 120. In this case, the control unit 100 may determine whether to change relative locations of the first object 461 and the second object 412 based on the received play related data and the play related data related to the play session of the dart game device 1000. However, the present disclosure is not limited thereto.

As yet another example, both the first object and the second object may be objects positioned in the first region 410 of the display unit 120. In addition, the control unit 100 may determine whether to change relative locations of the first object and the second object different from the first object based on the received play related data and the play related data related to the play session of the dart game device 1000.

Referring back to FIG. 6, according to some embodiments of the present disclosure, the control unit 100 of the dart game device 1000 may change the relative locations of the first object and the second object based on the proximity in determining whether to change the relative locations of the first object and the second object. Here, the proximity may indicate a proximity to the ranking of the dart game device 1000.

Specifically, the control unit 100 may determine a first proximity between the play related data related the first object and the play related data of the dart game device 1000 based on the received play related data. Here, the first proximity may indicate how close the ranking of the player of the dart game device 1000 is to the ranking of the player related to the first object. Further, the control unit 100 may determine a second proximity between the play related data related the second object and the play related data of the dart game device 1000. Here, the second proximity may indicate how close the ranking of the player of the dart game device 1000 is to the ranking of the player related to the second object. When the first proximity and the second proximity are determined, the control unit 100 compares the first proximity and the second proximity to determine whether there is a change in superior relationship between the first proximity and the second proximity. In addition, when it is determined that there is the change in superior relationship between the first proximity and the second proximity, the control unit 100 may change the relative locations of the first object and the second object.

For example, the ranking of the player of the dart game device 1000 may be $50^{th}$ among 50 players in the play session. In addition, in step S310, the ranking of the first player related to the first object determined based on the previous play related data used for displaying the first object in the display unit may be $1^{st}$. In addition, the ranking of the second player related to the second object determined based on the previous play related data used for displaying the second object in the display unit may be $2^{nd}$. In this case, the first proximity between the ranking of the player of the dart game device 1000 and the first player may be more relatively lower than the second proximity between the ranking of the player of the dart game device 1000 and the second player. Thereafter, the superior relationship between the first proximity and the second proximity determined based on play related data which the control unit 100 of the dart game device 1000 newly receives through the network communication unit 150 may be changed. That is, the control unit 100 may determine that the first proximity is more relatively higher than the second proximity as a result of determining the first proximity and the second proximity based on the newly received play related data. In this case, the control unit 100 may change the relative locations of the first object and the second object. As such, the dart game device 1000 may provide a visual effect in which rankings of the plurality of other devices are changed in real time to the player. Accordingly, an interest for the dart game of the player who uses the dart game device 1000 may be promoted.

According to some embodiments of the present disclosure, the control unit 100 of the dart game device 1000 may perform a spinning operation of repeatedly exchanging the relative locations of the first object and the second object at a predetermined number of times. Here, the spinning operation may be an operation in which the relative locations of the first object and the second object are spun and exchanged with each other. For example, under the control of the control unit 100, the first object may be moved in a clockwise direction, and moved to a location at which the second object is displayed. By interlocking therewith, the second object may be moved in the clockwise direction, and moved to a location at which the first object is displayed. As another example, under the control of the control unit 100, the first object may be moved in a counterclockwise direction, and moved to the location at which the second object is displayed. By interlocking therewith, the second object may be moved in the counterclockwise direction, and moved to the location at which the first object is displayed.

When it is determined that there is the change in superior relationship between the first object and the second object, the control unit 100 of the dart game device 1000 may exchange the relative locations of the first object and the second object. Further, the control unit 100 may exchange the locations of the first object and the second object of which relative locations are exchanged again. The number of times at which the locations of the first object and the second object are repeatedly exchanged may be a predetermined odd number of times. Accordingly, the control unit 100 repeatedly exchanges the relative locations of the first object and the second object at the predetermined number of times, and may allow the relative locations of the first object and the second object to be displayed in a changed state finally. However, the present disclosure is not limited thereto.

According to some embodiments of the present disclosure, the control unit 100 of the dart game device 1000 may determine whether to change the relative locations of the first object and the second object based on the play related data received by the unit of the sub play session included in the play session.

As an example, the control unit 100 may determine whether to change the relative locations of the first object and the second object based on the play related data received by the unit of the round of the play session.

As another example, the control unit 100 may determine whether to change the relative locations of the first object and the second object based on the play related data received by the unit of a dart pin throwing action of the play session.

As yet another example, the control unit 100 may determine whether to change the relative locations of the first object and the second object based on the play related data received by the unit of the set of the play session.

According to some embodiments of the present disclosure, the control unit 100 of the dart game device 1000 may display the first object in the first region of the display unit 120 and display the first object and the second object in the second region different from the first region. The control unit 100 may determine the first object displayed in the first region to be displayed in the first form, and the first object displayed in the second region to be displayed in the second form different from the first form. Here, the first form may include at least one of an image in which the first player of the first device throws the dart pin, a predetermined character image for identifying the first player, or a predetermined text for identifying the second player. In addition, the second form may include identification information of the first player. Further, the control unit 100 may determine the location of the first object based on at least one of the scores or the rankings related to the first object and the second object in determining the location of the first object displayed in the second region. However, the present disclosure is not limited thereto.

The control unit 100 of the dart game device 1000 may change the location of the first object displayed in the second region based on the play related data received by the unit of the round or set of the play session when the first object is displayed in the second region.

Specifically, the control unit 100 may change the location of the first object in the second region based on the change in first proximity related to the first object. The control unit 100 may determine the location of the second object displayed in the second region to be changed by interlocking with the changed location of the first object as the location of the first object is changed.

According to the above-described configuration, the control unit 100 of the dart game device 1000 may change the relative locations of the first object and the second object based on the play related data. In this case, the dart game device 1000 may provide a visual effect in which the rankings of the plurality of other devices are changed in real time to the player.

According to some embodiments of the present disclosure, the network communication unit 150 of the dart game device 1000 may receive the second play related data of another device 2000 or receive the second play image based on the network grade. Hereinafter, a method for receiving at least one play related data based on the network grade by the network communication unit 150 according to the present disclosure will be described through FIG. 7.

Figure 7:
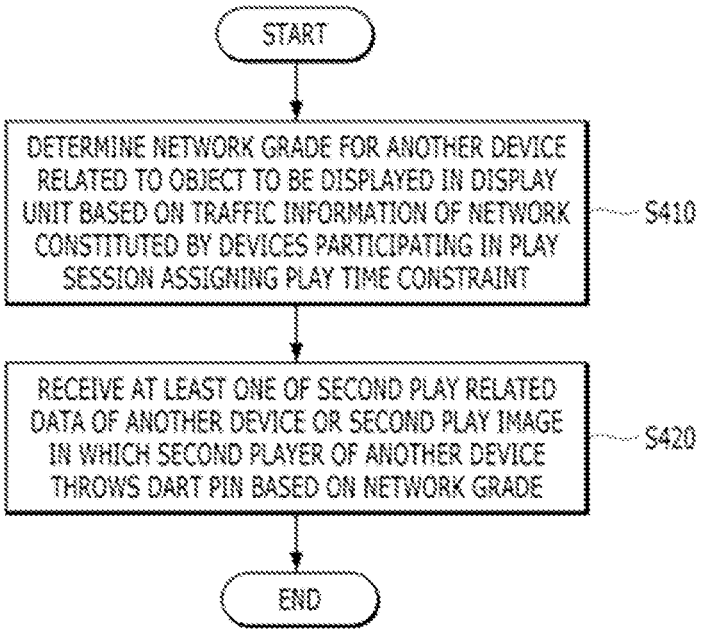
FIG. 7 is a diagram describing an example of a method for receiving at least one of second play related data of another device or a second play image in which a second player of another device throws a dart pin by the dart game device according to some embodiments of the present disclosure.

FIG. 7 is a diagram describing an example of a method for receiving at least one of second play related data of another device or a second play image in which a second player of another device throws a dart pin by the dart game device according to some embodiments of the present disclosure.

Referring to FIG. 7, the control unit 100 of the dart game device 1000 may recognize traffic information of a network constituted by devices which participate in a play session to which a play time constraint is assigned. The control unit 100 may determine a network grade for another device 2000 related to an object to be displayed in the display unit 120 based on the traffic information (S410). Here, the traffic information may be information on a transmission/reception speed of the network between the dart game device 1000 and another device 2000 or the dart game device 1000 and the dart game server 3000. Further, the traffic information may be received from the dart game server 3000 through the network communication unit 150. Alternatively, the traffic information may be determined based on a latency computed by transmitting/receiving a packet to/from another device 2000 by the network communication unit 150. However, the present disclosure is not limited thereto.

The network grade may be a grade which the control unit 100 determines according to a predetermined condition so as for the network communication unit 150 to receive different play related data according to the grade. The network grade may include any type of numerical values which may quantitatively express a communication capacity of the dart game device, the server, and/or a network related thereto.

Specifically, the control unit 100 may determine a network grade for another device 2000 having traffic less than predetermined traffic as a first grade based on the traffic information. The control unit 100 may determine a network grade for another device 2000 having traffic equal to or more than the predetermined traffic as a second grade. That is, the control unit 100 may determine a network grade for another device 2000 having an excellent transmission/reception speed of the network as the first grade. In addition, the control unit 100 may determine a network grade for another device 2000 having a relatively worse transmission/reception speed of the network than the first grade as the second grade. However, the present disclosure is not limited thereto.

The network communication unit 150 of the dart game device 1000 may receive at least one of second play result data of another device 2000 or a second play image in which the second player of another device 2000 throws the dart pin based on the network grade (S420).

Specifically, the network communication unit 150 may receive second play related data including the second play image and the second play result data from another device 2000 having the first grade. In addition, the network communication unit 150 may receive the second play related data including the second play result data from another device 2000 having the second grade. In other words, the network communication unit 150 may transmit second play related data not including the second play image from another device 2000 having the second grade.

In general, the play image photographed through the camera unit of another device 2000 may have a larger capacity than play result data including information on an acquired score according to dart pin throwing of another device 2000, information on a score acquired in a round which permits dart pin throwing of N times, etc. As a result, when the network communication unit 150 receives a play image from another device 2000 having the second grade, a long time may be required. Accordingly, the network communication unit 150 may receive second play related data including the second play image only from another device 2000 having the first grade. In addition, the network communication unit 150 may receive second play related data including only the second play result data without receiving the second play image from another device 2000 having the second grade. However, the present disclosure is not limited thereto.

According to some embodiments of the present disclosure, the network communication unit 150 of the dart game device 1000 may not receive the second play image from another device 2000 having the second grade. In this case, the control unit 100 may determine a display image related to the second play related data among one or more prestored images. In addition, the display unit 120 may display the display image determined by the control unit 100. Here, the display image may include at least one of a prestored image in which the second player throws the dart pin, a predetermined character image for identifying the second player, and a predetermined text for identifying the second player. In addition, the display unit 120 may display the determined display image. Accordingly, even though the network communication unit 150 may not receive the second play image from another device 2000 having the second grade, the display unit 120 may display the display image related to the second play related data. In this case, a visual effect to inspire an interest of the game may be provided to the player compared to displaying only identification information of another device 2000 based on the second play related data.

According to some embodiments of the present disclosure, an object displayed in the display unit 120 of the dart game device 1000 may also include a plurality of images. As an example, the object may include at least one of an image in which the second player of another device 2000 throws the dart pin within a time period included in the play session, a predetermined character image for identifying the second player, a predetermined text for identifying the second player, or an image related to the dart target unit of the second player. In this case, the network communication unit 150 may also receive only at least one image from another device 2000 having the first grade.

Specifically, the control unit 100 may determine an object including an image in which the second player of another device 2000 throws the dart pin and an image related to the dart target unit of the second player to be displayed. However, the network communication unit 150 may also receive only the image in which the second player of another device 2000 throws the dart pin. In this case, the control unit 100 may determine a prestored image corresponding to the image related to the dart target unit of the second player based on the second play related data. In addition, the control unit 100 may determine an object including the image in which the second player throws the dart pin and the prestored image to be displayed.

For example, the control unit 100 may recognize that the second player acquires 20 points based on the second play related data including only the second play result data. The image related to the dart target unit of the second player not received by the network communication unit 150 may be an image in which the dart pin of the second player reaches a 20-point region. In this case, the control unit 100 may determine an image in which the dart pin reaches a 20-point region among one or more images prestored in the storage unit 110. In addition, the control unit 100 may determine an object including the image in which the second player throws the dart pin and the image in which the dart pin reaches the 20-point region to be displayed. However, the present disclosure is not limited thereto.

According to some embodiments of the present disclosure, the network communication unit 150 of the dart game device 1000 may not receive the second play image from another device 2000 having the second grade. In this case, the control unit 100 may compare prestored previous play related data and the second play related data of another device 2000. In addition, the control unit 100 may determine whether to re-determine the network grade based on a comparison result.

Specifically, the control unit 100 may determine re-determining the network grade when there is a large difference from a predetermined threshold according to the comparison result between the previous play related data and the second play related data.

For example, the control unit 100 may compare the second play related data received from another device 2000 determined as the second grade with the previous play related data. The control unit 100 may re-determine the network grade of another device 2000 as the first grade when there is a large difference than a predetermined threshold according to the comparison result. For example, the control unit 100 may compare the previous play related data of another device 2000 prestored in the storage unit 110, and the second play related data. The control unit 100 may generate a difference value that indicates a difference between the previous play related data and the second play related data based on the comparison result. Further, the control unit 100 may determine re-determining the network grade of another device 2000 as the first grade when the difference value generated according to the comparison result is larger than a predetermined threshold. In this case, the network communication unit 150 may receive the second play image of another device 2000. However, the present disclosure is not limited thereto.

According to some embodiments of the present disclosure, the control unit 100 of the dart game device 1000 may additionally determine the number of objects to be displayed in the display unit 120 based on at least one of the traffic information or display unit information. Here, the display unit information may include at least one of information on a size of the display unit 120, information on the number of display units 120, and information on a display region of the display unit 120. However, the present disclosure is not limited thereto.

Specifically, the control unit 100 may recognize a network transmissions/reception speed between the dart game device 1000 and the plurality of other devices or the dart game server 3000 based on the traffic information. In addition, the control unit 100 may determine the number of objects related to other devices 2000 to be displayed in the display unit 120 based on the recognized speed.

For example, the control unit 100 may determine displaying objects related to more other devices 2000 in the display unit 120 as the recognized network transmission/reception speed is higher. However, the present disclosure is not limited thereto.

Further, the control unit 100 may determine the number of objects related to other devices 2000 to be displayed in the display unit 120 based on the display unit information.

For example, the control unit 100 may determine displaying objects related to more other devices 2000 as the size of the display unit 120 is larger based on the display unit information. Alternatively, the control unit 100 may determine displaying objects related to more other devices 2000 as the number of display units 120 is larger based on the display unit information. However, the present disclosure is not limited thereto.

Further, the control unit 100 may also determine the number of objects to be displayed in the display unit 120 based on both the traffic information and the display unit information.

As described above, the control unit 100 of the dart game device 1000 may determine the network grade for another device 2000 related to the object to be displayed in the display unit 120 based on the traffic information of the network. In this case, the network communication unit 150 may receive appropriate play related data from another device 2000 based on the network grade determined by the control unit 100. When the network communication unit 150 receives the play image not based on the network grade as in the present disclosure, a time required for receiving the play image may be longer than expected. In this case, real-time performance for the object related to another device 2000 to be displayed in the display unit 120 may be deteriorated. On the contrary, according to the present disclosure, the network communication unit 150 may receive the appropriate play related data from another device 2000 based on the network grade determined by the control unit 100. Accordingly, in the present disclosure, the above-described situation may be prevented, and real-time display for the object related to another device 2000 may be guaranteed.

According to some embodiments of the present disclosure, the network communication unit 150 of the dart game device 1000 may also determine play related data related to the dart game device 1000 to be transmitted to another device 2000 or the dart game server 3000 based on the network grade.

Specifically, the network communication unit 150 may also transmit at least one of the first play result data of the dart game device 1000 or the first play image in which the first player of the dart game device 1000 throws the dart pin based on the network grade.

For example, the network communication unit 150 may transmit first play related data including the first play image and the first play result data to another device 2000 having the first grade. In addition, the network communication unit 150 may transmit first play related data including the first play result data to another device 2000 having the second grade. In other words, the network communication unit 150 may transmit first play related data not including the first play image from another device 2000 having the second grade.

According to some embodiments of the present disclosure, the control unit 100 of the dart game device 1000 may also determine whether re-determine the network grade for another device 2000.

Specifically, when the first play image of the first player is photographed through the camera unit 140, the control unit 100 may recognize the first play image, and a previous play image of the first player prestored in the storage unit 110. In this case, the control unit 100 may determine whether to re-determine the network grade based on a comparison between the previous play image and the first play image.

For example, the control unit 100 may determine re-determining the network grade for another device 2000 when there is a large difference from a predetermined threshold according to the comparison result between the previous play related image and the first play image. For example, when the first play image is photographed through the camera unit 140, the control unit 100 compares the previous play image and the first play image of the first player prestored in the storage unit 110 to generate a difference value indicating a difference both images. The control unit 100 may determine re-determining the network grade of another device 2000 when the difference value generated according to the comparison result is larger than a predetermined threshold. In addition, the network communication unit 150 may transmit the first play image to another device 2000 based on the re-determined network grade. In this case, as the first player acquires a much higher score than the previous play or a specific event occurs, the photographed first play image may be displayed in the display unit 120 of another device 2000.

According to some embodiments of the present disclosure, the control unit 100 of the dart game device 1000 may also determine whether re-determine the network grade for another device 2000 based on the play related data of the first player.

Specifically, the control unit 100 may determine whether to re-determine the network grade based on a comparison between previous play related data of the first player prestored in the storage unit 110 and the first play related data.

For example, the control unit 100 may determine re-determining the network grade when there is a large difference from a predetermined threshold according to the comparison result between the previous play related data and the first play related data. For example, the control unit 100 may compare the previous play related data of the first player in the storage unit 110, and the first play related data. The control unit 100 may generate a difference value that indicates a difference between the previous play related data and the first play related data based on the comparison result. Further, the control unit 100 may determine re-determining the network grade for another device 2000 when the difference value generated according to the comparison result is larger than a predetermined threshold. In addition, the network communication unit 150 may transmit the first play image to another device 2000 based on the re-determined network grade. In this case, as the first player acquires a much higher score than the previous play or a specific event occurs, the photographed first play image may be displayed in the display unit 120 of another device 2000.

As described above, the network communication unit 150 of the dart game device 1000 may transmit appropriate play related data to another device 2000 or the dart game server 3000 based on the network grade determined by the control unit 100. When the network communication unit 150 transmits the play image not based on the network grade as in the present disclosure, a time required for transmitting the play image may be longer than expected. In this case, real-time performance for the object related to the dart game device 1000 to be displayed in the display unit of another device 2000 may be deteriorated. On the contrary, according to the present disclosure, the network communication unit 150 may transmit the appropriate play related data to another device 2000 based on the network grade determined by the control unit 100. Accordingly, in the present disclosure, the case of the situation may be prevented. Furthermore, when data which the network communication unit 150 should transmit to another device 2000 is delayed, the data delay may also exert an influence on a reception speed of data which the network communication unit 150 should receive. Accordingly, the network communication unit 150 may appropriately transmit/receive the play related data based on the network grade determined by the control unit 100.

According to some embodiments of the present disclosure, the above-described operations may also be performed by the dart game server 3000.

As an example, the control unit of the dart game server 3000 may determine a network grade for each of a plurality of other devices based on traffic information of a network constituted by devices who participate in a play session to which a play time constraint is assigned. Here, the plurality of other devices may include the dart game device 1000 and another device 2000. The network communication unit of the dart game server 3000 may receive play related data including at least one of play result data of the plurality of other devices or play images in which players of the plurality of other devices throw the dart pin based on the determined network grade of each of the plurality of other devices. For example, the network communication unit of the dart game server 3000 may receive second play related data including a second play image and second play result data from another device 2000 having the first grade based on the network grade. The network communication unit of the dart game server 3000 may receive second play related data including the second play result data of another device 2000 from another device 2000 having the second grade.

As another example, the network communication unit of the dart game server 3000 may transmit play related data including at least one of play result data of the plurality of other devices or play images in which players of the plurality of other devices throw the dart pin based on the determined network grade of each of the plurality of other devices. For example, the network communication unit of the dart game server 3000 may transmit first play related data including a first play image in which the first player of the dart game device 1000 throws the dart pin and first play result data of the first player to another device 2000 having the first grade based on the network grade. The network communication unit of the dart game server 3000 may transmit first play related data including the first play result data of the dart game device 1000 to another device 2000 having the second grade.

According to some embodiments of the present disclosure, the dart game server 3000 may determine a plurality of players who are to participate in a play session to be conducted after a first time period based on play result information of a plurality of devices conducted during the first time period. Hereinafter, a method for determining the plurality of players who are to participate in the play session to be conducted after the first time period by the dart game server 3000 according to the present disclosure will be described through FIG. 8.

Figure 8:
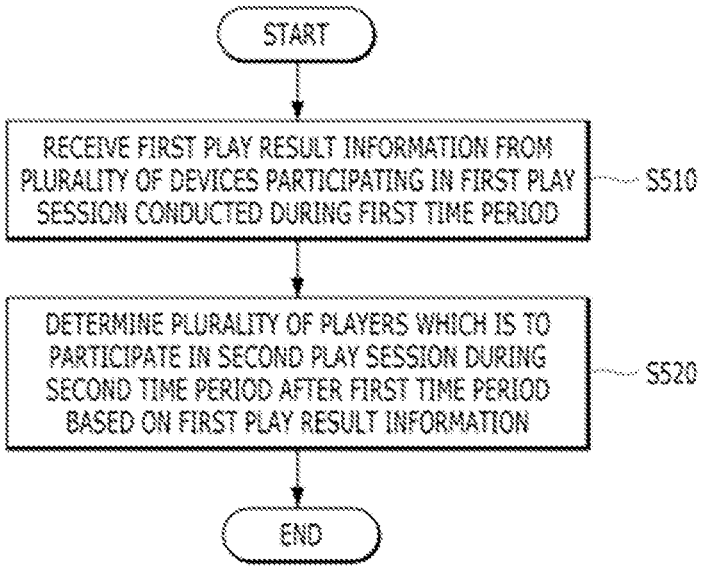
FIG. 8 is a flowchart describing an example of a method for determining a plurality of players who are to participate in a second play session to be conducted after a first time period by a dart game server according to the present disclosure.

FIG. 8 is a flowchart describing an example of a method for determining a plurality of players who are to participate in a second play session to be conducted after a first time period by a dart game server according to the present disclosure.

Referring to FIG. 8, the dart game server 3000 may receive first play result information from a plurality of devices who participate in a first play session which is conducted during a first time period (S510). Here, the first play result information may be information on a result generated as the first play session is ended. The first play result information may include identification information of each of the plurality of devices which participate in the first play session, information on a score for each player determined as the first play session is terminated, or information on a ranking for each player determined as the first play session is terminated.

According to some embodiments of the present disclosure, the first play result information may include result data of playing by the players of the plurality of devices during the first time period at least partially overlapped according to a time constraint assigned in the first play session.

Specifically, a first player who participates in the first play session having a time constraint during for 10 minutes from 10 a.m. on Oct. 1, 2021 may participate in the dart game for 10 minutes from 10 a.m. on Oct. 1, 2021. In addition, the second player may participate in the dart game for 8 minutes from 10 a.m. on Oct. 1, 2021. In this case, the first play result information may include result data of playing by the first player and result data of playing by the second player overlapped at least for 8 minutes.

As another example, the first player who participates in the first play session having the time constraint during for 10 minutes from 10 a.m. on Oct. 1, 2021 may participate in the dart game for 10 minutes from 10 a.m. on Oct. 1, 2021. In addition, the second player may participate in the dart game for 8 minutes from 10 a.m. on Oct. 1, 2021. Since the time constraint of the play session is from 10 a.m. to 10:10 a.m. on Oct. 1, 2021, both a play of the first player for 10 minutes and a play of the second player for 8 minutes may be recognized as the play result data.

The dart game server 3000 may determine a plurality of players who are to participate in a second play session during a second time period after the first time period based on the first play result information (S520). Here, the second time period of the second play session have the same period as the first time period, and may be a time period in which the second play session is conducted from a second time after a first time.

For example, the first play session and the second play session may be similarly assigned with the time constraint in which the dart game is conducted for 10 minutes. When the first play session is conducted from 10 a.m. on Oct. 1, 2021, the second play session may be conducted from a time after 10:10 a.m. on Oct. 1, 2021, such as 10:10 a.m. on Oct. 1, 2021 or 10:15 a.m. on Oct. 1, 2021. However, the present disclosure is not limited thereto, and the second play session and the first play session may also have different periods. As an example, the first play session may be conducted for 10 minutes, and the second play session may also be conducted for 15 minutes.

According to some embodiments of the present disclosure, the dart game server 3000 may determine a plurality of players having predetermined rankings as the player who is to participate in the second play session based on the ranking included in the first play result information.

For example, the dart game server 3000 may determine players of which rankings are $1^{st}$ and $2^{nd}$ in the first play session as players who are to participate in the second play session based on the first play result information. That is, the dart game server 3000 may determine the plurality of players having predetermined rankings in the first play session as the players who are to participate in the second play session.

As another example, the dart game server 3000 may determine players of which rankings are $1^{st}$, $3^{rd}$, and $5^{th}$ which are odd rankings in the first play session as the players who are to participate in the second play session based on the first play result information. However, the present disclosure is not limited thereto.

According to some other embodiments of the present disclosure, the dart game server 3000 may determine players in which rankings included in the first play result information are equal to or more than a predetermined ranking as the player who is to participate in the second play session.

For example, the dart game server 3000 may determine two players of which rankings are $2^{nd}$ or higher in the first play session as the player who is to participate in the second play session based on the first play result information. However, the present disclosure is not limited thereto.

According to some yet other embodiments of the present disclosure, the dart game server 3000 may receive first play result information of each of sub sessions in the first play session conducted during the first time period. In addition, the dart game server 3000 may determine a plurality of players of which rankings are the same in each of the sub sessions as the player who is to participate together in the second play session. Here, the sub session may be a play session conducted during the same time period as the first play session.

For example, the dart game server 3000 may determine a player of which ranking is $1^{st}$ in a 1-$1^{st}$ play session and a player of which ranking is $1^{st}$ in a 1-$2^{nd}$ play session in the first play session as the players who are to participate in the second play session together based on the first play result information. That is, the dart game server 3000 may determine a plurality of players having the same ranking in the first play session as the player who is to participate in the second play session. However, the present disclosure is not limited thereto.

According to some still yet other embodiments of the present disclosure, the dart game server 3000 may receive first play result information of each of the sub sessions in the first play session conducted during the first time period. In addition, the dart game server 3000 may determine players in which rankings included in the first play result information are equal to or more than a predetermined ranking as the player who is to participate in the second play session.

For example, the dart game server 3000 may determine two players of which rankings are $2^{nd}$ or higher in the 1-$1^{st}$ play session in the first play session as the player who is to participate in the second play session based on the first play result information. In addition, the dart game server 3000 may determine two players of which rankings are $2^{nd}$ or higher in the 1-$2^{nd}$ play session as the player who is to participate in the second play session. In other words, the dart game server 3000 may determine players of which rankings are $2^{nd}$ or more in each of the sub sessions in the first play session as the player who is to participate in the second play session. However, the present disclosure is not limited thereto.

According to some still yet other embodiments of the present disclosure, the dart game server 3000 may receive first play result information of each of the sub sessions in the first play session conducted during the first time period. In addition, the dart game server 3000 may determine a plurality of players of which rankings are different in each of the sub sessions as the player who is to participate together in the second play session.

For example, the dart game server 3000 may determine the player of which ranking is $1^{st}$ in the 1-$1^{st}$ play session and the player of which ranking is $2^{nd}$ in the 1-$2^{nd}$ play session in the first play session as the players who are to participate in the second play session based on the first play result information. That is, the dart game server 3000 may determine a plurality of players having different rankings in the first play session as the player who is to participate in the second play session. However, the present disclosure is not limited thereto.

According to some embodiments of the present disclosure, when a plurality of players are determined, the dart game server 3000 may transmit a first signal related to the second play session to devices related to the plurality of determined players, respectively. Here, the first signal may be a signal for checking whether to participate in the second play session. Further, the dart game server 3000 may also transmit information related to the second play session jointly when transmitting the first signal. Specifically, the dart game server 3000 may also transmit information related to a time for which the second play session is conducted, a date, or participants. The dart game server 3000 may transmit the first signal, and then receive at least one second signal corresponding to the first signal. In this case, the dart game server 3000 may confirm the player who is to participate in the second play session based on at least one second signal.

As an example, the first signal may be a signal for manually checking whether to participate in the second play session.

As a specific example, the first signal may be a signal including a text such as "Do you desire to participate in the second play session?". In this case, the text may be displayed in display units of a plurality of devices receiving the first signal. In addition, the dart game server 3000 may confirm the player who is to participate in the second play session based on the second signal which is a response signal to the first signal received from each of the plurality of devices.

As another example, the first signal may be a signal for actively checking whether to participate in the second play session.

As a specific example, the first signal may be a signal including a text such as "The second play session is scheduled to start after a while. When you does not desire participation, please, respond". In this case, the text may be displayed in the display units of the plurality of devices receiving the first signal. In addition, the dart game server 3000 may confirm players related to a plurality of devices who may not receive the second signal which is the response signal to the first signal, respectively as the player who is to participate in the second play session. However, the present disclosure is not limited thereto.

According to some embodiments of the present disclosure, when the dart game server 3000 recognizes that the number of players who are to participate in the second play session does not satisfy a predetermined person number, the dart game server 3000 may also add a dummy player. Hereinafter, an example of a method for generating the dummy player by the dart game server 3000 according to the present disclosure will be described through FIG. 10.

According to some embodiments of the present disclosure, the dart game server 3000 may also determine a plurality of players who are to participate in a next play session from a plurality of devices which participate in play sessions having different time periods.

Specifically, the dart game server 3000 may receive play result information from a plurality of devices who participate in a third play session which is conducted during a third time period and a fourth play session which is conducted during a fourth time period different from the third time period. The dart game server 3000 may determine a plurality of players who are to participate in a fifth play session during a fifth time period after the third time period and the fourth time period based on the play result information. For example, in the case of international competitions, it may be difficult for all players to participate in the third play session conducted during the third time period from a lower stage such as a qualifying round. Accordingly, the dart game server 3000 may receive play result information from a plurality of devices who participate in a plurality of play sessions having different time periods, respectively in the lower stage such as the qualifying round. For example, the dart game server 3000 may receive play result information from a plurality of devices who participate in the third play session conducted during the third time period from 10 a.m. on Oct. 1, 2021 to 10:10 a.m. on Oct. 1, 2021 based on the Korean Standard Time. Further, the dart game server 3000 may receive play result information from a plurality of devices who participate in the fourth play session conducted during the fourth time period from 10 a.m. on Oct. 1, 2021 to 10:10 a.m. on Oct. 1, 2021 based on the U.S. Central Standard Time. That is, the fourth play session may be conducted during a time period from 8 p.m. on Sep. 30, 2021 to 8:10 p.m. on Sep. 30, 2021 based on the Korean Standard Time. In this case, the dart game server 3000 may receive the play result information from the plurality of players who participate in the third play session and the fourth play session. In addition, the dart game server 3000 may also determine the plurality of players who is to participate in the fifth play session to which the same time constraint is assigned based on the play result information in a stage such as a final round. For example, the dart game server 3000 may determine the plurality of players who are to participate in the fifth play session conducted from 10 a.m. on Oct. 2, 2021 to 10:10 a.m. on Oct. 2, 2021 based on the Korean Standard Time. However, the present disclosure is not limited thereto.

According to the above-described configuration, the dart game server 3000 may determine a plurality of players who are to participate in the second play session to be conducted after the first time period. In this case, the dart game server 3000 may induce the players to perform consecutive games.

According to some other embodiments of the present disclosure, the dart game server 3000 may also determine the plurality of players who are to participate in the second play session for each group based on the rankings included in the first play result information. Hereinafter, another method for determining the plurality of players who are to participate in the second play session by the dart game server 3000 according to the present disclosure will be described through FIG. 9.

Figure 9:
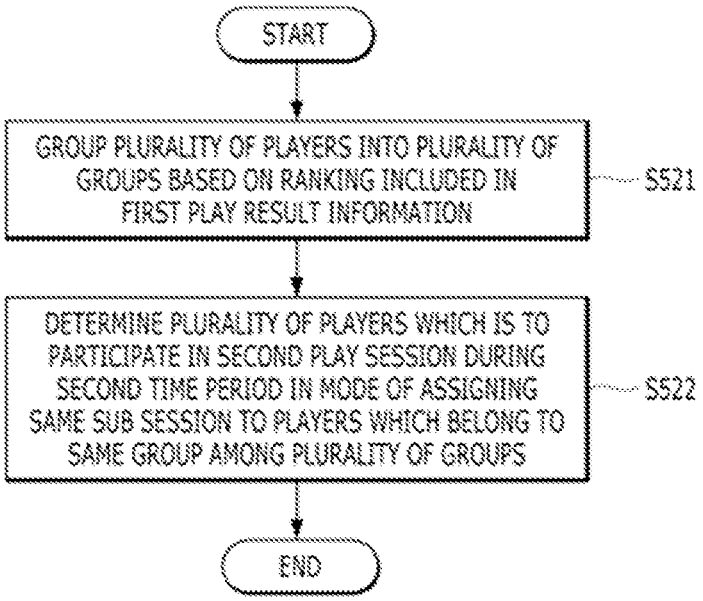
FIG. 9 is a flowchart describing an example of another method for determining a plurality of players who are to participate in the second play session to be conducted after the first time period by the dart game server according to the present disclosure.

FIG. 9 is a flowchart describing an example of another method for determining a plurality of players who are to participate in the second player session to be conducted after the first time period by the dart game server according to the present disclosure.

Referring to FIG. 9, the dart game server 3000 may group the plurality of players into a plurality of groups based on the rankings include in the first play result information (S521).

Specifically, the dart game server 3000 may group the plurality of players into the plurality of groups according to at least one of first to fourth references.

The first reference may be a reference for grouping the plurality of players based on a proximity of ranking values included in the first play result information.

For example, the dart game server 3000 may determine rankings of $1^{st}$ and $8^{th}$ in the first play session based on the first play result information. Here, the ranking of $8^{th}$ may be a lowest ranking and a ranking having a lowest proximity to the ranking of $1^{st}$ in the first play session. In this case, the dart game server 3000 may group the rankings of $2^{nd}$ to $4^{th}$ having relatively higher proximity to the ranking of $1^{st}$ than the rankings of $5^{th}$ to $8^{th}$ into one group jointly with the ranking of $1^{st}$. In addition, the dart game server 3000 may group the rankings of $5^{th}$ to $7^{th}$ having a relatively higher proximity to the ranking of $8^{th}$ than the rankings of $1^{st}$ to $4^{th}$ into one group jointly with the ranking of $8^{th}$. However, the present disclosure is not limited thereto.

In addition, the second reference may be a reference for grouping players of which ranking values included in the first play result information are the same into the same group.

For example, the dart game server 3000 may group a player having a ranking of $1^{st}$ in a 1-$1^{st}$ play session and a player having a ranking of $1^{st}$ in a 1-$2^{nd}$ play session in the first play session into the same group.

In addition, the third reference may be a reference for grouping players of which ranking values included in the first play result information are different into the same group.

For example, the dart game server 3000 may group the player having the ranking of $1^{st}$ in the 1-$1^{st}$ play session and the player having a ranking of $2^{nd}$ in the 1-$2^{nd}$ play session in the first play session into the same group.

Further, the fourth reference may be a reference for grouping the plurality of players based on a proximity of score values included in the first play result information.

For example, the dart game server 3000 may determine a player who acquires a highest score and a player who acquires a lowest score in the first play session based on the first play result information. In this case, the dart game server 3000 may group players having high proximity to the player who acquires the highest score into one group, and group players having high proximity to the player who acquires the lowest score into one group. However, the present disclosure is not limited thereto.

The dart game server 3000 may determine a plurality of players who are to participate in a second play session during a second time period by a mode of assigning the same sub session to players who belong to the same group among the plurality of groups (S522).

Specifically, the dart game server 3000 may group the plurality of players into a first group and a second group according to at least one of the first to fourth references.

For example, the dart game server 3000 may group a player having the ranking of $1^{st}$ in a 1-$1^{st}$ play session and a player having a ranking of $1^{st}$ in a 1-$2^{nd}$ play session into the first group according to the second reference. Further, the dart game server 3000 may group a player having a ranking of $2^{nd}$ in the 1-$1^{st}$ play session and a player having a ranking of $2^{nd}$ in a 1-$2^{nd}$ play session into the second group. The dart game server 3000 may assign a 2-$1^{st}$ play session in the second play session to the player belonging to the first group and assign a 2-$2^{nd}$ play session in the second play session to the player belonging to the second group. By such a mode, the dart game server may determine a plurality of players who are to participate in the second play session during the second time period. Here, the 2-$1^{st}$ play session and the 2-$2^{nd}$ play session may be sub session of the second play session having the same time constraint as the second play session. However, the present disclosure is not limited thereto.

According to some other embodiments of the present disclosure, the dart game server 3000 may determine a plurality of players who are to participate in the second play session. In addition, after the plurality of players are determined, the dart game server 3000 may also group the plurality of determined players.

Specifically, the dart game server 3000 may group the plurality of determined players into a plurality of groups including a first group and a second group. For example, when the number of plurality of determined players is 8, the dart game server 3000 may randomly extract 4 players from 8 players, and group the 4 extracted players into the first group and group 4 remaining players into the second group. However, the present disclosure is not limited thereto, and the plurality of groups may also be determined based on the first play result information.

Further, when grouping the plurality of determined players into the plurality of groups, the dart game server 3000 may match the 2-$1^{st}$ play session in the second play session with the first group. In addition, the dart game server 3000 may match the 2-$2^{nd}$ play session in the second play session with the second group.

Further, the dart game server 3000 may determine initiating a first dart game in which players included in the first group participate in the 2-$1^{st}$ play session. The dart game server 3000 may determine initiating a second dart game in which players included in the second group participate in the 2-$2^{nd}$ play session by interlocking with determining the initiating of the first dart game. However, the present disclosure is not limited thereto.

According to the above-described configuration, the dart game server 3000 may group the plurality of players into the plurality of groups. In addition, the dart game server 3000 may assign the same sub session to the plurality of respective groups. In this case, in respect to the plurality of players, players having a similar skill may be matched in a next game. Further, since players who are to participate in a next play session together may be automatically determined according to play results in respective play sessions, the players may continuously perform the dart game play with players with a similar skill thereto without a cumbersome task of selecting an opponent player.

According to some embodiments of the present disclosure, when the number of players who are to participate in the player session is insufficient, the dart game server 3000 may also generate a dummy player. Here, the dummy player may be a virtual player other than an actual player. In addition, the dart game server 3000 may make the generated dummy player participate in at least one play session in which the number of players is insufficient. Hereinafter, a method for generating the dummy player by the dart game server 3000 will be described through FIG. 10.

Figure 10:
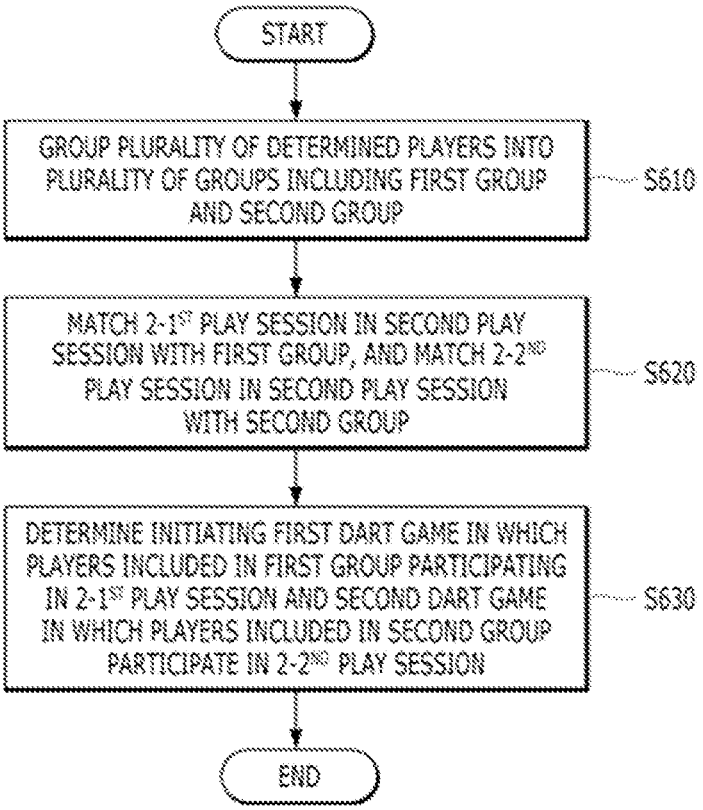
FIG. 10 is a flowchart describing an example of a method for generating a dummy player by the dart game server according to some embodiments of the present disclosure.

FIG. 10 is a flowchart describing an example of a method for generating a dummy player by the dart game server according to some embodiments of the present disclosure.

Referring to FIG. 10, the dart game server 3000 may determine a preliminary player who is to conduct the second play session during the second time period based on the first play result information (S610). Here, the preliminary player may be a player which the dart game server 3000 preliminarily or temporarily determines before confirming players who are to conduct the second play session.

For example, the dart game server 3000 may determine, as a preliminary player who is to conduct the second play session, 3 players having a ranking of $1^{st}$ in the 1-$1^{st}$ to 1-$3^{rd}$ play sessions in the first play session.

The dart game server 3000 may determine whether to generate the dummy player based on the number of preliminary players (S620).

Specifically, when the dart game server 3000 determines that the number of preliminary players does not satisfy the number of players set in the second play session, the dart game server 3000 may determine generating the dummy player. Here, the dummy player may be a virtual player other than an actual player.

For example, the second play session may be a dart game of a mode in which two players constitute a team. Accordingly, even players such as 4 players or 6 players may be required to conduct the second play session. In this case, when the number of preliminary players is odd, the dart game server 3000 may determine that the number of preliminary players does not satisfy the number of players set in the second play session. In this case, the control unit 100 may determine generating the dummy player.

When the dart game server 3000 determines generating the dummy player, the dart game server 3000 may add the dummy player to the player who is to participate in the second play session (S630). In addition, as the dummy player is added, the dart game server 300 may determine that the number of players for conducting the second play session is satisfied.

According to some embodiments of the present disclosure, the dart game server 3000 may generate the dummy player based on the first play result information.

Specifically, the dart game server 3000 may generate the dummy player to imitate a play record of one player among the plurality of players who participate in the first play session based on the first play result information. When the dummy player is generated to just acquire only a repeated score, interests of the players who participate in the second play session on the dart game may be reduced. Accordingly, the dart game server 3000 may generate the dummy player to imitate the play record of one player among the plurality of players who participate in the first play session so that the interests of the players on the dart game may be inspired.

According to some embodiments of the present disclosure, a dart game play performing ability of the dummy player may also be determined by interlocking with the first play result information of the player included in the second play session in which the dummy player is to participate.

Specifically, the dart game server 3000 may determine players who acquire the rankings are $1^{st}$ and $2^{nd}$ in the first play session as the player who is to participate in the second play session based on the first play result information. When the dart game play performing ability of the dummy player is much lower than dart game play performing abilities of the players who participate in the second play session, the interests of the players who participate in the second play session on the dart game may be reduced. Accordingly, the dart game server 3000 may determine the dart game play performing ability of the dummy player by interlocking with the first play result information of the players included in the second play session. However, the present disclosure is not limited thereto.

According to some embodiments of the present disclosure, when the dummy player is generated, the dart game server 3000 may assign a prestored dart pin throwing image of a player to the dummy player. In this case, an image related to the dummy player may be output from a plurality of devices who participate in the second play session.

According to the above-described configuration, the dart game server 3000 may prevent a situation in which the players may not conduct the second play session because the number of players who are to participate in the second play session is insufficient.

According to some embodiments of the present disclosure, the dummy player may also be added to the first play session.

For example, the player of the dart game device 1000 may generate the play session through the dart game device 1000, and then wait for participating in the play session by another player in order to participate in the dart game. In this case, even though a time for which the player waits exceeds a predetermined time, the dart game server 3000 may recognize that another player does not participate. In this case, the dart game server 3000 may generate the dummy player, and make the dummy player participate in the play session generated by the player of the dart game device 1000. Accordingly, the dart game server 3000 may prevent the player from taking a long time to wait for participation by another player.

According to some embodiments of the present disclosure, when the number of player who are to participate in the second play session is not insufficient, the dart game server 3000 may also remove the dummy player who participates in the first play session.

Specifically, the dart game server 3000 may determine whether there is the dummy player among the plurality of players who participate in the first play session in determining the plurality of players who are to participate in the second play session. When it is determined that there is the dummy player, the dart game server 3000 may recognize rankings included in first play result information of the remaining players other than the dummy player. In addition, the dart game server 3000 may determine a plurality of players having a predetermined ranking as the player who is to participate in the second play session.

For example, the player who acquires the ranking of $1^{st}$ in the 1-$1^{st}$ play session in the first play session may be the dummy player. In this case, the dart game server 3000 may determine a player who acquires the ranking of $1^{st}$ among the players other than the dummy player as the player who is to participate in the second play session. In general, the players may prefer to directly compete with a person rather than the dummy player. Accordingly, when the dart game server 3000 recognizes that the second play session is possible to conduct without the dummy player, the dart game server 3000 may determine the player other than the dummy player as the player who is to participate in the second play session.

According to the above-described configuration, the dart game server 3000 may prevent a situation in which the players may not conduct the dart game because the number of players who are to participate in the play session is insufficient.

According to some embodiments of the present disclosure, the display unit 120 of the dart game device 1000 and the display unit of another device 2000 may display information related to the play session. Hereinafter, the information related to the play session displayed in the display unit 120 according to the present disclosure will be described through FIG. 11.

Figure 11:
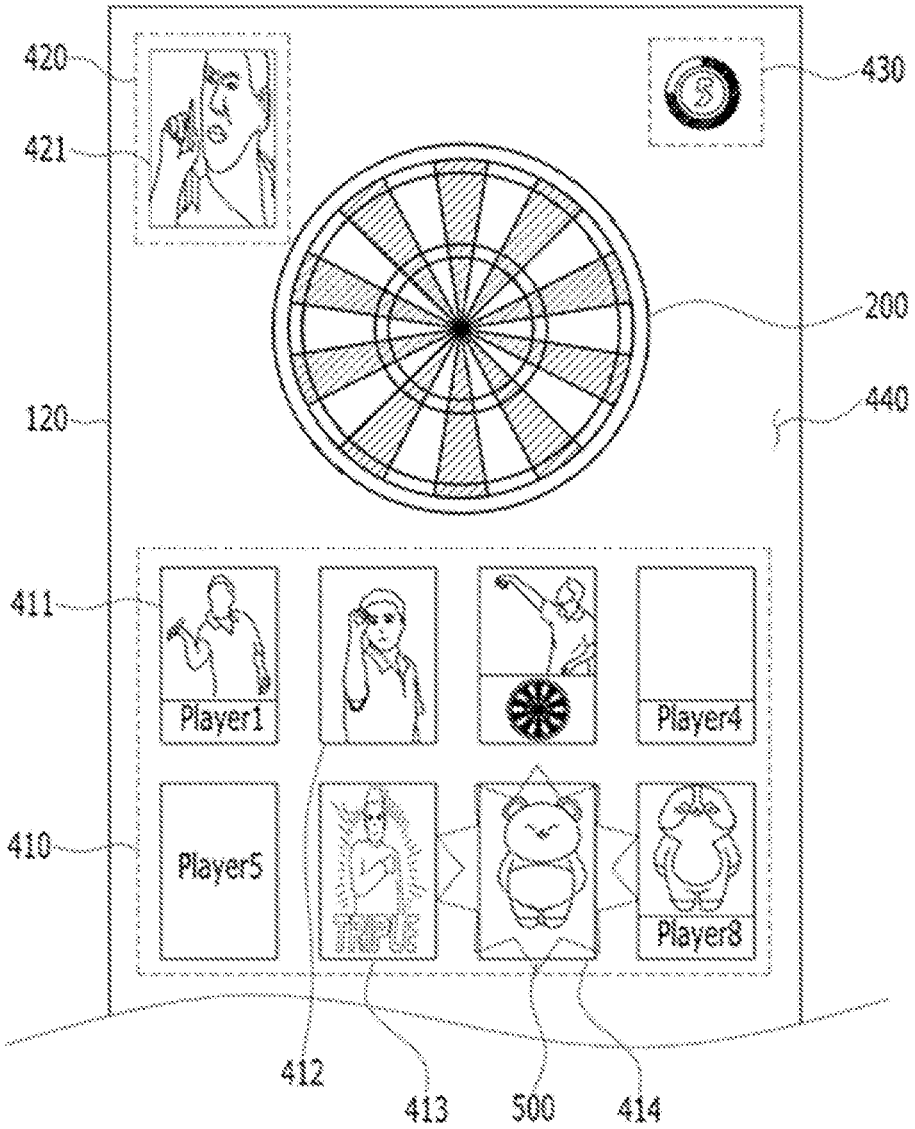
FIG. 11 is a diagram describing an example of information related to a play session displayed by a display unit of the dart game device according to some embodiments of the present disclosure.

FIG. 11 is a diagram describing an example of information related to a play session displayed by a display unit of the dart game device according to some embodiments of the present disclosure.

In FIG. 11, only information displayed in the first display region 121 of the display unit 120 is described. Further, first to fifth objects described in FIG. 11 are distinguished for convenience of description, and may be objects related to a different player from the first object and the second object described in FIG. 6.

Referring to FIG. 11, the display unit 120 may include a first region 410, a third region 420, a fourth region 430, and a background region 440. However, the present disclosure is not limited thereto.

An object related to another device 2000 may be displayed in the first region 410. Here, the object related to another device 2000 displayed in the first region 410 may include at least one of an image in which a player of another device 2000 throws the dart pin within a time period included in the play session, a predetermined character image for identifying the player of another device 2000, or a predetermined text for identifying the player of another device 2000.

For example, a first object 411 displayed in the first region 410 may include the image in which the player of another device 2000 throws the dart pin. Here, the image in which the player of another device 2000 throws the dart pin may be a real-time play image photographed by the camera unit of another device 2000. Further, the first object 411 may also include the predetermined text for identifying the player of another device 2000.

As another example, a second object 412 displayed in the first region 410 may include only the image in which the player of another device 2000 throws the dart pin.

A third object 413 displayed in the first region 410 may include a display image prestored in the storage unit 110 of the dart game device 1000.

Specifically, the network communication unit 150 may not receive the play image from another device 2000 related to the third object 413, and may receive play related data including only play result data. In this case, the control unit 100 may determine a display image related to the play related data in one or more images prestored in the storage unit 110 based on the received player related data. In addition, the display unit 120 may display the third object 413 including the prestored display image related to another device 2000 according to the determination by the control unit 100.

A fourth object 414 displayed in the first region 410 may include only the predetermined character image for identifying the player of another device 2000.

When the fourth object 414 is described more, a highlight effect 500 may be expressed around the fourth object 414. Here, the highlight effect 500 may be an effect for enhancing the interest of the player of the dart game device 1000 on the dart game.

As an example, the control unit 100 may determine that the player of another device 2000 related to the fourth object 414 is a player prestored by the player of the dart game device 1000. In this case, the control unit 100 may control the display unit 120 to display the highlight effect around the fourth object 414. However, the present disclosure is not limited thereto.

The control unit 100 may grant another highlight effect to objects in addition to the highlight effect illustrated in FIG. 11. As an example, the control unit 100 may provide a visual effect to express an object related to another device 2000 determining that a specific event is satisfied to be swung. Alternatively, the control unit 100 may provide a visual effect to allow the object related to another device 2000 determining that the specific event is satisfied to be enlarged, and then reduced. The control unit 100 may also determine only one object related to another device 2000 determining that the specific event is satisfied to be displayed in the first region 410, and the remaining objects not to be displayed in the first region 410. The control unit 100 may also allow a predetermined image of the object related to another device 2000 determining that the specific event is satisfied to be output. The control unit 100 may also allow a predetermined image to be output around of the object related to another device 2000 determining that the specific event is satisfied.

The control unit 100 may determine whether the player of another device 2000 satisfies the specific event based on the play related data of another device 2000. Here, the specific event may include an event of acquiring a specific score within a predetermined time, an event which occurs in the case of exceeding a time constraint for dart pin throwing, an event which occurs in the case where the dart pin is not thrown N times within a time constraint for a round, and an event which occurs in the case where the player is confirmed as the ranking of $1^{st}$ in the play session.

For example, the control unit 100 may determine that the player of another device 2000 acquires a specific score within a predetermined time based on the play related data related to another device 2000. In this case, the control unit 100 may grant the highlight effect to the object related to another device 2000.

The control unit 100 may also grant the highlight effect to a plurality of objects based on play related data of a plurality of other devices.

For example, the control unit 100 may determine whether there is an opportunity in which the ranking of the player related to the fourth object 414 may reverse the ranking of the player related to the third object 413 based on the play related data. In this case, the control unit 100 may allow a single highlight effect to be granted over the third object 413 and the fourth object 414.

Besides, when objects displayed in the first region 410 are described, an object including the image in which the player of another device 2000 throws the dart pin and the image related to the dart target unit of another device 2000 may be displayed in the first region 410. Further, an object including only the predetermined text for identifying the player of another device 2000 may also be displayed in the first region 410. In addition, an object including the predetermined character image for identifying the player of another device 2000 and the predetermined text for identifying the player of another device 2000 may also be displayed in the first region 410.

According to some embodiments of the present disclosure, the object displayed in the first region 410 may be an object including one of the image related to the dart target unit of another device 2000 or the image in which the player of another device 2000 throws the dart pin. Here, the image related to the dart target unit of another device 2000 may be one of a prestored dart target unit related virtual image corresponding to the play related data of another device 2000 or an actual image in which the dart pin thrown by the second player of another device 2000 hits the dart target unit.

Specifically, the control unit 100 may determine a network grade for another device 2000 related to the object based on traffic information of a network constituted by the devices who participate in the play session. The control unit 100 may determine displaying the object including the prestored dart target unit related virtual image corresponding to the play related data of another device 2000 or displaying the object including the actual image in which the dart pin thrown by the second player of another device 2000 hits the dart target unit based on the network grade.

For example, as the control unit 100 determines the network grade for another device 2000 as the second grade, the network communication unit 150 may receive the play related data including the play result data from another device 2000. In this case, the control unit 100 may determine an image related to the dart target unit prestored in the storage unit 110 to be included in the object based on the received player related data. As a specific example, the control unit 100 may recognize that the player of another device 2000 acquires 20 points based on the received play related data. The control unit 100 may determine an image in which the dart pin reaches a 20-point region among one or more images prestored in the storage unit 110. The display unit 120 may display an object including an image in which the dart pin reaches the 20-point region according to the determination by the control unit 100.

As another example, the control unit 100 may determine a network grade for another device 2000 related to the object as the first grade. As the control unit 100 determines the network grade for another device 2000 as the first grade, the network communication unit 150 may receive the image in which the player of another device 2000 throws the dart pin. In this case, the display unit 120 may display the object including the image in which the player of another device 2000 throws the dart pin.

A fifth object 421 displayed in the third region 420 may be an object related to the player of the dart game device 1000. However, the present disclosure is not limited thereto, and as the object displayed in the third region 420, an object related to another device 2000 may also be displayed according to an embodiment.

Information related to the play time constraint of the play session may be displayed in the fourth region 430.

For example, information on a first play constraint time period including the time constraint for the dart pin throwing may be displayed in the fourth region 430. Alternatively, information on a second play constraint time period including the time constraint for the round which permits dart pin throwing of N times may be displayed in the fourth region 430. Alternatively, information on a third play constraint time period including a time constraint for a set including K rounds may be displayed in the fourth region 430. Alternatively, information on a waiting time period predetermined between two sets may be displayed in the fourth region 430. However, the present disclosure is not limited thereto.

According to some embodiments of the present disclosure, the control unit 100 of the dart game device 1000 may determine a valid play time period of the play session based on a play time constraint assigned to the play session. The control unit 100 may display information related to the valid play time period in the fourth region when the valid play time period is determined. Here, the valid play time period may be a time period in which the first player of the dart game device 1000 is permitted to perform the dart game in the corresponding play session. For example, the play session may include a first sub play session in which all players participating in the play session should throw one dart pin from 10 a.m. to 10:00:10 a.m. on Oct. 1, 2021. In this case, the valid play time period of the first sub play session may be 10 seconds, and may be gradually reduced according to the progress of the first sub play session. Hereinafter, a method for determining the valid play time period of the play session based on the play time constraint assigned to the play session by the control unit 100 will be described through FIG. 19.

Information related to the play session, an image related to the play session, and an image predetermined by the player of the dart game device 1000 may be displayed in the background region 440. However, the present disclosure is not limited thereto.

According to some embodiments of the present disclosure, the object related to another device 2000 may be displayed in the background region 440.

Specifically, the network communication unit 150 of the dart game device 1000 may receive the play related data of another device 2000. In this case, the control unit 100 may acquire information on a location at which the dart pin thrown by the player of another device 2000 reaches the dart target unit based on the play related data of another device 2000. The control unit 100 may display the object related to another device 2000 in the background region 440 of the dart game device 1000 based on the location at which the dart pin thrown by the player of another device 2000 reaches the dart target unit. Hereinafter, an example of the object related to another device 2000 displayed in the background region 440 will be described through FIG. 15.

According to the above-described configuration, the display unit 120 of the dart game device 1000 may display real-time information related to the play session in which the dart game device 1000 participates. Accordingly, the player of the dart game device 1000 may interestingly enjoy the dart game while confirming information related to various players who participate in the dart game in real time.

According to some embodiments of the present disclosure, the control unit 100 may also determine a size of each object displayed in the first region. Hereinafter, another embodiment of the object displayed in the second region according to the present disclosure will be described through FIG. 12.

FIG. 12 is a diagram describing another example of an object displayed in a first region according to some embodiments of the present disclosure.

According to some embodiments of the present disclosure, the control unit 100 of the dart game device 1000 may determine a third attribute that indicates display sizes for a plurality of objects related to a plurality of other devices, respectively. The control unit 100 may also determine the third attribute so that at least one object among the plurality of objects related to the plurality of other devices has a different size from another object. Further, the control unit 100 may determine a fourth attribute not to display at least one other object by determining the third attribute so that the size of at least one object is different.

Figure 12A:
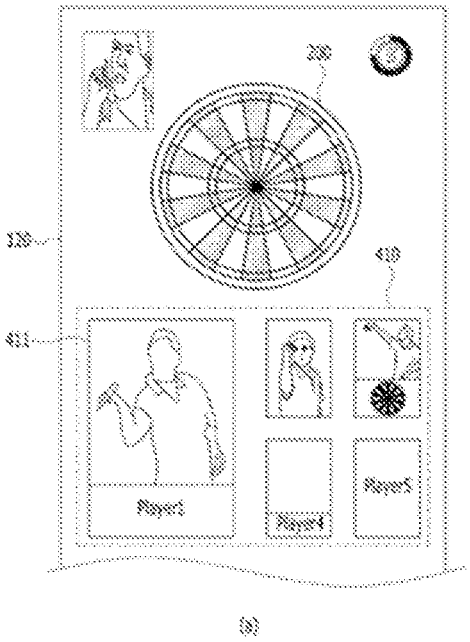
FIG. 12A is a diagram describing an example of an object displayed in a first region according to some embodiments of the present disclosure.

As an example, referring to FIG. 12A, the control unit 100 may determine the third attribute so that an object 411 related to a player predetermined by the player of the dart game device 1000 among a plurality of objects has a larger size than the remaining objects. As the size of the object 411 related to the predetermined player increases, a region occupied by the first region 410 may be widened. Accordingly, the control unit 100 may determine a fourth attribute of at least one other object not to display at least one other object in the first region 410.

When the control unit 100 determines at least one object among the plurality of objects displayed in the first region 410 to have a larger size than the remaining objects, the control unit 100 may also determine the sizes of the remaining objects to have a smaller size than a size displayed previously.

For example, the plurality of objects displayed in the first region 410 may be displayed to have the same first size. The control unit 100 may determine that there is the object 411 related to the predetermined player in the first region 410. In this case, the control unit 100 may determine the third attribute so that the object 411 related to the predetermined player has a second size larger than a first size. The control unit 100 may determine the third attribute so that the remaining objects other than the object 411 related to the predetermined player has a second size smaller than the first size.

As another example, the control unit 100 may determine the third attribute so that an object 411 related to a player having a highest ranking among players who participate in the same play session of the dart game device 1000 has a larger size than the remaining objects.

Figure 12B:
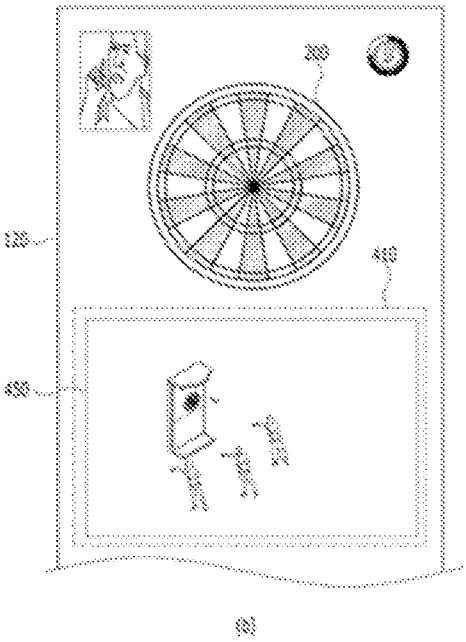
FIG. 12B is a diagram describing another example of an object displayed in a first region according to some embodiments of the present disclosure.

Referring to FIG. 12B, the control unit 100 of the dart game device 1000 may determine a synthesis image 450 related to the play session in which the dart game device 1000 participates to be displayed. Here, the synthesis image may be an image in which players related to the plurality of other devices are synthesized.

As an example, the synthesis image may be an image in which a plurality of players related to another device 2000 enjoy the dart game through one dart game device. In this case, since an image for one dart game device and images of the plurality of respective players are synthesized and displayed, an image such as the plurality of players playing jointly may be output to one dart game device. As another example, the synthesis image may be an image in which the plurality of players related to another device 2000 enjoy the dart game through a plurality of dart game devices. According to the embodiment of the present disclosure, the dart game device 1000 and other devices 2000 which participate in the play session may be the same device. In this case, coordinate values for locations of the dart target unit and the player photographed through the camera unit of each device may be constant in the image. Accordingly, the control unit 100 may generate the synthesis image rapidly in spite of receiving the play image from a plurality of other devices.

Specifically, the network communication unit 150 may receive a plurality of play images photographed through camera units of a plurality of other devices from the plurality of other devices, respectively. When the plurality of play images are received, the control unit 100 may generate the synthesis image so that the plurality of received play images may be displayed as one image. In addition, the display unit 120 may display the generated synthesis image in the first region 410. In this case, the player of the dart game device 1000 may have realistic experience of playing the dart game jointly with multiple players.

According to some embodiments of the present disclosure, the control unit 100 of the dart game device 1000 may group a plurality of players to be included in the synthesis image. In addition, the control unit 100 may generate the synthesis image based on play images related to the plurality of grouped players, respectively.

Specifically, the control unit 100 may determine a proximity between first ranking information included in the first play related data and second ranking information included in the second play related data within the time period included in the play session. Here, the first play related data may be a data related to the player of the dart game device 1000, and the second play related data may be data related to the player of another device 2000. The control unit 100 may group a predetermined number of devices according to the determined proximity.

For example, the ranking of the player of the dart game device 1000 may be $50^{th}$ in the play session. In this case, the control unit 100 may group a plurality of players of which rankings are $46^{th}$ to $49^{th}$ and $51^{st}$ to $54^{th}$ based on the determined proximity. In addition, the control unit 100 may generate the synthesis image based on the play images related to the plurality of grouped players. The display unit 120 may display the generated synthesis image in the first region 410.

The control unit 100 of the dart game device 1000 may also control the display unit 120 so as to display the synthesis image and at least one object in the first region 410.

Specifically, the control unit 100 may determine a proximity between first ranking information included in the first play related data and second ranking information included in the second play related data within the time period included in the play session. The control unit 100 may generate a synthesis image related to at least two players among the plurality of players based on the determined proximity.

When the synthesis image is generated, the display unit 120 may display the synthesis image related to at least two players. In addition, the control unit 100 may determine information related to the remaining players other than at least two players to be displayed as the object.

For example, the ranking of the player of the dart game device 1000 may be $50^{th}$ in the play session. In addition, the control unit 100 may determine the plurality of players of which rankings are $46^{th}$ to $49^{th}$ and $51^{st}$ to $54^{th}$ based on a proximity between first ranking information and second ranking information. The control unit 100 may determine a plurality of objects related to the players of which rankings are $46^{th}$ to $49^{th}$ to be displayed in the first region 410. Further, the control unit 100 may control the network communication unit 150 to receive play images from a plurality of other devices related to the players of which rankings are $51^{st}$ to $54^{th}$. When the play images are received from the plurality of other devices, the control unit 100 may generate a synthesis image including the players of which rankings are $51^{st}$ to $54^{th}$. In this case, the display unit 120 may display the plurality of objects related to the players of which rankings are $46^{th}$ to $49^{th}$ and the synthesis image related to the rankings of $51^{st}$ to $54^{th}$ in the first region 410.

According to the above-described configuration, the display unit 120 of the dart game device 1000 may display at least one object or image in the first region 410 by various modes.

According to some embodiments of the present disclosure, the control unit 100 may determine whether to change relative locations of the plurality of respective objects based on the play related data received through the network communication unit 150. Hereinafter, a method for determining whether to change the relative locations of the plurality of respective objects by the control unit 100 according to the present disclosure will be described through FIG. 13.

FIG. 13 is a diagram describing an example of a method for changing relative locations of a plurality of respective objects by the dart game device according to some embodiments of the present disclosure.

Prior to describing FIG. 13, a first object in FIG. 13 may be the object related to the first device described in FIG. 6. In addition, a second object may be the object related to the second device described in FIG. 6. That, the first object and the second object in FIG. 13 may be objects related to devices different from the first object and the second object described in FIG. 11.

Referring to FIG. 13A, the display unit 120 may include a first display region 121 and a second display region 122. In addition, the first display region 121 may include a first region 410 and the second display region 122 may include a second region 460. However, the present disclosure is not limited thereto.

A plurality of objects having a first form may be displayed in the first region 410. Here, the plurality of objects included in the first region 410 may be objects related to a plurality of other devices. In addition, the first form may include at least one of an image in which players of the plurality of other devices throws dart pins, a predetermined character image for identifying the players of the plurality of other devices, a predetermined text for identifying the players of the plurality of other devices, or an image related dart target units of the plurality of other devices. However, the present disclosure is not limited thereto.

As an example, a first object 415 displayed in the first region 410 among the plurality of objects may be an object related to a first device. In addition, the first object 415 may include a predetermined text for identifying a player of the first device. Further, the first object 415 may include a space into which an image in which the first player throws the dart pin or a predetermined character image is to be inserted.

A plurality of objects having a second form may be displayed in the second region 460. In addition, the second form may include at least one of predetermined texts for identifying players of a plurality of respective devices. Further, information represented by the plurality of objects displayed in the second region 460 may be information related to rankings in play sessions in which the dart game device 1000 and other devices 2000 participate. Accordingly, the plurality of objects included in the first region 410 may also be included in the second region 460 in the second form different from the first form.

For example, a form of the first object 415 related to the first device displayed in the first region 410 may be the first form. In addition, a form of the first object 461 related to the first device displayed in the second region 460 may be the second form different from the first form.

According to some embodiments of the present disclosure, the control unit 100 may change relative locations of the first object 415 displayed in the first region 410 and the second object 462 displayed in the second region 460 based on the play related data received through the network communication unit 150.

Specifically, the control unit 100 may determine a first proximity between the play related data related the first object 415 and the play related data of the dart game device 1000 based on the received play related data. Here, the first proximity may indicate how close the ranking of the player of the dart game device 1000 is to the ranking of the player related to the first object 415. Further, the control unit 100 may determine a second proximity between the play related data related the second object 462 of the second device and the play related data of the dart game device 1000. Here, the second proximity may indicate how close the ranking of the player of the dart game device 1000 is to the ranking of the player related to the second object 462. When the first proximity and the second proximity are determined, the control unit 100 compares the first proximity and the second proximity to determine whether there is a change in superior relationship between the first proximity and the second proximity. In addition, when it is determined that there is the change in superior relationship between the first proximity and the second proximity, the control unit 100 may change the relative locations of the first object 415 and the second object 462.

For example, the control unit 100 may determine changing the relative locations of the first object 415 and the second object 462 displayed in the first region 410. In this case, In this case, referring to FIG. 13B, the second object 416 related to the second device may be displayed at a location at which the first object 415 is displayed in the first region 410. As a result, the control unit 100 may determine the first object 415 to be displayed at a different location in the first region 410. In this case, the different location of the first object 415 displayed in the first region 410 may be determined based on at least one of a score or a ranking related to the first object 415.

Further, referring back to FIG. 13A, the control unit 100 may determine changing the relative locations of the first object 461 and the second object 462 displayed in the second region 460. In this case, referring to FIG. 13B, the second object 462 related to the second device may be displayed at a location at which the first object 461 is displayed in the second region 460. Further, the control unit 100 may determine the first object 461 to be displayed at a different location in the second region 460. In this case, the different location of the first object 461 displayed in the second region 460 may be determined based on at least one of the scores or rankings related to the first object 415 and the second object. Moreover, the control unit 100 may also change locations of other objects other than the first object 461 and the second object 462 displayed in the second region 460 by interlocking with the changing of the relative locations of the first object 461 and the second object 462.

According to some embodiments of the present disclosure, the control unit 100 of the dart game device 1000 may perform a spinning operation of repeatedly exchanging the relative locations of the first object 415 displayed in the first region 410 and the second object 462 displayed in the second region 460 at a predetermined number of times.

Specifically, when it is determined that there is the change in superior relationship between the first object 415 and the second object 462, the control unit 100 may exchange the relative locations of the first object 415 and the second object 462. Further, the control unit 100 may exchange the locations of the first object 415 and the second object 462 of which relative locations are exchanged again. The number of times at which the locations of the first object 415 and the second object 462 are repeatedly exchanged may be a predetermined odd number of times. Accordingly, the control unit 100 repeatedly exchanges the relative locations of the first object 415 and the second object 462 at the predetermined number of times, and may finally allow the relative locations of the first object 415 and the second object 462 to be displayed in a changed state. However, the present disclosure is not limited thereto.

According to some other embodiments of the present disclosure, the control unit 100 of the dart game device 1000 may perform a spinning operation of repeatedly exchanging the relative locations of the first object 415 displayed in the first region 410 and another object displayed in the first region 410 at a predetermined number of times.

Specifically, when it is determined that there is the change in superior relationship between the first object 415 and another object, the control unit 100 may exchange relative locations of the first object 415 and another object. Further, the control unit 100 may exchange the locations of the first object 415 and the another object of which relative locations are exchanged again. However, the present disclosure is not limited thereto.

According to some embodiments of the present disclosure, the object related to the dart game device 1000 may be displayed in the second region 460. The control unit 100 may display the object related to the dart game device 1000 in the second region 460 in a third form different from the second form in which another object other than the object related to the dart game device 1000 is displayed.

As an example, the third form may be a form in which the object related to the dart game device 1000 is highlighted to be emphasized, or may also be a form in which identification information is not displayed, and the object occupies one location in the second region. In this case, the player of the dart game device 1000 may easily determine a ranking thereof in the second region 460. However, the present disclosure is not limited thereto.

According to the above-described configuration, the control unit 100 of the dart game device 1000 may change the relative locations of the first object and the second object based on the play related data. In this case, the dart game device 1000 may provide a visual effect in which the rankings of the plurality of other devices are changed in real time to the player.

According to some embodiments of the present disclosure, the control unit 100 of the dart game device 1000 may compare a prestored previous play image of the player of the dart game device 1000 and a first play image photographed through the camera unit 140. In addition, the control unit 100 may determine whether to transmit the first play image based on the comparison result. Hereinafter, a method for determining whether to transmit the first play image by the control unit 100 according to the present disclosure will be described through FIG. 14.

FIG. 14 is a diagram describing an example of a method for determining whether to transmit a first play image by the dart game device according to some embodiments of the present disclosure.

According to some embodiments of the present disclosure, the control unit 100 of the dart game device 1000 may determine whether to transmit the first play image related to a first player of the dart game device 1000.

Specifically, when the first play image is photographed through the camera unit 140, the control unit 100 may compare the previous play image of the first player prestored in the storage unit 110 and the first play image. In addition, the control unit 100 may determine whether to transmit the first play image based on the comparison result.

Figure 14A:
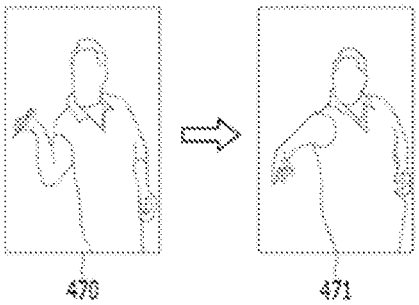
FIG. 14A is a diagram describing an example of a method for determining whether to transmit a first play image by the dart game device according to some embodiments of the present disclosure.

For example, referring to FIG. 14A, when a first play image 471 is photographed through the camera unit 140, the control unit 100 may compare a previous play image 470 and the first play image 471. As the control unit 100 determines there is a smaller difference than a predetermined threshold according to a comparison result, the control unit 100 may determine not transmitting the first play image 471. For example, when the first play image 471 is photographed through the camera unit 140, the control unit 100 may compare the previous play image 470 of the first player prestored in the storage unit 110 and the first play image 471, and generate a difference value indicating a difference between the first play image 471 and the previous play image 470. The control unit 100 may determine not to transmit the first play image 471 when the generated difference value is smaller than the predetermined threshold according to the comparison result.

Figure 14B:
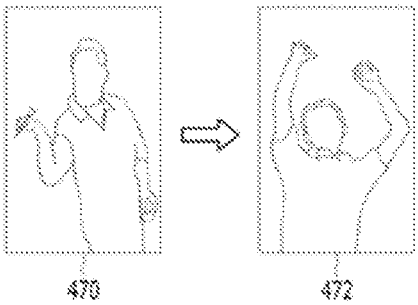
FIG. 14B is a diagram describing an example of a method for determining whether to transmit a first play image by the dart game device according to other embodiments of the present disclosure.

As another example, referring to FIG. 14B, when a first play image 472 is photographed through the camera unit 140, the control unit 100 may compare a previous play image 470 and the first play image 472. As the control unit 100 determines there is a larger difference than a predetermined threshold according to a comparison result, the control unit 100 may determine transmitting the first play image 472. For example, when the first play image 472 is photographed through the camera unit 140, the control unit 100 may compare the previous play image 470 of the first player prestored in the storage unit 110 and the first play image 472, and generate a difference value indicating a difference between the first play image 472 and the previous play image 470. The control unit 100 may determine transmitting the first play image 472 when the generated difference value is larger than the predetermined threshold according to the comparison result. That is, the control unit 100 may determine transmitting a new photographed first play image 472 only when the first play image 472 and the previous play image 470 are different to have a larger difference than the predetermined threshold. However, the present disclosure is not limited thereto.

According to some other embodiments of the present disclosure, the control unit 100 of the dart game device 1000 may also determine whether re-determine the network grade for another device 2000 based on the comparison between the previous play image 470 and the first play image 472. Here, the network grade may be a grade which the control unit 100 determines for another device 2000 based on traffic information of a network constituted by the devices who participate in the play session.

As an example, the control unit 100 may determine a network grade for another device 2000 having traffic equal to or more than predetermined traffic as a second grade based on the traffic information. In this case, the network communication unit 150 may not transmit the play image related to the dart game device 1000, but transmit only the play related data to another device 2000 determined as the second grade. In this case, when the first play image 472 is photographed through the camera unit 140, the control unit 100 may compare the previous play image 470 and the first play image 472. As the control unit 100 determines there is a larger difference than a predetermined threshold according to the comparison result, the control unit 100 may re-determine the network grade of another device 2000 as the first grade. The network communication unit 150 may transmit the first play image 472 to another device 2000 re-determined as the first grade. However, the present disclosure is not limited thereto.

According to the above-described configuration, the control unit 100 of the dart game device 1000 may determine whether to transmit the first play image related to the first player of the dart game device 1000. When the network communication unit 150 transmits the first play related data including the first play image whenever the first play image is photographed through the camera unit 140 to another device 2000, a problem related to network traffic may occur. Accordingly, the control unit 100 may determine whether to transmit the first play image based on the comparison between the previous play image and the first play image.

According to some embodiments of the present disclosure, the dart game device 1000 may further include an image acquisition unit. The image acquisition unit may be a module for acquiring an image in which the first player of the dart game device 1000 plays the dart game. As an example, the image acquisition unit may include the camera unit 140 for photographing the first player. The control unit 100 may determine whether to transmit the first play image in which the first player plays the dart game acquired through the image acquisition unit to another device 2000.

Specifically, the control unit 100 of the dart game device 1000 may determine whether to transmit the first play image to another device 2000 based on the comparison between the previous play image of the first player stored in the storage unit 110 and the first play image. Here, when the first play image is compared with non-image play result data, the first play image may have a larger size than the non-image play result data. As a result, when the network communication unit 150 transmits the first play image to another device 2000 whenever the first play image is acquired through the image acquisition unit, a load of the network traffic may increase. Accordingly, the control unit 100 may need to determine whether to transmit the first play image by comparing the previous play image and the first play image.

According to some embodiments of the present disclosure, the control unit 100 of the dart game device 1000 may determine whether to transmit the first play image to another device 2000 based on a difference between a motion of the first player in the previous play image and a motion of the first player in the first play image.

For example, the control unit 100 may determine transmitting first non-image play result data of the first player to another device 2000 when the difference between the motions is equal to or less than a predetermined threshold. Here, the first non-image play result data may include at least one of information on a score which the first player acquires by throwing the dart pin, information on a score acquired in a round which allows dart pin throwing of N times, information on a score acquired in a set including K rounds, or first ranking information of the first player within a time period included in the play session. The first non-image play result data may have a smaller size than the first play image, and a network delay problem may be resolved, which may occur when the network communication unit 150 receives or transmits the non-image play result data.

As another example, the control unit 100 may determine transmitting, to another device 2000, first non-image play result data and a first play image related to a current dart game play of the first player when the difference between the motions is more than the predetermined threshold.

According to some embodiments of the present disclosure, the control unit 100 of the dart game device 1000 may also determine whether to transmit the first play image based on a comparison of a body part in determining whether to transmit the first play image.

Specifically, the control unit 100 may also determine whether to transmit the first play image to another device based on a difference between a body part of the first player in the previous play image stored in the storage unit 110 and a body part of the first player in the first play image. It may be appreciated that the difference between the body parts indicates a difference which occurs due to a change in motion or location of the body part.

For example, the control unit 100 may determine transmitting the first non-image play result data of the first player to another device 2000 when the difference between the body parts is equal to or less than a predetermined threshold. As another example, the control unit 100 may determine transmitting, to another device 2000, the first non-image play result data and the first play image related to the current dart game play of the first player when the difference between the body parts is more than the predetermined threshold.

According to some embodiments of the present disclosure, the control unit 100 of the dart game device 1000 may also determine whether to transmit the first play image based on a comparison of facial expressions in determining whether to transmit the first play image.

Specifically, the control unit 100 may also determine whether to transmit the first play image to another device 2000 based on a difference between a facial expression of the first player in the previous play image stored in the storage unit 110 and a facial expression of the first player in the first play image.

For example, the control unit 100 may determine transmitting the first non-image play result data of the first player to another device 2000 when the difference between the facial expressions is equal to or less than a predetermined threshold. As another example, the control unit 100 may determine transmitting, to another device 2000, first non-image play result data and a first play image related to a current dart game play of the first player when the difference between the facial expressions is more than the predetermined threshold.

According to some embodiments of the present disclosure, according to a comparison result between the previous play image and the first play image of the first player, there is a smaller difference than a predetermined threshold, but the network communication unit 150 may also transmit the first play image to another device 2000. As an example, even though there is a large change in scores which some players acquire by throwing the dart pins, a change in expression or motion may be remarkably small. Accordingly, the control unit 100 may also determine whether to transmit the first play image to another device 2000 based on the non-image play result in addition to the difference between the play images.

Specifically, the control unit 100 may determine that there is a smaller difference than a predetermined threshold according to the comparison result between the previous play image of the first player stored in the storage unit 110 and the first play image. In this case, the control unit 100 compares previous non-image play result data related to the previous dart game play of the first player prestored in the storage unit 110 and first non-image play result data related to the current dart game play to determine whether to transmit the first play image to another device 2000.

For example, the control unit 100 may determine whether to transmit the first play image to another device 2000 based on a difference between previous score information included in the previous non-image play result data and first score information included in the first non-image play result data.

According to some embodiments of the present disclosure, the above-described operations may also be performed by the dart game server 3000.

As an example, the network communication unit of the dart game server 3000 may receive the first play image related to the current dart game play of the first player of the dart game device 1000 which participates in a play session which assigns the play time constraint to two or more devices. The control unit of to another device 2000 based on the comparison between the previous play image of the first player prestored in the storage unit and the first play image.

According to the above-described configuration, the dart game device 1000 may determine whether to transmit the first play image to another device 2000 based on the comparison between the previous play image and the first play image of the first player. When the network communication unit 150 transmits the first play image whenever the first play image is acquired through the image acquisition unit, the load of the network traffic may increase. Accordingly, the dart game device 1000 may determine whether to transmit the first play image by comparing the previous play image and the first play image which is the current play image. By such a mode, a network load may decrease, and as a result, a real-time dart game play which increases a user experience may be implemented.

According to some embodiments of the present disclosure, the object related to another device 2000 may be displayed in the background region 440. Hereinafter, a method for displaying an object related to another device in the background region 440 by the control unit 100 of the dart game device 1000 according to the present disclosure will be described through FIG. 15.

FIG. 15 is a diagram describing an example of a method for displaying an object related to another device in a background region by the dart game device according to some embodiments of the present disclosure.

According to some embodiments of the present disclosure, the network communication unit 150 of the dart game device 1000 may receive second play related data of another device 2000. In this case, the control unit 100 may determine the object related to another device 2000 to be displayed in the background region 440 based on the second play related data.

Specifically, the control unit 100 may acquire information on a location at which the dart pin thrown by the player of another device 2000 reaches the dart target unit of another device 2000 based on the second play related data. The control unit 100 may determine the object related to another device 2000 in the background region 440 of the dart game device 1000 to be displayed based on the location at which the dart pin thrown by the player of another device 2000 reaches the dart target unit. In addition, the display unit 120 may display the object related to another device 2000 in the background region 440 under the control by the control unit 100.

Figure 15B:
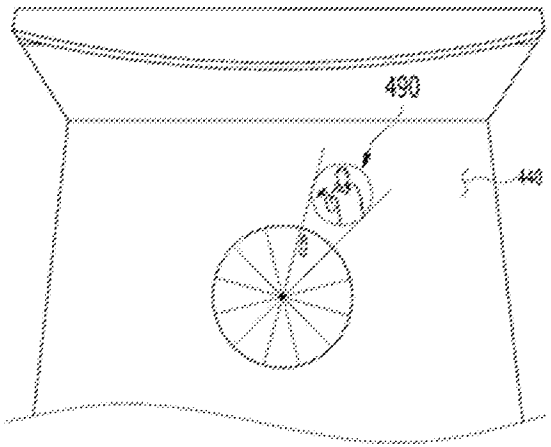
FIG. 15B is a diagram describing an example of a method for displaying an object related to another device in a background region by the dart game device according to other embodiments of the present disclosure.
Figure 15A:
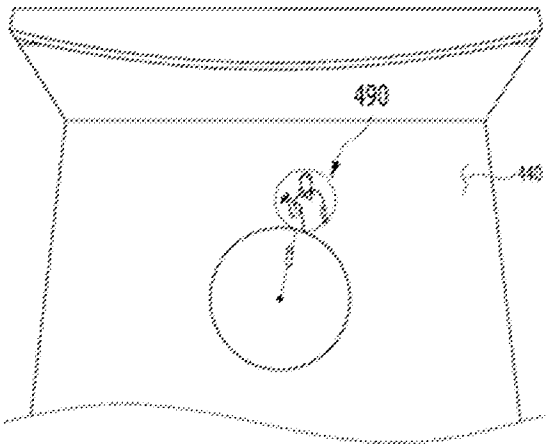
FIG. 15A is a diagram describing an example of a method for displaying an object related to another device in a background region by the dart game device according to some embodiments of the present disclosure.

For example, referring to FIG. 15A, the control unit 100 may determine an original point of the dart target unit 200 of the dart game device 1000. In addition, the control unit 100 may determine a hit location on the dart target unit 200 of the dart game device 1000 corresponding to a location at which the dart pin thrown by the player of another device 2000 hits the dart target unit of another device 2000.

Further, the control unit 100 may determine a line extended from the original point of the dart target unit 200 to the hit location. In this case, the control unit 100 may determine a portion adjacent to a point meeting an outline of the dart target unit 200 as a location at which the object is to be displayed.

Referring to FIG. 15B, the dart target unit 200 may be divided into a plurality of fan-shaped regions. In this case, the control unit 100 may determine a hit location on the dart target unit 200 corresponding to a location at which the dart pin thrown by the player of another device 2000 hits the dart target unit of another device 2000. In addition, the control unit 100 may determine a portion adjacent to an arc of the fan-shaped region including the hit location as a location at which the object 490 is to be displayed. However, the present disclosure is not limited thereto.

According to some embodiments of the present disclosure, the control unit 100 of the dart game device 1000 may determine the object related to another device 2000 to be displayed in the background region 440 additionally based on the first play related data of dart game device 1000. As an example, the object related to another device 2000 displayed in the background region 440 may include a play image of the player related to another device 2000, a hit image for the dart target related to another device 2000, or any type of text or image information for identifying the player related to another device 2000.

According to an embodiment of the present disclosure, when there are a plurality of players who hit score regions (e.g., 20 points or 20-point triple) corresponding to each other, the control unit 100 of the dart game device 1000 may determine sequentially displaying images related to a plurality of players in a display region associated with the score region in the background region 440.

As another example, when there are the plurality of players who hit score regions (e.g., 20 points or 20-point triple) corresponding to each other, the control unit 100 of the dart game device 1000 may also determine displaying an image related to a player who hits in a region close to the dart target temporally earlier, and displaying an image related to the player who hits in a region distant from the dart target temporally subsequently by splitting the display region associated with the score region in the background region 440.

As another example, when there are the plurality of players who hit score regions (e.g., 20 points or 20-point triple) corresponding to each other, the control unit 100 of the dart game device 1000 may also determine displaying an image related to a player who hits in a region close to the dart target temporally subsequently, and displaying an image related to the player who hits in a region distant from the dart target temporally earlier by splitting the display region associated with the score region in the background region 440.

The control unit 100 of the dart game device 1000 may determine the score acquired by the player of the dart game device 1000 based on the hit location of the dart pin recognized through the sensing unit 160. The control unit 100 may determine whether there is the second player of another device 2000 which acquires the score acquired by the first player earlier than the first player based on the second play related data of another device 2000. In addition, when it is determined that there is the second player, the control unit 100 may display the object related to the second player in the background region 440. However, the present disclosure is not limited thereto. Hereinafter, the method for displaying the object related to another device 2000 in the background region 440 by the dart game device 1000 will be described more through FIG. 24.

According to some embodiments of the present disclosure, the control unit 100 of the dart game device 1000 may prevent cheating of the first player by using facial information. Hereinafter, a method for preventing the cheating of the first player by the control unit 100 according to the present disclosure will be described through FIG. 16.

Figure 16:
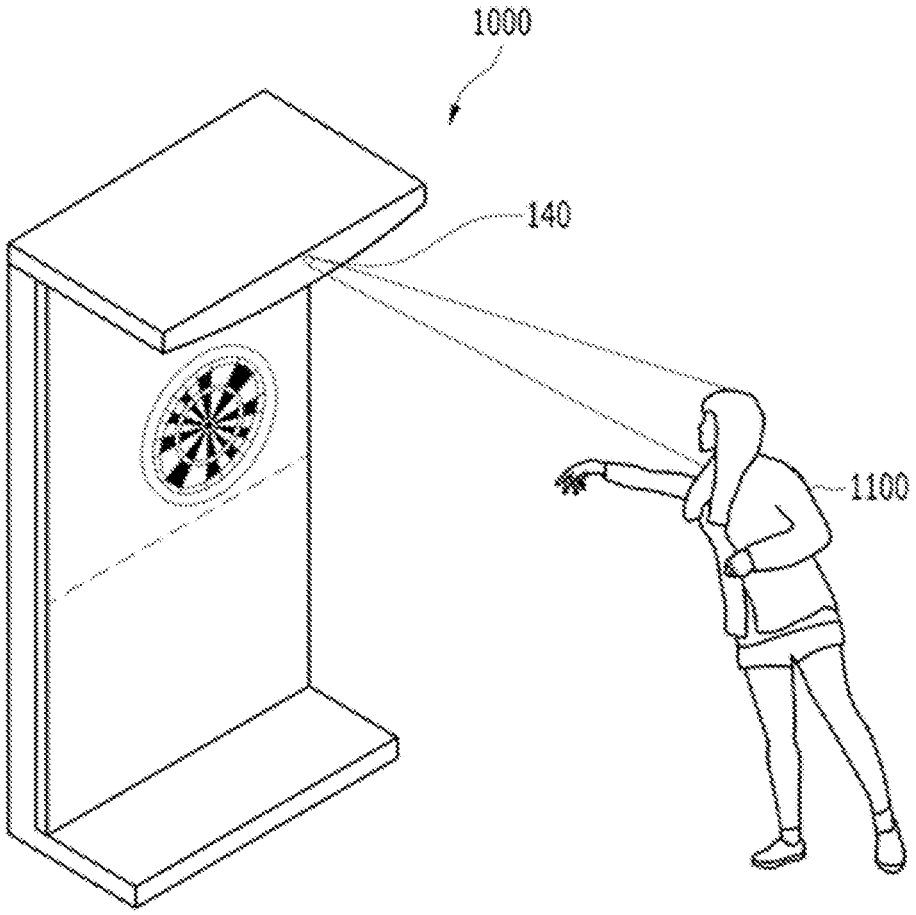
FIG. 16 is a diagram describing an example of a method for preventing cheating of a player by the dart game device according to some embodiments of the present disclosure.

FIG. 16 is a diagram describing an example of a method for preventing cheating of a player by the dart game device according to some embodiments of the present disclosure.

According to some embodiments of the present disclosure, the control unit 100 of the dart game device 1000 may accept or reject a log-in request of the player 1100 for the dart game device 1000.

As an example, the control unit 100 may receive an input for logging in to the dart game device 1000 from the player through the user input unit 170. In this case, the control unit 100 may control the camera unit 140 to photograph an image including a player 1100 who currently manipulates the user input unit 170. The control unit 100 may accept or reject the log-in request of the player 1100 based on a comparison between facial information included in identification information of the player who requests the log-in and facial information recognized from the photographed image.

For example, the control unit 100 may accept the log-in request of the player 1100 when there is a smaller difference than the predetermined threshold according to the comparison result. For example, the control unit 100 may generate a similarity value indicating a similarity level by comparing the image photographed through the camera unit 140 and the facial information included in the identification information. The control unit 100 may accept the log-in request of the player 1100 when the similarity value generated according to the comparison result has a larger difference than the predetermined threshold. The control unit 100 may reject the log-in request of the player 1100 when the similarity value generated according to the comparison result has a smaller difference than the predetermined threshold.

The control unit 100 of the dart game device 1000 may determine whether the player 1100 performs the cheating while enjoying the dart game by participating in the play session. Here, the cheating may be an action such as performing the dart game by a surrogate player other than the player 1100.

Specifically, when the player 1100 conducts the dart game by participating in the play session, the control unit 100 may control the camera unit 140 so as to photograph the player 1100 at a predetermined interval. The control unit 100 compares the facial information included in the identification information used upon log-in, and the image photographed through the camera unit 140 to determine whether a player who is currently performing the dart game is the surrogate player.

For example, the control unit 100 may determine the player who is currently performing the dart game is the surrogate player which is performing the cheating when there is a larger difference than a predetermined threshold according to the comparison result. For example, the control unit 100 may generate a similarity value indicating a similarity level by comparing the image photographed through the camera unit 140 and the facial information included in the identification information. The control unit 100 may determine that the player who is currently performing the dart game is the surrogate player when the similarity value generated according to the comparison result has a smaller difference than the predetermined threshold. In this case, the control unit 100 may eject the player of the dart game device 1000 from the play session in which the player is currently participating. Further, the control unit 100 may also transmit identification information related to the dart game device 1000 to the dart game server 3000. However, the present disclosure is not limited thereto.

According to some embodiments of the present disclosure, when the control unit 100 of the dart game device 1000 accepts the log-in request of the player, the control unit 100 may recognize previous play related data of the player. The control unit 100 may control the sound output unit 190 so as to output a predetermined sound based on the previous play related data. Alternatively, when the control unit 100 accepts the log-in request of the player, the control unit 100 may determine whether there is a prestored sound, music, or voice message based on identification information of the player. In addition, when it is determined that there is at least one of the prestored sound, music, or voice message, the control unit 100 may control the sound output unit 190 so as to output a corresponding sound.

According to the above-described configuration, the control unit 100 of the dart game device 1000 may prevent the cheating in which the player participating in the play session through the dart game device 1000 conducts the dart game through the surrogate player. An example of the method for preventing the cheating of the player by the control unit 100 of the dart game device 1000 will be described more through FIG. 26.

According to some embodiments of the present disclosure, the control unit 100 of the dart game device 1000 may also provide a lesson image to the first player of the dart game device 1000 based on the play related data of another device 2000. Hereinafter, a method for providing the lesson image by the control unit 100 according to the present disclosure will be described through FIG. 17.

Figure 17:
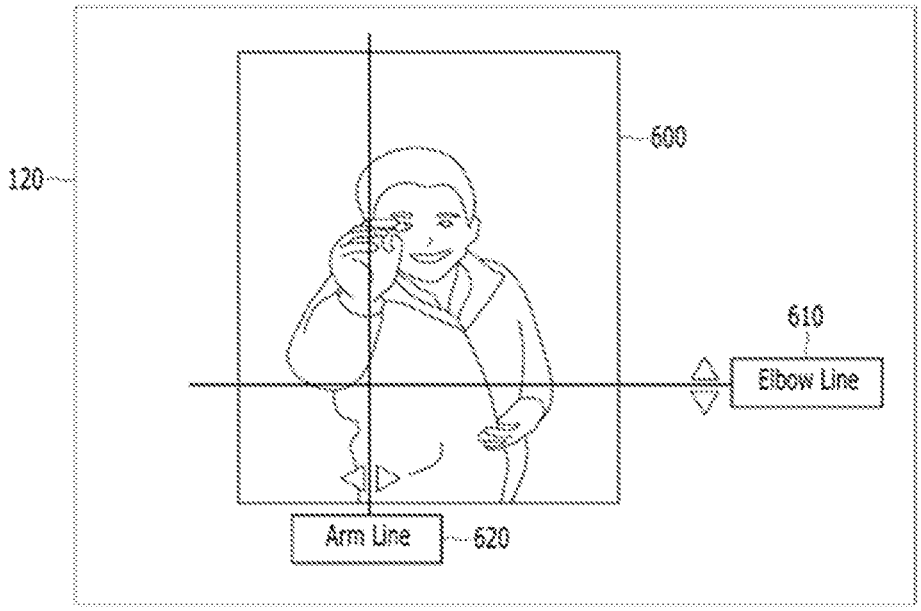
FIG. 17 is a diagram describing a method for providing a lesson image by the dart game device according to the present disclosure.

FIG. 17 is a diagram describing a method for providing a lesson image by the dart game device according to the present disclosure.

Referring to FIG. 17, the control unit 100 of the dart game device 1000 may provide a lesson image 600 through the display unit 120. Here, the lesson image 600 may be generated based on play related data of a plurality of other devices collected as the dart game device 1000 participates in the play session.

As an example, the control unit 100 may determine another device 2000 related to the second player who gets the $1^{st}$ ranking in at least one play session among the plurality of other devices. In addition, the control unit 100 may generate a lesson image 600 including at least one virtual character based on play relate data related to the determined another device 2000. Here, the virtual character may be a character generated based on play related data of the second player other than an actual second player.

According to some embodiments of the present disclosure, when another device 2000 is determined, the control unit 100 of the dart game device 1000 may determine whether a play image related to another device 2000 is present in the storage unit 110. As an example, as the dart game device 1000 of another device 2000 participates in the same play session, the network communication unit 150 may receive only? play related data including the play image from another device 2000. In addition, when it is determined that the play image received from another device 2000 is present in the storage unit 110, the control unit 100 may generate the lesson image 600 based on the play image. For example, the control unit 100 may generate the lesson image 600 including an actual play appearance of the second player of another device 2000. As another example, the control unit 100 may generate a virtual character imitating the second player, and then the lesson image 600 including the virtual character based on the play image of the second player of another device 2000. However, the present disclosure is not limited thereto.

When the lesson image 600 is displayed, the control unit 100 of the dart game device 1000 may control the camera unit 140 to photograph the first player of the dart game device 1000. In this case, an image acquired by photographing the first player may be overlapped with the lesson image 600 and displayed. However, the present disclosure is not limited thereto.

The lesson image 600 may include an arm line 610 or an elbow line 620.

The arm line 610 may display a line matched with an arm of the first player or an arm of the virtual character generated based on the play related data.

The elbow line 620 may display a line matched with an elbow of the first player or an elbow of the virtual character generated based on the play related data.

According to some embodiments of the present disclosure, the control unit 100 of the dart game device 1000 may provide a real-time lesson mode through the display unit 120.

As an example, the control unit 100 may be requested to allow the lesson mode to be executed from the first player of the dart game device 1000 while participating in the play session. In this case, the control unit 100 may determine an object including a second play image in which the second player of another device 2000 throws the dart pin among the objects being displayed in the display unit 120. In addition, the control unit 100 may determine the first play image of the first player and the second play image of the second player photographed through the camera unit 140 to be displayed in association with each other.

As an example, the control unit 100 may provide the lesson mode to display the first play image and the second play image to be at least partially overlapped. However, the present disclosure is not limited thereto.

According to some embodiments of the present disclosure, the control unit 100 of the dart game device 1000 may provide the lesson mode based on the previous play related data of the first player.

Specifically, when the control unit 100 is requested to execute the lesson mode from the first player through the user input unit 170, the control unit 100 may recognize the previous play related data of the first player. The control unit 100 may determine a play session in which a second player having a higher average result score of the dart game than the first player participates, based on the previous play related data of the first player. In addition, when it is determined that the first player is to participate in the play session, the control unit 100 may provide a real-time lesson mode to the first player based on the second player participating in the play session.

As an example, the control unit 100 may provide the lesson mode to display the first play image of the first player and the second play image of the second player to be at least partially overlapped. However, the present disclosure is not limited thereto.

According to some embodiments of the present disclosure, the dart game server 3000 may provide a reward based on play result information of a play session in which a plurality of players participates. Hereinafter, a method for providing the reward by the dart game server 3000 according to the present disclosure will be described through FIG. 18.

Figure 18:
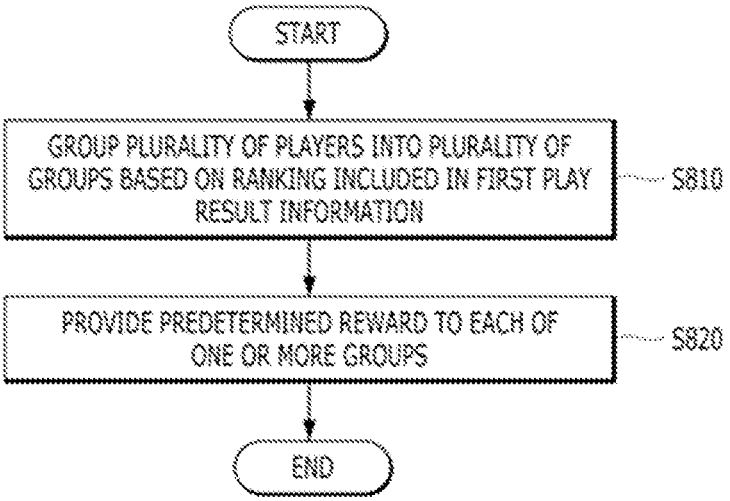
FIG. 18 is a flowchart describing an example of a method for providing a reward by the dart game server according to some embodiments of the present disclosure.

FIG. 18 is a flowchart describing an example of a method for providing a reward by the dart game server according to some embodiments of the present disclosure.

Referring to FIG. 18, the dart game server 3000 may group a plurality of players into a plurality of groups based on the rankings included in the first play result information of a play session in which two or more devices participate (S810).

For example, the dart game server 3000 may determine, as a first group, players of which rankings are $4^{th}$ to $10^{th}$ among the plurality of players who participates in the play session based on the first play result information. In addition, the dart game server 3000 may determine, as a second group, players of which rankings are $10^{th}$ to $20^{th}$ among the plurality of players. However, the present disclosure is not limited thereto.

The dart game server 3000 may provide a predetermined reward to each of one or more groups (S820). Here, the reward may be a game credit, cryptocurrency, or a virtual coin. However, the present disclosure is not limited thereto.

According to some embodiments of the present disclosure, the dart game server 3000 may also provide the reward to one or more players participating in the play session.

Specifically, the dart game server 3000 may determine a specific event to occur while providing one or more play sessions to two or more devices. As an example, the specific event may be an event in which a specific score is acquired within a predetermined time. The dart game server 3000 may determine one or more devices which satisfy the specific event based on play related data received from two or more devices. In this case, the dart game server 3000 may also provide the reward to one or more devices which satisfy the specific event. However, the present disclosure is not limited thereto.

Figure 19:
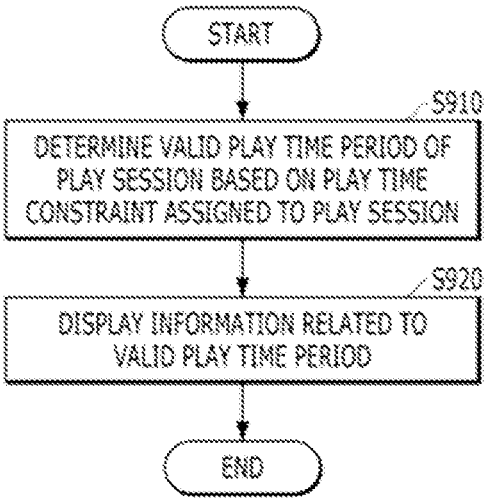
FIG. 19 is a flowchart describing an example of a method for determining a valid play time period of a play session based on a play time constraint assigned to the play session by the dart game device according to some embodiments of the present disclosure.
Figure 20:
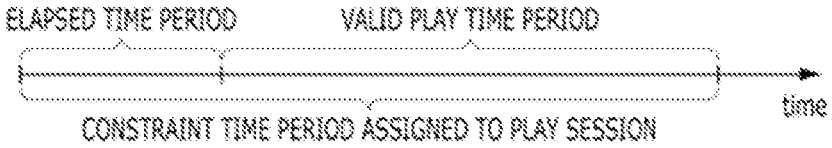
FIG. 20 is a diagram describing an example of a valid play time period according to some embodiments of the present disclosure.

FIG. 19 is a flowchart describing an example of a method for determining a valid play time period of a play session based on a play time constraint assigned to the play session by the dart game device according to some embodiments of the present disclosure. FIG. 20 is a diagram describing an example of a valid play time period according to some embodiments of the present disclosure.

Referring to FIG. 19, the control unit 100 of the dart game device 1000 may determine a valid play time period of the play session based on a play time constraint assigned to the play session (S910). Here, the valid play time period may be a time period in which the first player of the dart game device 1000 is allowed to perform the dart game in the play session. For example, the play session may include a first sub play session in which all players participating in the play session should throw one dart pin from 10 a.m. to 10:00:10 a.m. on Oct. 1, 2021. In this case, the valid play time period of the first sub play session may be 10 seconds, and may be gradually reduced according to the progress of the first sub play session. In other words, the control unit 100 may determine the valid play time period of the play session by a mode in which the valid play time period decreases as time elapses within the play session in determining the valid play time period of the play session. As another example, the play session may include a second sub play session in which all players participating in the play session should end a round by throwing the dart pin three times from 10 a.m. to 10:00:30 a.m. on Oct. 1, 2021. In this case, the valid play time period of the second sub play session may be 30 seconds, and may be gradually reduced according to the progress of the second sub play session. The valid play time period may at least partially correspond to a valid play time period of another device 2000 participating in the play session. According to the embodiment, the valid play time period of the dart game device 1000 and the valid play time period of another device 2000 may be time periods at least partially overlapped.

The valid play time period may be described more with reference to FIG. 20. An x axis of the graph shown in FIG. 20 may indicate the elapse of the time.

Referring to FIG. 20, the elapsed time period and the valid play time period may be present within the constraint time period assigned to the play session. For example, the first sub play session may be assigned with a constraint time period in which all players participating in the first sub play session should throw one dart pin from 10:00:00 a.m. to 10:00:10 a.m. on Oct. 1, 2021. In this case, the valid play time period of the first sub play session may be 10 seconds, and may be gradually reduced according to the elapsed time period of the first sub play session. For example, in the first sub play session, when a time period of 3 seconds elapses without throwing of the dart pin by the player, the valid play time period may be 7 seconds.

According to an embodiment of the present disclosure, the valid play time period may be output from the dart game device 1000 in a form such as a timer, and may present time information in which the player may play in the play session. When the valid play time period elapses, the play in the corresponding play session is not allowed. For example, when the dart pin of the player hits after the valid play time period elapses, the corresponding dart pin does not influence the dart game play.

Referring back to FIG. 19, when the valid play time period of the play session is determined, the display unit 120 of the dart game device 1000 may display information related to the valid play time period (S920). As an example, the display unit 120 may display the information related to the valid play time period in the fourth region 430.

The information related to the valid play time period may include at least one of information indicating the remaining valid play time period, information indicating the elapse of the valid play time period, information indicating the time elapse of the play session, or information indicating the time constraint assigned to the play session. The information indicating the remaining valid play time period may indicate information on a time in which the time constraint period assigned to the play session remains. For example, in a first sub play session in which one dart pin should be thrown from 10 a.m. to 10:00:10 a.m. on Oct. 1, 2021, when 3 seconds elapse without throwing the dart pin by the player, the valid play time period may be 7 seconds. In this case, the control unit 100 may determine 7 seconds as the remaining valid play time period, and display 7 seconds in the fourth region 430. In respect to the information indicating the elapse of the valid play time period, for example, in the first sub play session in which the player should throw one dart pin from 10 a.m. to 10:00:10 a.m. on Oct. 1, 2021, 3 seconds may elapse without throwing the dart pin by the player. In this case, the information indicating the elapse of the valid play time period may be information indicating that a time period of 3 seconds elapses. The information indicating the time elapse of the play session may be information indicating the time elapse of the play session other than at least one sub play session in which a current player plays. For example, the player of the dart game device 1000 may also have to consider the time constraint assigned to the second sub play session in playing the first sub play session. The reason is that the first sub play session may be a play session including the time constraint for dart pin throwing, and the second sub play session may include the time constraint for the round which allows dart pin throwing of N times. In other words, the second sub play session may be a play session for a round in which N first sub play sessions are aggregated. Accordingly, the control unit 100 may also display the information indicating the time elapse of the play session in the fourth region 430 jointly in addition to the information indicating the remaining valid play time period or the information indicating the elapse of the valid play time period. The information indicating the time constraint assigned to the play session may be information for indicating the time constraint assigned to the play session regardless of the time elapse of the play session. For example, the first sub play session may be a sub play session in which all players participating in the play session should throw one dart pin from 10 a.m. to 10:00:10 a.m. on Oct. 1, 2021. In this case, the information for indicating the time constraint assigned to the play session may indicate 10 seconds.

According to some embodiments of the present disclosure, the control unit 100 of the dart game device 1000 may determine the valid play time period based on the elapsed time in the play session and the time constraint assigned to the play session in determining the valid play time period of the play session.

As in the above-described example, in the first sub play session including the time constraint for dart pin throwing, the time may elapse within the play session without throwing the dart pin by the player of the dart game device 1000. For example, the control unit 100 may recognize that 3 seconds elapse without throwing the dart pin by the player in the first sub play session in which all players participating in the play session should throw one dart pin from 10 a.m. to 10:00:10 a.m. on Oct. 1, 2021. In this case, the control unit 100 may determine the valid play time as 7 seconds based on 3 seconds which elapses in the play session and the time constraint of 10 seconds assigned to the play session.

According to some embodiments of the present disclosure, the play time constraint and the valid play time period may be determined again at a time when the play session is changed.

For example, the first sub play session may include a time constraint for dart pin throwing. In addition, due to characteristics of the dart game, the dart game device 1000 may provide, to the player, a play session including a plurality of first sub play sessions. When a first dart pin is thrown by the player, the control unit 100 may determine that one first sub play session among the plurality of first sub play sessions is terminated. As the control unit 100 determines that one first sub play session is terminated, the control unit 100 may provide a subsequent first sub play session by determining the play time constraint and the valid play time period again.

As another example, the determined valid play time period may also be initialized when it is detected that a predetermined number of dart pins are hit on the dart game device 1000. According to the embodiment, the second sub play session may include a time constraint for a round which permits dart pin throwing of N times. Due to characteristics of the dart game, the dart game device 1000 may provide, to the player, a play session including a plurality of second sub play sessions. The control unit 100 may initialize one second sub play session when it is detected that N times dart pins hit. The control unit 100 may provide a subsequent second sub play session by determining the play time constraint and the valid play time period again.

According to some embodiments of the present disclosure, the control unit 100 of the dart game device 1000 may determine a display attribute for information related to the valid play time period. The display attribute may be a property or feature for the information related to the valid play time period determined by the control unit 100 so as to display the information related to the valid play time period in the display unit 120. The display attribute may include at least one of a size attribute for a size of the information related to the valid play time period, a color attribute for a color of the information related to the valid play time period, or a shade attribute for a shade of the information related to the valid play time period. According to the embodiment, the control unit 100 may determine the display attribute for the information related to the valid play time period based on at least one of the play time constraint or the valid play time period. As an example, the control unit 100 may determine the size attribute for the size of the information related to the valid play time period so that the information related to the valid play time period may be displayed to be larger as the play time constraint or the valid play time period is shorter. As another example, the control unit 100 may determine the color attribute for the color of the information related to the valid play time period so that the information related to the valid play time period may be conspicuous as the play time constraint or the valid play time period is shorter. As yet another example, the control unit 100 may determine the shade attribute for the shade of the information related to the valid play time period so that the information related to the valid play time period may be conspicuous as the play time constraint or the valid play time period is shorter. When the display attribute is determined, the display unit 120 may display the information related to the valid play time period based on the determined display attribute. According to the embodiment, the display unit 120 may display the information related to the valid play time period in the fourth region 430.

According to some embodiments of the present disclosure, the control unit 100 of the dart game device 1000 may determine a highlight effect for the information related to the valid play time period based on at least one of the play time constraint or the valid play time period. Here, the highlight effect may be an effect in which a prestored image is displayed in a region adjacent at least a part of a region in which the information related to the valid play time period is displayed. For example, when the fourth object 414 of FIG. 11 is described, a highlight effect 500 may be expressed around the fourth object 414. The control unit 100 may apply the highlight effect 500 expressed around the fourth object 414 or a similar effect to the highlight effect 500 to the information related to the valid play time period. As a result, the interest of the player participating in the dart game may be inspired.

According to some embodiments of the present disclosure, an intensity of the highlight effect may be higher as the valid play time period is shorter. Here, the higher-intensity highlight effect may include at least one of a highlight effect in which a size of the prestored image is relatively large, a highlight effect in which the prestored image has a relatively high chroma, or a highlight effect in which a flashing speed of the prestored image is relatively high.

According to some embodiments of the present disclosure, the control unit 100 of the dart game device 1000 may cause the information related to the valid play time period to be output to another device 2000*a* related to the dart game device 1000. Here, another device 2000*a* may be a mobile device interlocking with the dart game device 1000, and expressing information related to the play session in which the dart game device 1000 participates to the player.

Specifically, when the valid play time period of the play session is determined, the control unit 100 may transmit the information related to the valid play time period to another device 2000 related to the dart game device through the network communication unit 150. In this case, the information related to the valid play time may be output to another device 2000*a*.

According to some embodiments of the present disclosure, the control unit 100 of the dart game device 1000 may control the sound output unit 190 to output a predetermined sound based on the valid play time period.

For example, the control unit 100 may determine a valid play time period of at least one sub play session among the plurality of sub play sessions included in the play session. In addition, when the determined valid play time period is less than a predetermined threshold, the control unit 100 may control the sound output unit 190 to output the predetermined sound.

According to some embodiments of the present disclosure, the control unit 100 of the dart game device 1000 may determine one or more segment regions in the dart target unit, in which a probability that a dart pin to be thrown by the player of the dart game device 1000 will hit is higher than a predetermined threshold. The control unit 100 may also display the information related to the valid play time period in a display region adjacent to outlines of the one or more determined segment regions.

For example, the control unit 100 may determine one or more segment regions in the dart target unit, in which the probability that the dart pin to be thrown by the player will hit is higher than the predetermined threshold based on the play related data of the player of the dart game device 1000. As an example, the predetermined threshold may be determined based on the number of times at which while the player of the dart game device 1000 conducts the dart game by participating in the play session, the player hits one or more segment regions within the dart target.

In the present disclosure, the control unit 100 of the dart game device 1000 may determine one or more segment regions related to a score for determining winning or losing according to a dart game rule. In this case, the control unit 100 may also display the information related to the valid play time period in the display region adjacent to the outlines of the one or more segment regions related to the score for determining the win or loss.

According to some embodiments of the present disclosure, the information related to the valid play time period may also be determined by the dart game server 3000.

Specifically, the control unit of the dart game server 3000 may determine a valid play time period of a first device which participates in the play session based on a play time constraint assigned to a play session in which the play time constraint is assigned to two or more devices. Here, the first device may be dart game device 1000. In this case, the network communication unit of the dart game server 3000 may transmit the information related to the valid play time period to the first device. According to the embodiment, the valid play time period of the first device may at least partially correspond to a valid play time period of a second device participating in the play session. Here, the second device may be another device 2000 other than the dart game device 1000.

According to the above-described configuration, the dart game device 1000 may display the information related to the valid play time period of the play session determined based on the play time constraint assigned to the play session. Accordingly, the user may recognize an elapsed time of the play session and a remaining time of the play session through the information related to the valid play time period displayed in the display unit 120. Moreover, the dart game device 1000 may apply the highlight effect having the higher intensity as the valid play time period is shorter to the information related to the valid play time period. Accordingly, the interest of the user may be inspired.

Meanwhile, according to some embodiments of the present disclosure, the dart game device 1000 may receive the play related data of another device 2000 which participates in the play session in which the dart game device 1000 participates. In this case, the dart game device 1000 may determine a display image related to the play related data based on the received play related data of another device 2000. Hereinafter, a method for determining the display image related to the play related data of another device 2000 by the dart game device 1000 will be described.

Figure 21:
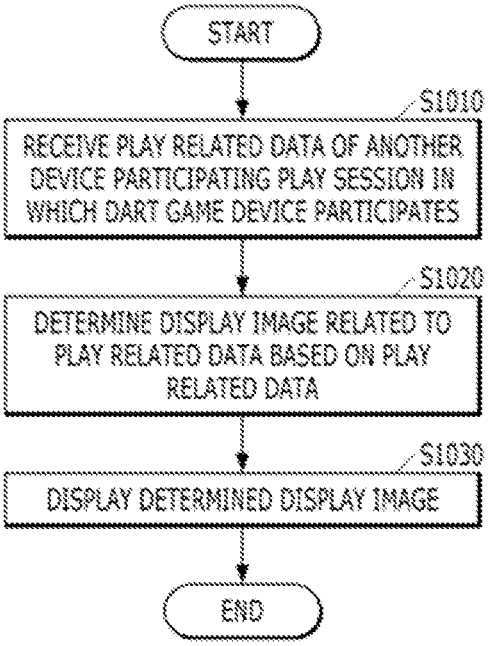
FIG. 21 is a flowchart describing an example of a method for determining a display image related to play related data of another device by the dart game device according to some embodiments of the present disclosure.

FIG. 21 is a flowchart describing an example of a method for determining a display image related to play related data of another device by the dart game device according to some embodiments of the present disclosure.

Referring to FIG. 21, the network communication unit 150 of the dart game device 1000 may receive play related data of another device 2000 which participates in a play session in which the dart game device 1000 participates (S1010). Here, the play related data may include non-image play result data.

The non-image play result data may be data not including a second play image in which the second player of another device 2000 throws the dart pin, and an actual image in which the dart pin thrown by the second player of another device 2000 hits the dart target unit.

As an example, the non-image play result data may include at least one of information on a score which a player of another device acquires by throwing the dart pin, information on a score acquired in a round which permits dart pin throwing of N times, or information on a score acquired in a set including K rounds. Accordingly, the non-image play result data may have a smaller size than image data, and a network delay problem may be resolved, which may occur when the network communication unit 150 receives or transmits the non-image play result data. Further, since the play related data may be received again each time the play session is changed, the non-image play result data may be received again each time the play session is changed.

The control unit 100 of the dart game device 1000 may determine a display image related to the play related data based on the play related data (S1020). The display unit 120 may display the determined display image (S1030). Here, the display image may include at least one of a character image for identifying the player of another device 2000 or an image including a text for identifying the player.

As an example, the control unit 100 may determine a location to which the dart pin of the player of another device 2000 is thrown based on the non-image play result data. The control unit 100 may determine a prestored image related to the dart target unit corresponding to the determined location as the display image. Here, the image related to the dart target unit may include one of a prestored dart target unit related virtual image or a prestored actual image in which the dart pin hits a region related to the dart target unit. The prestored dart target unit related virtual image may be a virtual image in which the dart pin hits the dart target unit, an image in which the dart pin hits a region adjacent to the dart target unit, an image in which the dart pin does not reach the dart target unit and falls to the ground, or an image in which the dart pin passes by the dart target unit. The prestored actual image in which the dart pin hits the region related to the dart target unit may not be an image received from another device 2000 in advance. For example, there may be no large difference between an image in which the dart pin reaches the dart target unit 200 acquired by photographing the dart target unit 200 by the camera unit 140 of the dart game device 1000 and an image in which the dart pin reaches the dart target unit acquired by photographing the dart target unit by the camera unit of another device 2000. In other words, there may be no large difference between an image in which the dart pin thrown by the player of the dart game device 1000 reaches the dart target unit 200 of the dart game device 1000 and an image in which the dart pin thrown by the player of another device 2000 reaches the dart target unit of another device 2000. Moreover, the image in which the dart pin thrown by the player of the dart game device 1000 reaches the dart target unit 200 of the dart game device 1000 may be acquired in advance as the player conducts the dart game by participating in the play session. Accordingly, the control unit 100 may determine, as the display image, a prestored actual image in which the player of the dart game device 1000 throws the dart pin, which hits the region related to the dart target unit 200, which corresponds to the score acquired by the player of another device 2000.

As another example, the control unit 100 may determine a score acquired by throwing the dart pin by the player of another device 2000 based on the non-image play result data. The control unit 100 may also determine, a prestored image related to the dart target unit corresponding to the determined score as the display image.

According to some embodiments of the present disclosure, the control unit 100 of the dart game device 1000 may additionally determine a prestored event image as the display image based on the play related data. Here, the prestored event image may be, for example, an image in which a virtual player appears and yells Triple, an image in which a character for identifying the player of another device 2000 appears and yells Triple, an image in which the virtual player appears and yells Double, an image in which the character for identifying the player of another device 2000 appears and yells Double, etc.

Specifically, the control unit 100 may determine the score acquired by throwing the dart pin by the player of another device 2000 or the location to which the dart pin of the player of another device 2000 is thrown, based on the play related data. When the score or location is determined, the control unit 100 may additionally determine a prestored event image corresponding to the score or location as the display image. In addition, the display unit 120 may display the prestored dart target unit related image and the prestored event image.

According to some embodiments of the present disclosure, the display image may include a prestored previous play image in which the player of another device 2000 throws the dart pin. Here, the prestored previous play image may include an image in which the player of another device 2000 throws the dart pin. In this case, the control unit 100 may also determine the prestored previous play image as the display image in determining the display image related to the play related data.

As an example, the control unit 100 may determine a score acquired by throwing the dart pin by the player of another device 2000 based on the non-image play result data. The control unit 100 may determine, as the display image, the prestored previous play image corresponding to the determined score among the prestored previous play images.

As another example, the control unit 100 may determine a location to which the dart pin of the player of another device 2000 is thrown based on the non-image play result data. The control unit 100 may determine, as the display image, the prestored previous play image corresponding to the determined location among the prestored previous play images.

According to some embodiments of the present disclosure, the prestored previous play image may be stored in a mode of being grouped into a plurality of groups based on score information included in the non-image play result data.

Specifically, the dart target unit may be divided into 62 segment regions. Here, the segments may be appreciated as respective regions acquired by dividing the dart target unit 200 according to the score. When the storage unit 110 of the dart game device 1000 stores all play images in which the player of another device 2000 throws the dart pin, which correspond to respective segment regions, the storage unit 110 may have to store 62 play images per player. When the number of players who participate in the play session is 100, the storage unit 110 may have to store 6200 images of players of respective other devices 2000. However, there may be no large change in the play images related to the players who participate in the play session according to the score. As an example, there may be no large difference between a facial expression change when the player of another device 2000 steadily acquires 20 points, and then acquires 1 point and a facial expressional change when steadily acquiring 20 points, and then acquiring 2 points. In other words, there may be no large difference between a plurality of previous play images in which the player of another device 2000 throws the dart pin according to the score. Accordingly, the control unit 100 may store the prestored previous play image related to another device 2000 in the storage unit 110 in a mode of being grouped into the plurality of groups based on the score information included in the non-image play result data. For example, the control unit 100 may generate a first group corresponding to 1 point to 5 points in the dart game. The control unit 100 may generate a second group corresponding to 6 point to 10 points in the dart game. The control unit 100 may determine, as the first group, a play image related to 1 point to 5 points among a plurality of play images received from another device 2000 through the network communication unit 150, and store only at least one image among the plurality of play images in the storage unit 110. The control unit 100 may determine, as the second group, a play image related to 6 point to 10 points among the plurality of play images received from another device 2000 through the network communication unit 150, and store only at least one image among the plurality of play images in the storage unit 110.

The control unit 100 may determine, as the display image, a prestored previous play image included in a group which belongs to the score information corresponding to the play related data among a plurality of groups in determining the display image.

Specifically, the control unit 100 may determine a group which belongs to corresponding score information among the plurality of groups based on the score information included in the non-image play result data related to another device 2000. The control unit 100 may determine a prestored previous play image included in the group to which the corresponding score information belongs as the display image.

For example, the control unit 100 may determine that the player of another device 2000 acquires 2 points based on the score information included in the non-image play result data related to another device 2000. The control unit 100 may determine a prestored previous play image included in the first group to which 2 points belong as the display image.

As another example, the control unit 100 may determine that the player of another device 2000 acquires 3 points based on the score information included in the non-image play result data related to another device 2000. The control unit 100 may determine a prestored previous play image included in the first group to which 3 points belong as the display image. According to the embodiment, when the player of another device 2000 acquires 3 points, the storage unit 110 may not prestore the corresponding play image related to another device 2000. In other words, the control unit 100 may determine, as the display image, a play image similar to the play image in spite of not prestoring the corresponding play image when the player of another device 2000 acquires 3 points. Accordingly, a resource for the storage unit 110 to store the play image related to another device 2000 may be saved.

According to some embodiments of the present disclosure, the control unit 100 of the dart game device 1000 may compare the play related data of another device 2000 which participates in the play session in which the dart game device 1000 participates and the prestored previous play related data of another device 2000. The control unit 100 may determine whether to display the play image in which the player of another device 2000 throws the dart pin based on a comparison result.

Specifically, the control unit 100 may receive the play related data of another device 2000 through the network communication unit 150. The control unit 100 may compare the received play related data and the previous play related data of another device 2000. The control unit 100 may determine displaying a play image in which the player of another device 2000 related to the play related data throws the dart pin when there is a larger difference than a predetermined threshold according to a comparison result. Alternatively, the control unit 100 may determine displaying a play image in which the player of another device 2000 related to the previous play related data throws the dart pin when there is a smaller difference than the predetermined threshold according to the comparison result. According to the embodiment, the previous play image in which the player of another device 2000 throws the dart pin, which is included in the previous play related data may be displayed in the display unit 120. In this case, as there is the smaller difference than the predetermined threshold according to the comparison result, the control unit 100 may not replace the previous play image displayed in the display unit 120 with a new play image.

According to some embodiments of the present disclosure, the display image displayed in the dart game device 1000 may also be determined by the dart game server 3000.

Specifically, the network communication unit of the dart game server 3000 may receive the play related data of another device 2000 which participates in the play session in which the dart game device 1000 participates. The control unit 100 of the dart game server 3000 may determine a display image related to the play related data to be displayed in the dart game device 1000 based on the received play related data. The network communication unit of the dart game server 3000 may transmit the display image determined by the control unit to the dart game device 1000.

According to the above-described configuration, the dart game device 1000 may determine the display image based on the play related data including the non-image play result data received from another device 2000. Since the non-image play result data has a smaller size than image data, a network delay problem may be resolved, which may occur when the dart game device 1000 receives the non-image play result data.

According to some embodiments of the present disclosure, the dart game device 1000 may also determine whether to transmit the play image related to the player of the dart game device 1000 to another device 2000. Hereinafter, a method for determining whether to transmit the play image to another device 2000 by the dart game device 1000 according to the present disclosure will be described through FIG. 22.

Figure 22:
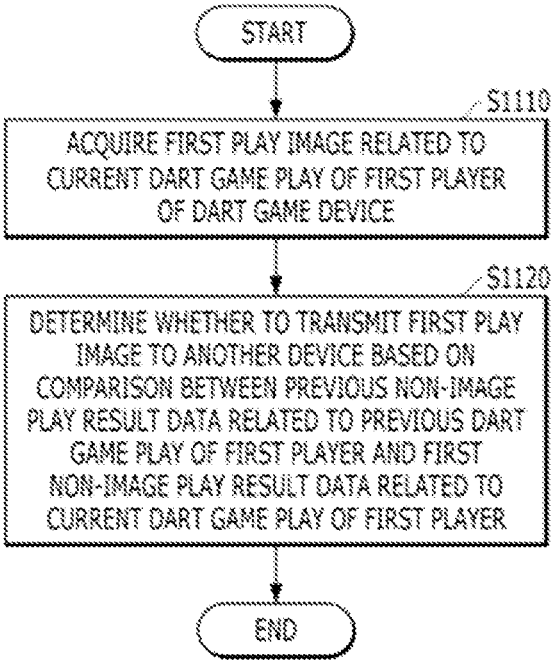
FIG. 22 is a flowchart describing an example of a method for determining whether to transmit, to another device, a play image by the dart game device according to some embodiments of the present disclosure.

FIG. 22 is a flowchart describing an example of a method for determining whether to transmit a play image to another device by the dart game device according to some embodiments of the present disclosure.

Referring to FIG. 22, the image acquisition unit of the dart game device 1000 may acquire a first play image related to a current dart game play of a first player of the dart game device 1000 (S1110). The image acquisition unit may be a module for acquiring an image in which the first player plays the dart game. As an example, the image acquisition unit may include the camera unit 140 for photographing the first player. The first play image may be an image in which the first player throws the dart pin, etc.

The control unit 100 of the dart game device 1000 may compare a difference between previous non-image play result data related to the previous dart game play of the first player stored in the storage unit 110 and first non-image play result data related to the current dart game play of the first player. The control unit 100 may determine whether to transmit the first play image to another device 2000 based on the comparison result (S1120).

For example, the control unit 100 may compare the difference between the previous score information included in the previous non-image play result data and the first score information included in the first non-image play result data. The control unit 100 may determine transmitting the first non-image play result data and the first play image related to the current dart game play of the first player when the difference between the previous score information and the first score information is larger than a predetermined threshold according to the comparison result. Alternatively, the control unit 100 may determine transmitting the first non-image play result data of the first player when the difference between the previous score information and the first score information is equal to or smaller than the predetermined threshold.

According to some embodiments of the present disclosure, the control unit 100 of the dart game device 1000 may also determine whether to transmit the first play image based on ranking information related to the first player in determining whether to transmit the first play image.

Specifically, the control unit 100 may determine whether to transmit the first play image to another device 2000 based on a difference between previous ranking information included in the previous non-image play result data stored in the storage unit 110 and first ranking information included in the first non-image play result data.

For example, the control unit 100 may determine transmitting the first non-image play result data and the first play image related to the current dart game play of the first player when the difference between the previous ranking information stored in the storage unit 110 and the first ranking information is larger than a predetermined threshold. Alternatively, the control unit 100 may determine transmitting the first non-image play result data of the first player when the difference between the previous ranking information stored in the storage unit 110 and the first ranking information is equal to or smaller than the predetermined threshold.

According to some embodiments of the present disclosure, according to a comparison result between the previous non-image play result data and the first non-image play result data of the first player, there is a smaller difference than a predetermined threshold, but the network communication unit 150 may also transmit the first play image to another device 2000. As an example, scores acquired by throwing the dart pins by some players may not also be almost changed. However, there may also be a change in motion or facial expression of the corresponding player. For example, when a win of the first player in the play session in which the first player is participating is confirmed or win or loss of an opponent player is determined, the first player may show a large motion. Accordingly, the control unit 100 may also determine whether to transmit the first play image to another device 2000 based on the play image in addition to the non-image play result.

Specifically, the control unit 100 may determine that there is a smaller difference than a predetermined threshold according to the comparison result between the previous non-image play result data stored in the storage unit 110 and the first non-image play result data. In this case, the control unit 100 may determine whether to transmit the first play image to another device 2000 based on the comparison between the previous play image of the first player prestored in the storage unit 110 and the first play image.

According to some embodiments of the present disclosure, the above-described operations may also be performed by the dart game server 3000.

As an example, the network communication unit of the dart game server 3000 may receive the first play image related to the current dart game play of the first player of the dart game device 1000 which participates in a play session which assigns the play time constraint to two or more devices. The control unit of to another device 2000 based on the comparison between the previous non-image play result data prestored in the storage unit and the first non-image play result data.

According to the above-described configuration, the dart game device 1000 may determine whether to transmit the first play image to another device 2000 based on the comparison between the prestored previous non-image play result data prestored and the first non-image play result data. When the network communication unit 150 transmits the first play image whenever the first play image is acquired through the image acquisition unit, the load of the network traffic may increase. Accordingly, the dart game device 1000 may determine whether to transmit the first play image by comparing the previous non-image play result data and the first non-image play result data. By such a mode, a network load may decrease, and as a result, a real-time dart game play which increases a user experience may be implemented.

Meanwhile, according to some embodiments of the present disclosure, an operation of generating the synthesis image by the control unit 100 of the dart game device 1000 described through FIG. 12B may also be performed by the dart game server 3000. Hereinafter, a method for providing the synthesis image by the dart game server 3000 according to the present disclosure will be described through FIG. 23.

Figure 23:
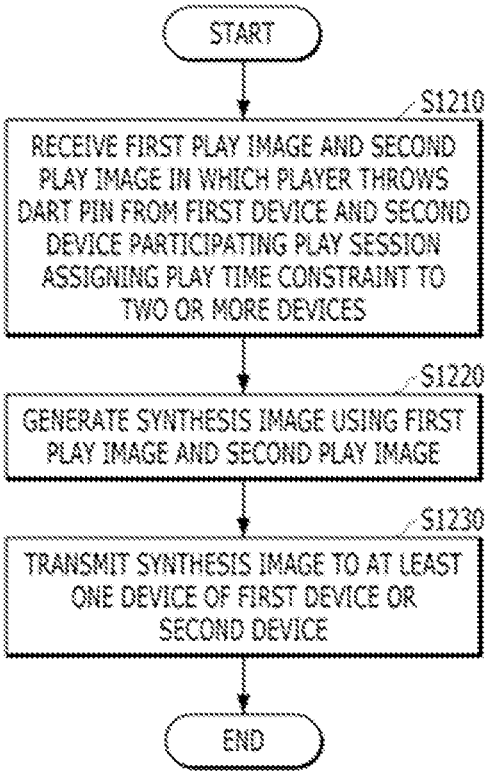
FIG. 23 is a flowchart describing an example of a method for providing a synthesis image by the dart game server according to some embodiments of the present disclosure.

FIG. 23 is a flowchart describing an example of a method for providing a synthesis image by the dart game server according to some embodiments of the present disclosure.

Referring to FIG. 23, the network communication unit of the dart game server 3000 may receive a first play image and a second play image in which a player throws a dart pin from a first device and a second device which participate in a play session which assigns a play time constraint to two or more devices (S1210). Here, the first play image may include a play image of a first player corresponding to the first device, and the second play image may include a play image of a second player corresponding to the second device. The first device and the second device which are distinguished for convenience of description may include the dart game device 1000 and a plurality of other devices.

The control unit of the dart game server 3000 may generate a synthesis image by using the first play image and the second play image (S1220). The network communication unit of the dart game server 3000 may transmit the generated synthesis image to at least one device of the first device or the second device (S1230). Here, the synthesis image may be an image acquired by combining a plurality of play images. Alternatively, the synthesis image may be an image generated by combining objects included in the plurality of play images, respectively.

As an example, the synthesis image may include an image in which the first player and the second player perform the dart game play in one virtual device. Here, the virtual device may be a virtual device similar or completely different from an outer shape of the dart game device 1000 or another device 2000.

As another example, the synthesis image may include an image in which the first player and the second player perform the dart game play in one device of the first device or the second device. Here, the first device and the second device may be one of the dart game device 1000 or another device 2000.

As yet another example, the synthesis image may include an image in which the first player performs the dart game play in the first device and an image in which the second player performs the dart game play in the second device. In other words, the synthesis image may include an image in which the plurality of players performs the dart game play through the dart game devices thereof.

As still yet another example, the synthesis image may include an image in which the first player and the second player throw dart pins toward one device during different time periods, respectively. For example, the control unit of the dart game server 3000 may generate the synthesis image in a form in which the first player and the second player alternatively throw the dart pin.

As another example, the synthesis image may include an image in which the first player and the second player throw dart pins, respectively toward one device during an overlapped time period. For example, the control unit of the dart game server 3000 may generate the synthesis image in a form in which the first player and the second player simultaneously throw the dart pin.

According to some embodiments of the present disclosure, the control unit of the dart game device 1000 may generate the synthesis image based on a location of at least on object to be included in the synthesis image in generating the synthesis image by using the first play image and the second play image.

Specifically, the control unit may determine a location of a first object to be included in the synthesis image. Here, the first object may be an object related to at least one of an outer shape of the dart game device 1000 or an outer shape of another device 2000. The control unit 100 may determine locations of respective second objects related to the first player and the second player, respectively based on the determined location of the first object. According to the embodiment, the control unit may also change sizes of the respective second objects. When the location of each of the first object and the second object is determined, the control unit may generate images for the second objects to be included in the synthesis image based on the first play image and the second play image. For example, an object not related to the dart game or a background region may be included in each of the first play image and the second play image in addition to the second object. The control unit may generate the images for the second objects by removing the non-related object or background region. When the images for the second objects are generated, the control unit may generate the synthesis image based on the location of the first object, the locations of the respective second objects, and the images for the second objects. Accordingly, the control unit may generate the synthesis image including a first object related to the outer shape of the dart game device 1000 or another device 2000 or the second objects related to the first player and the second player, respectively. According to the embodiment, the control unit may also insert a landscape such as an interior or travel destination into the background region in generating the synthesis image.

According to some embodiments of the present disclosure, the control unit of the dart game server 3000 may generate a synthesis image including another player other than the first player and the second player.

Specifically, the control unit may determine a size in which the synthesis image is displayed before generating the synthesis image. According to the embodiment, the synthesis image may display in the entirety of the first region 410 of the dart game device 1000, or also displayed in at least a partial region of the first region 410. Accordingly, the control unit of the dart game server 3000 may determine a size of a synthesis image to be displayed in the dart game device 1000 or another device 2000. The control unit may determine the number of players to be included in the synthesis image based on the determined size. As an example, the control unit may determine the number of players to be included in the synthesis image in a mode of being in proportion to the determined size of the synthesis image.

According to some embodiments of the present disclosure, the control unit of the dart game server 3000 may group the plurality of devices based on the play related data, and generate the synthesis image for each of the plurality of generated groups.

Specifically, the control unit may generate the plurality of groups based on the play related data of the plurality of respective devices including the first device and the second device. The control unit may generate the synthesis image for each of the plurality of generated groups.

As an example, the control unit may generate the plurality of groups according to at least reference of a first reference of generating the group based on a ranking value included in the play related data or a second reference for generating the group based on a score value included in the play related data. For example, when the control unit generates a synthesis image to be transmitted to the first device, the control unit may determine first ranking information included in first play related data of the first device. The control unit may determine at least one device having a ranking close to the first ranking information in a play session in which the first device participates. The control unit may generate the group by grouping the first device and at least one device, and generate the synthesis image for the generated group. When the synthesis image is generated, the network communication unit may transmit the synthesis image to the first device. As another example, when the control unit generates the synthesis image to be transmitted to the first device, the control unit may determine a first score value based on information on the ranking included in the first play related data of the first device. The control unit may determine at least one device having a score value close to the first score value in the play session in which the first device participates. The control unit may generate the group by grouping the first device and at least one device, and generate the synthesis image for the generated group. When the synthesis image is generated, the network communication unit may transmit the synthesis image to the first device.

According to some embodiments of the present disclosure, the network communication unit of the dart game server 3000 may also transmit the play image other than the synthesis image jointly in transmitting the synthesis image to at least one device of the first device or the second device.

Specifically, the network communication unit may transmit a synthesis image generated by using play images of players included in the first group among the plurality of groups to at least one device of the first device or the second device. The network communication unit may transmit play images of players included in a second group in which players not belonging to the first group are grouped to at least one device of the first device or the second device.

As an example, when the control unit determines transmitting the synthesis image to the first device, the control unit may determine the first ranking information included in the first play related data of the first device. The control unit may generate the first group to include at least one device having a ranking close to the first ranking information in the play session in which the first device participates. The control unit may generate the second group to include at least one device having a ranking not close to the first ranking information relatively compared to the first group. The control unit may generate the synthesis image by using the play images of the players included in the first group. When the synthesis image is generated, the network communication unit may transmit the play images of the players included in the second group jointly in addition to transmitting the synthesis image to the first device.

As another example, when the control unit determines transmitting the synthesis image to the first device, the control unit may determine the first ranking information included in the first play related data of the first device. The control unit may generate the first group to include at least one device having a ranking close to the first ranking information in the play session in which the first device participates. The control unit may generate the second group to include at least one device having a ranking not close to the first ranking information relatively compared to the first group. The control unit may generate the synthesis image by using the play images of the players included in the second group. When the synthesis image is generated, the network communication unit may transmit the play images of the players included in the first group jointly in addition to transmitting the synthesis image to the first device.

According to some embodiments of the present disclosure, the control unit of the dart game server 3000 may also generate a synthesis image by using play images received from a second device and a third device in addition to the first device. Here, the third device may be a device which is participating in a play session which is the same as the play session in which the first device and the second device participate. The network communication unit may transmit the generated synthesis image to the first device. In other words, the dart game server 3000 may also generate and transmit a synthesis image not including the first play image of the first device in transmitting the synthesis image to the first device.

According to the above-described configuration, the dart game server 3000 may generate the synthesis image by various modes, and transmit the generated synthesis image to the dart game device 1000 or another device 2000. In this case, the player of the dart game device 1000 or another device 2000 may experience a realism such as playing the dart game jointly with multiple players.

According to some embodiments of the present disclosure, the display unit 120 of the dart game device 1000 may display an object related to another device 2000 in the background region 440. Hereinafter, a method for displaying the object related to another device 2000 in the background region 440 by the dart game device 1000 will be described through FIG. 24.

Figure 24:
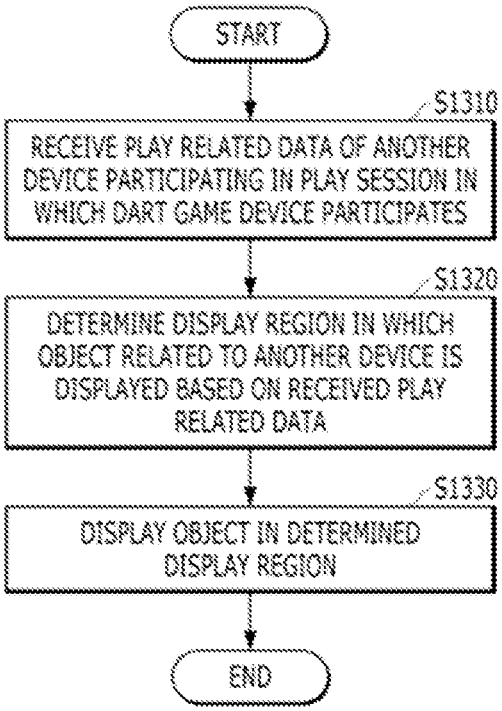
FIG. 24 is a flowchart describing an example of a method for displaying an object related to another device in a background region by the dart game device according to some embodiments of the present disclosure.

FIG. 24 is a flowchart describing an example of a method for displaying an object related to another device in a background region by the dart game device according to some embodiments of the present disclosure.

Referring to FIG. 24, the network communication unit 150 of the dart game device 1000 may receive play related data of another device 2000 which participates in a play session in which the dart game device 1000 participates (S1310).

As an example, the network communication unit 150 may receive play related data including non-image play result data indicating a dart game play result of a player who plays the dart game by using another device 2000.

The control unit 100 of the dart game device 1000 may determine a display region in which the object related to another device 2000 is displayed based on the received play related data (S1320). When the display region is determined by the control unit 100, the display unit 120 may display the object in the display region (S1330). Here, the display region may be a region adjacent to at least a part of an outline of the dart target unit 200 of the dart game device 1000. As an example, the display region may be positioned in the background region 440. According to the embodiment, the object may include at least one of an image in which a player of another device 2000 throws the dart pin within a time period included in a play session, a predetermined image for identifying the player of another device 2000, an image for expressing a scorer according to a play result of another device 2000, or a predetermined text for identifying the player of another device 2000.

According to some embodiments of the present disclosure, the control unit 100 of the dart game device 1000 may determine the display region based on a segment of the dart target unit 200 in determining the display region in which the object related to another device 2000 is displayed. Here, the segment may be appreciated as respective regions acquired by dividing the dart target unit 200 according to the score.

Specifically, the control unit 100 may determine the segment of the dart target unit 200, which corresponds to the score information included in the received play related data. For example, the control unit 100 may determine that the player of another device 2000 acquires 20 points through the score information related to another device 2000. In this case, the control unit 100 may determine a segment corresponding to 20 points in the dart target unit 200. The control unit 100 may determine a virtual line extended toward one point of the determined segment from the center of the dart target unit 200. The control unit 100 may determine a portion adjacent to a point where the virtual line meets the outline of the dart target unit 200 as the display region in which the object is displayed.

According to some embodiments of the present disclosure, the play related data which the network communication unit 150 of the dart game device 1000 receives from another device 2000 may include non-image play result data indicating a dart game play result of a player who plays the dart game by using another device 2000. As a result, the control unit 100 may determine the display region in which the object related to another device 2000 is displayed based on the non-image play result data.

Specifically, the control unit 100 may determine a score acquired by throwing the dart pin by the player of another device 2000 based on the non-image play result data. For example, the control unit 100 may determine that the player of another device 2000 acquires 20 points through the score information of another device 2000 included in the non-image play result data. In this case, the control unit 100 may determine a segment corresponding to 20 points in the dart target unit 200. The control unit 100 may determine a location adjacent to at least part of the outline of the dart target unit 200 corresponding to the determined score as the display region in which the object is displayed.

According to some embodiments of the present disclosure, the control unit 100 of the dart game device 1000 may determine a size of an object or the number of objects to be displayed in the display region.

As an example, the control unit 100 may determine a size of a prestored object to be displayed based on the non-image play result data received from another device 2000. According to the embodiment, the control unit 100 may determine the size of the object based on at least one of the score information or the ranking information included in the play related data. For example, the control unit 100 may determine the size of the object in a mode in which the higher the score value of the player of another device 2000 within the play session, the larger the size of the object is displayed, based on the score information. As another example, the control unit 100 may determine the size of the object in a mode in which the higher the ranking of the player of another device 2000 within the play session, the larger the size of the object is displayed, based on the ranking information.

As another example, the control unit 100 may determine a prestored number of objects to be displayed based on the non-image play result data received from another device 2000. According to the embodiment, the control unit 100 may determine the number of objects based on at least one of the score information or the ranking information included in the play related data. For example, the control unit 100 may determine whether a round or set-unit score value of the play session is equal to or more than a specific score value based on the score information of the player of another device 2000. When the score value of the player of another device 2000 is equal to or more than the specific score value, the control unit 100 may determine the object related to another device 2000 as the object to be displayed in the display region. By such a mode, the control unit 100 may determine the number of objects to be displayed in the display unit 120. As another example, the control unit 100 may determine whether a round or set-unit ranking of the play session is equal to or more than a specific ranking based on the ranking information of the player of another device 2000. When the ranking of the player of another device 2000 is equal to or more than the specific ranking, the control unit 100 may determine the object related to another device 2000 as the object to be displayed in the display region. By such a mode, the control unit 100 may determine the number of objects to be displayed in the display unit 120.

According to some embodiments of the present disclosure, the display unit 120 of the dart game device 1000 may display the object in the determined display region by a mode in which display duration of the object or a display size of the object is varied based on the received play related data.

Specifically, the control unit 100 may determine the display duration of the object by at least one mode of a first mode in which the larger the score information included in the received play related data, the longer the display duration of the object, a second mode in which the more the ranking information included in the received play related data is adjacent to the ranking information of the player of the dart game device 1000, the longer the display duration of the object, and a third mode in which as the ranking information included in the received play related data corresponds a higher ranking, the longer the display duration of the object. Further, the control unit 100 may determine the display size of the object by at least one mode of a first mode in which the larger the score information included in the received play related data, the larger the display size of the object, a second mode in which the ranking information included in the received play related data is adjacent to the ranking information of the player of the dart game device 1000, the larger the display size of the object, and a third mode in which as the ranking information included in the received play related data corresponds a higher ranking, the larger the display size of the object.

According to some embodiments of the present disclosure, the control unit 100 of the dart game device 1000 may also determine the object to be displayed in the display region based on time information. Here, the time information may be information indicating a time when the network communication unit 150 receives the play related data from another device 2000. Alternatively, the time information may be information indicating that time when the play related data is generated in another device 2000.

Specifically, the network communication unit 150 may receive the play related data from each of the first device and the second device positioned remotely from each other. Here, the first device and the second device may be other devices 2000 which participate in the play session in which the dart game device 1000 participates. The control unit 100 may determine first time information for first play related data corresponding to the first device, and determine second time information for second play related data corresponding to the second device. Here, a meaning of determining the time information may be appreciated as a meaning of determining a time of receiving the play related data or a time at which another device 2000 generates the play related data. The control unit 100 may display a first object corresponding to the first play related data and a second object corresponding to the second play related data in the display region based on the determined time information.

For example, when the first time information is temporally earlier than the second time information, the control unit 100 may display the first object related to the first device more proximal to the center of the dart target unit 200 in the display region than the second object related to the second device. As another example, when the first time information is temporally earlier than the second time information, the control unit 100 may display the first object related to the first device more distal to the center of the dart target unit 200 in the display region than the second object related to the second device.

According to some embodiments of the present disclosure, when the first time information is temporally earlier than the second time information, the control unit 100 of the dart game device 1000 may also display the first object related to the first device in the display region, and then replace the first object with the second object related to the second device, and display the second object in the display region.

As an example, the network communication unit 150 of the dart game device 1000 may receive the first play related data of the first device. As the control unit 100 receives the first play related data, the control unit 100 may display the first object related to the first device in the display region. After the first object is displayed in the display region, the network communication unit 150 may receive the second play related data of the second device. When the time information is information indicating the time of receiving the play related data from another device 2000, the control unit 100 may replace the first object, and display the second object in the display region.

As another example, the network communication unit 150 of the dart game device 1000 may receive the first play related data from the first device. As the control unit 100 receives the first play related data, the control unit 100 may display the first object related to the first device in the display region. After the first object is displayed in the display region, the network communication unit 150 may receive the second play related data of the second device. When the time information is information indicating a time when another device 2000 generates the play related data, the control unit 100 may determine the first time information for first play related data corresponding to the first device, and determine the second time information for second play related data corresponding to the second device. When the first time information is temporally earlier than the second time information, the control unit 100 may replace the first object, and display the second object in the display region.

According to some embodiments of the present disclosure, even though the control unit 100 of the dart game device 1000 receives the first play related data from the first device through the network communication unit 150, and then receives the second play related data from the second device, the control unit 100 may not also replace the first object displayed in the display region with the second object.

According to some embodiments of the present disclosure, the object related to the dart game device 1000 may also be displayed in the display region of the dart game device 1000. In this case, the control unit 100 may determine a location of the object related to another device 2000 in the display region based on the play related data of the dart game device 1000.

Specifically, the network communication unit 150 may receive the play related data from another device 2000. The control unit 100 may compare the play related data of the dart game device 1000 and the received play related data of another device 2000. The control unit 100 may display the object related to another device 2000 in the determined display region based on a result of the comparison.

For example, the control unit 100 may determine that hit location information included in the received play related data and hit location information included in the play related data of the dart game device 1000 correspond to each other according to the result of the comparison. In this case, the control unit 100 may display the object related to another device 2000 more distal to the center of the dart target unit 200 in the display region than the object corresponding to the player of the dart game device 1000.

As another example, the control unit 100 may determine that the hit location information included in the received play related data and the hit location information included in the play related data of the dart game device 1000 correspond to each other according to the result of the comparison. In this case, the control unit 100 may display the object related to another device 2000 more proximal to the center of the dart target unit 200 in the display region than the object corresponding to the player of the dart game device 1000.

As yet another example, the control unit 100 may determine that the hit location information included in the received play related data and the hit location information included in the play related data of the dart game device 1000 correspond to each other according to the result of the comparison. The control unit 100 may display the object related to another device 2000 on the same line as the object corresponding to the player of the dart game device 1000, and also display the object related to another device not to overlap with the object corresponding to the player of the dart game device 1000. Here, the same line may be a virtual curve corresponding to a diameter of the outline of the dart target unit 200.

As still yet another example, the control unit 100 may determine that the hit location information included in the received play related data and the hit location information included in the play related data of the dart game device 1000 correspond to each other according to the result of the comparison. The control unit 100 may display the object related to another device 2000 on the same line as the object corresponding to the player of the dart game device 1000, and also display the object related to another device to overlap at least partially with the object corresponding to the player of the dart game device 1000.

According to the above-described configuration, the dart game device 1000 may display the object related to another device 2000 in a display region adjacent to a point meeting the outline of the dart target unit 200. Due to characteristics of the dart game, the players may have a relatively higher visual concentration for the dart target unit 200 and a peripheral portion of the dart target unit 200 than another region. Accordingly, as the object related to another device 2000 is displayed in the display region adjacent to the point meeting the outline of the dart target unit 200, the interest of the user on the dart game may be enhanced.

According to some embodiments of the present disclosure, a highlight effect 500 may be expressed around the object related to another device 2000 or the object related to the dart game device 1000. Hereinafter, a method for applying the highlight effect around the object related to another device 2000 by the dart game device 1000 will be described.

Figure 25:
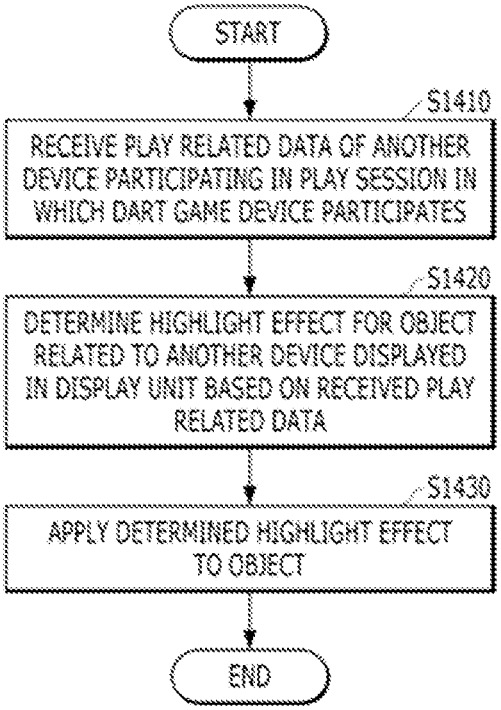
FIG. 25 is a flowchart describing an example of a method for applying a highlight effect to a vicinity of the object related to another device by the dart game device according to some embodiments of the present disclosure.

FIG. 25 is a flowchart describing an example of a method for applying a highlight effect to a vicinity of the object related to another device by the dart game device according to some embodiments of the present disclosure.

Referring to FIG. 25, the network communication unit 150 of the dart game device 1000 may receive play related data of another device 2000 which participates in a play session in which the dart game device 1000 participates (S1410). As an example, the network communication unit 150 may receive play related data including non-image play result data indicating a dart game play result of a player who plays the dart game by using another device 2000.

The control unit 100 may determine the highlight effect 500 for the object related to another device 2000 displayed in the display unit 120 based on the received play related data (S1420). The control unit 100 may apply the determined highlight effect to the object (S1430). Here, the highlight effect may include a first highlight effect in which a prestored image is displayed in a region adjacent to at least a part of the region in which the object is displayed.

For example, the control unit 100 may determine that another device 2000 related to the object displayed in the display unit 120 is another device 2000 related to a player prestored by the player of the dart game device 1000 based on the received play related data, In this case, the control unit 100 may apply the first highlight effect around the object related to another device 2000.

According to some embodiments of the present disclosure, the control unit 100 of the dart game device 1000 may also determine duration of the highlight effect with the determined other device 2000.

Specifically, the network communication unit 150 may receive, from another device 2000, play related data including data indicating a dart game play result of a player who plays the dart game by using another device 2000. The control unit 100 may determine the duration for the highlight effect determined based on at least one of dart game related score information or dart game related ranking information included in the play related data.

As an example, the control unit 100 may determine the time in a mode in which the higher the score value of the player of another device 2000 within the play session, the longer the highlight effect is continued based on the score information related to another device 2000. As another example, the control unit 100 may determine the duration in a mode in which the higher the ranking of the player of another device 2000 within the play session, the longer the highlight effect is continued based on the ranking information related to another device 2000.

According to some embodiments of the present disclosure, the highlight effect may include an effect of rotating the object. The highlight effect may include at least one a second highlight effect of rotating the object a predetermined number of rotation times based on a center point of the object, a third highlight effect of rotating the object a predetermined number of rotation times based on a vertical center line of the object, and a fourth highlight effect of rotating the object a predetermined number of rotation times based on a horizontal center line of the object.

As an example, the control unit 100 may apply a second highlight effect to the object related to another device 2000 displayed in the display unit 120 based on the play related data received from another device 2000. According to the embodiment, the second highlight effect may be an effect of rotating the object a predetermined number of rotation times based on the center point of the object. Specifically, the control unit 100 may determine the center point of the object determining applying the second highlight effect. The control unit 100 may rotate the object in a clockwise direction or a counterclockwise direction a predetermined number of rotation times based on the determined center point of the object.

As another example, the control unit 100 may apply a third highlight effect to the object related to another device 2000 displayed in the display unit 120 based on the play related data received from another device 2000. According to the embodiment, the third highlight effect may be an effect of rotating the object a predetermined number of rotation times based on a vertical center line of the object. Specifically, the control unit 100 may determine the vertical center line of the object determining applying the third highlight effect. The control unit 100 may rotate the object a predetermined number of rotation times based on the determined center line of the object. When the control unit 100 rotates the object the predetermined number of rotation times based on the vertical center line of the object, the user may obtain a visual effect such as the object moving in three dimensions.

As yet another example, the control unit 100 may apply a fourth highlight effect to the object related to another device 2000 displayed in the display unit 120 based on the play related data received from another device 2000. According to the embodiment, the fourth highlight effect may be an effect of rotating the object a predetermined number of rotation times based on a horizontal center line of the object. Specifically, the control unit 100 may determine the horizontal center line of the object determining applying the fourth highlight effect. The control unit 100 may rotate the object a predetermined number of rotation times based on the determined center line of the object. When the control unit 100 rotates the object the predetermined number of rotation times based on the horizontal center line of the object, the user may obtain a visual effect such as the object moving in three dimensions.

According to some embodiments of the present disclosure, the control unit 100 of the dart game device 1000 may determine the duration of the highlight effect for the object. The control unit 100 may also determine the number of rotation times of rotating the object or a rotation speed of rotating the object based on the duration.

Specifically, the control unit 100 may determine the duration for the highlight effect of the object related to another device 2000 which is determined based on the play related data received from another device 2000. The control unit 100 may determine a predetermined number of rotation times and a speed of rotating the object based on the determined duration.

According to some embodiments of the present disclosure, the highlight effect may include a fifth highlight effect of varying the size of the object a predetermined number of variation times.

As an example, the control unit 100 may apply the fifth highlight effect to the object related to another device 2000 displayed in the display unit 120 based on the play related data received from another device 2000. According to the embodiment, the control unit 100 may determine the determined duration for the fifth highlight effect based on the play related data. The control unit 100 may determine a predetermined number of variation times and a speed of varying the object based on the determined duration.

According to some embodiments of the present disclosure, the highlight effect may include a sixth highlight effect of changing a size of a displayed object. Here, a meaning of changing the size of the displayed object may be appreciated as a meaning that the size may be changed until the play session in which the dart game device 1000 participates is changed. The change of the play session may be an end or a start of a first sub play session, a second sub play session, or a third sub play session. For example, referring to FIG. 12A, an object 411 related to another device 2000 to which the sixth highlight effect is applied may be displayed to have a larger size than another object until the play session is changed. When FIG. 12A is described more, when the size of the displayed object is changed, sizes of other objects or the number of objects adjacent to the object may be changed adaptively to a changed display size of the object.

For example, referring to FIG. 11, eight objects related to a plurality of other devices, respectively may be displayed in the first region 410 of the display unit 120. The control unit 100 may apply the sixth highlight effect to the first object 411 among the plurality of other devices. Referring back to FIG. 12A, as the sixth highlight effect is applied to the first object 411, the size of the first object 411 may be changed. In addition, the number of one or more other objects other than the first object 411, which are displayed may be changed adaptively to the size of the first object 411. According to the embodiment, sizes of one or more other objects other than the first object 411 may also be changed adaptively to the size of the first object 411.

According to some embodiments of the present disclosure, the highlight effect may include a seventh highlight effect of changing the location of the displayed object. When at location at which the object is displayed is changed, the object may be displayed in a mode in which the object moves relatively according to the display location of the object in which locations of other objects adjacent to the object are changed.

For example, referring to FIG. 11, the control unit 100 may apply the seventh highlight effect to a second object 412 based on play related data of another device 2000 related to the second object 412. As an example, the control unit 100 may determine ranking information related to the second object 412 based on the play related data of another device 2000 related to the second object 412. The control unit 100 may determine ranking information related to the first object 411 based on the play related data of another device 2000 related to the first object 411. As the control unit 100 determines that a ranking included in the ranking information related to the second object 412 reverses a ranking included in the ranking information related to the first object 411, the control unit 100 may apply the seventh highlight effect to the second object 412 to change the location of the second object 412. As a result, the second object 412 may be changed to a location at which the first object 411 is displayed. As the display location of the second object 412 is changed, the first object 411 may move relatively. For example, the first object 411 may move to a location at which the second object 412 is displayed.

According to some embodiments of the present disclosure, the control unit 100 of the dart game device 1000 may determine the highlight effect for the object related to another device 2000 based on the player of another device 2000 satisfying a specific event condition. Here, the specific event condition may include at least one of a first event condition generated when a specific score is acquired within a predetermined time, a second event condition generated when a time constraint for dart pin throwing assigned to a play session is exceeded, a third event condition generated when N times dart pins are not thrown within a time constraint for a round assigned to the play session, or a fourth event condition generated when K rounds are not ended within a time constraint for a set assigned to the play session.

Specifically, the control unit 100 may determine whether the player of another device 2000 satisfies the specific event condition based on the play related data received from another device 2000. According to the embodiment, when the control unit 100 determines that the player of another device 2000 acquires a specific score within a predetermined time based on the play related data, the control unit 100 may determine that the first event condition is satisfied. Alternatively, when the control unit 100 determines that the player of another device 2000 does not throw the dart pin to exceed the time constraint for dart pin throwing assigned to the play session based on the play related data, the control unit 100 may determine that the second event condition is satisfied. Alternatively, when the control unit 100 determines that the player of another device 2000 does not throw the dart pin N times to exceed the time constraint for the round assigned to the play session based on the play related data, the control unit 100 may determine that the third event condition is satisfied. Alternatively, when the control unit 100 determines that the player of another device 2000 does not end K rounds to exceed the time constraint for the set assigned to the play session based on the play related data, the control unit 100 may determine that the fourth event condition is satisfied.

When at least one specific event condition among the first to fourth event conditions is satisfied, the control unit 100 may determine the highlight effect for the object related to another device 2000. As an example, the control unit 100 may apply at least one highlight effect among the first to seventh highlight effects to the object related to another device 2000.

According to some embodiments of the present disclosure, the above-described operations may also be performed by the dart game server 3000.

Specifically, the network communication unit of the dart game server 3000 may receive the first play related data from the first device which participates in a play session in which a play time constraint is assigned to two or more devices, and receive the first play related data from the second device. The control unit of the dart game server 3000 may determine the highlight effect for the object related to the second device displayed in the display unit of the first device based on at least one of the first play related data and the second play related data. The control unit 100 may apply the determined highlight effect to the object related to the second device displayed in the display unit of the first device.

According to the above-described configuration, the dart game device 1000 may provide the visual effect to the user in various modes including the first to seventh highlight effects. Accordingly, the interest of the player who uses the dart game device 1000 may be promoted.

According to some embodiments of the present disclosure, the dart game device 1000 may prevent cheating of the player by using facial information. Hereinafter, a method for preventing the cheating of the player by the dart game device 1000 according to the present disclosure will be described through FIG. 26.

Figure 26:
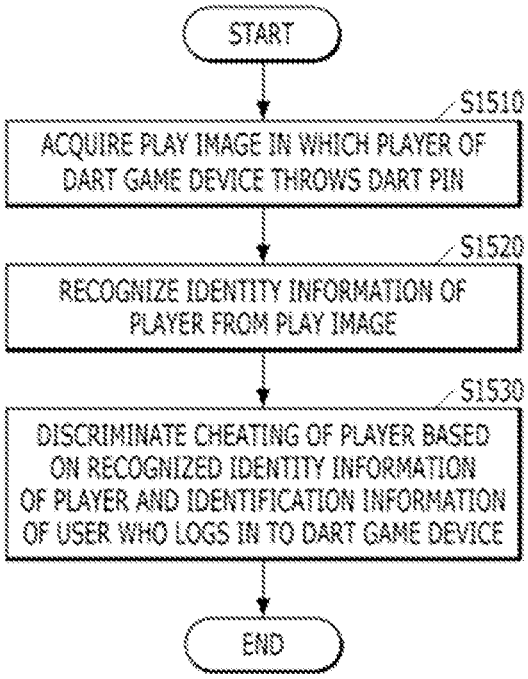
FIG. 26 is a flowchart describing an example of a method for preventing cheating of a player by the dart game device according to some embodiments of the present disclosure.

FIG. 26 is a flowchart describing an example of a method for preventing cheating of a player by the dart game device according to some embodiments of the present disclosure.

Referring to FIG. 26, the image acquisition unit of the dart game device 1000 may acquire a play image in which the player of the dart game device 1000 throws the dart pin (S1510). The image acquisition unit may be a module for acquiring an image in which the player of the dart game device 1000 plays the dart game. As an example, the image acquisition unit may include a camera unit 140 for photographing the player.

The control unit 100 of the dart game device 1000 may recognize identity information of the player from a play image (S1520). Here, the identity information may include an image for a body part for identifying the player.

Specifically, the control unit 100 may recognize the identity information of the player by using a neural network model learned to segment the body part of the player in the play image. The neural network may be a network for determining latent structures of data. The neural network may determine latent structures (for example, which object has a photo) of a photo, a text, a video, a voice, and a music. According to the present disclosure, the neural network model may segment the body part of the player from the acquired play image. Here, the segmentation may be appreciated as an operation of segmenting a body of the player into a plurality of parts. The neural network may include a deep neural network (DNN), a convolutional neural network (CNN), a recurrent neural network (RNN), an auto encoder, generative adversarial networks (GAN), a restricted Boltzmann machine (RBM), a deep belief network (DBN), a Q network, a U network, a Siam network, and the like. The description of the neural network described above is just an example and the present disclosure is not limited thereto. Here, the description of the neural network is known technology, so a detailed description will be omitted.

According to some embodiments of the present disclosure, the recognized identity information of the player may include a facial image for identifying the player.

Specifically, the control unit 100 of the dart game device 1000 segments a face or a facial part of the user to recognize the identity information including the facial image.

The control unit 100 of the dart game device 1000 may discriminate the cheating of the player based on the recognized identity information of the player and identification information of a user who logs in to the dart game device 1000 (S1530). Here, the log-in identification information of the user may include the facial image of the user.

Specifically, the control unit 100 may discriminate the cheating of the player based on a similarity between the facial image for identifying the player included in the identity information and the facial image of the user included in the identification information.

For example, when the similarity is less than a predetermined threshold, the control unit 100 may determine that the player does not correspond to the user who logs in to the dart game device 1000. As another example, when the similarity is equal to or more than the predetermined threshold, the control unit 100 may determine that the player corresponds to the user who logs in to the dart game device 1000.

According to some embodiments of the present disclosure, the control unit 100 of the dart game device 1000 may recognize an iris of the player in recognizing the identity information of the player from the play image. In this case, the control unit 100 may discriminate the cheating of the player based on one or more features extracted from the recognized iris of the player and iris information of the user included in the identification information.

According to some embodiments of the present disclosure, the control unit 100 of the dart game device 1000 may also determine a height, a body type, or a gender of the player based on the recognized identity information of the player. In this case, the control unit 100 may also discriminate the cheating of the player based on a comparison of at least one of the height, the body type, or the gender of the player included in the identity information and the height, the body type, or the gender of the user included in the identification information.

According to some embodiments of the present disclosure, when it is determined that the recognized player does not correspond to the user who logs in to the dart game device 1000, the control unit 100 of the dart game device 1000 may determine ejecting the user from the play session in which the dart game device 1000 participates or neutralize the player of the user. Moreover, the control unit 100 may cancel and log-out log-in to the dart game device 1000 or log-in to the dart game server 3000.

When it is determined that the recognized player does not correspond to the user who logs in to the dart game device 1000, the network communication unit 150 of the dart game device 1000 may transmit at least one of the identification information of the user or the play image to the dart game server 3000. As a result, the dart game server 3000 may record the at least one in a database to prevent the user from participating in another play session. Alternatively, the dart game server 3000 may record the at least one in the database to prevent the user from logging in to the dart game server 3000.

According to some embodiments of the present disclosure, when it is determined that the recognized player does not correspond to the user who logs in to the dart game device 1000, the control unit 100 of the dart game device 1000 may generate an additional quest for authenticating the identity between the player and the user. Here, the additional quest may be appreciated as an operation for requesting a specific action to the user in order to prevent eject a legitimate user from the play session. As an example, the additional quest may include at least one of a first quest for requesting the player to be photographed in a range of one or more lines in which the player is displayed after displaying one or more predetermined lines in the display unit 120 of the dart game device 1000, or a second quest for requesting a password stored in the identification information to be input through the user input unit 170 of the dart game device 1000. The control unit 100 may discriminate the cheating of the player based on whether to authenticate the identity through the additional quest.

For example, the control unit 100 may recognize the identity information of the player from the play image of the player photographed in the range of one or more lines displayed in the display unit 120. The control unit 100 may discriminate the cheating of the player based on the recognized identity information of the player and the identification information of the user who logs in to the dart game device 1000.

As another example, the control unit 100 may be input with the password from the player through the user input unit 170. The control unit 100 may discriminate the cheating of the player based on whether the password input from the player matching the password included in the identification information of the user who logs in.

According to some embodiments of the present disclosure, the play time constraint assigned to the play session in which the player of the dart game device 1000 participates may include a predetermined waiting time period between two rounds or between two sets. In this case, the authentication through the additional quest may be performed during the waiting time period. In other words, the control unit 100 may perform the authentication through the additional quest when the dart game is not in progress in the play session in which the player of the dart game device 1000 participates.

According to some embodiments of the present disclosure, the image acquisition unit of the dart game device 1000 may acquire the play image periodically or aperiodically.

As an example, the image acquisition unit may acquire a play image in which the player of the dart game device 1000 throws the dart pin by the unit of at least one sub play session included in the play session.

According to the embodiment, the play session may include at least one of a first sub play session including a time constraint for dart pin throwing, a second sub play session including a time constraint for a round which permits dart pin throwing of N times, or a third sub play session including a time constraint for a set including K rounds. The image acquisition unit may acquire the play image by the unit of at least one sub play session among the first sub play session, the second sub play session, and the third sub play session included in the play session.

As another example, based on a difference between the previous non-image play result data related to the previous dart game play of the player and the first non-image play result data related to the current dart game play of the player, the image acquisition unit may acquire the play image when there is a difference which exceeds a predetermined threshold.

Specifically, the control unit 100 may compare the previous non-image play result data related to the previous dart game play of the player and the first non-image play result data related to the current dart game play of the player. The control unit 100 may determine that there is a difference which exceeds a predetermined threshold according to the comparison result. In this case, the image acquisition unit may acquire the play image in which the player of the dart game device 1000 throws the dart pin.

According to some embodiments of the present disclosure, the control unit 100 of the dart game device 1000 may also determine whether the player performs the cheating such as throwing the dart pin beyond a throw line. Here, the throw line may be a line drawn on ground in which the dart game device 1000 is installed in advance by an installer. Alternatively, the body structure 300 may include a support unit extended from an end contacting the ground along the ground. In this case, the throw line may be displayed in the support unit. Alternatively, the throw line may also be displayed in a form of being projected onto the ground through the illumination unit 180.

Specifically, the control unit 100 may extract an image including a foot part of the player and the throw line of the dart game device 1000 at a time of throwing the dart pin by the player from the play image. The control unit 100 may determine whether the player throws the dart pin beyond the throw line based on the extracted image. When it is determined that the player throws the dart pin beyond the throw line, the control unit 100 may determine that the player performs the cheating. In this case, the control unit 100 may neutralize the score which the player acquires by throwing the dart pin. In other words, the control unit 100 may process the score which the player acquires by throwing the dart pin as 0 point.

According to some embodiments of the present disclosure, the above-described operations may also be performed by the dart game server 3000.

Specifically, the network communication unit of the dart game server 3000 may receive a play image in which the player of the dart game device 1000 throws the dart pin from the dart game device 1000 which participates in a play session which assigns the pay time constraint to two or more devices. The control unit of the dart game device 3000 may recognize the identity information of the player from the play image. The control unit of the dart game server 3000 may discriminate the cheating of the player based on the recognized identity information of the player and the identification information of the user who logs in to the dart game device 1000.

According to the above-described configuration, the control unit 100 of the dart game device 1000 may discriminate the cheating of the player based on the player participating in the play session through the dart game device 1000 matching the user who logs in. Accordingly, a cheating may prevented, such as participation of a surrogate player, which may occur as the dart game device 1000 and another device 2000 participate in the play session online.

According to some embodiments of the present disclosure, the information related to the play session displayed in the display unit 120 of the dart game device 1000 may also be displayed as a different example from the above-described embodiment. Hereinafter, another example of the information related to the play session displayed in the display unit 120 according to the present disclosure will be described through FIG. 27.

Figure 27:
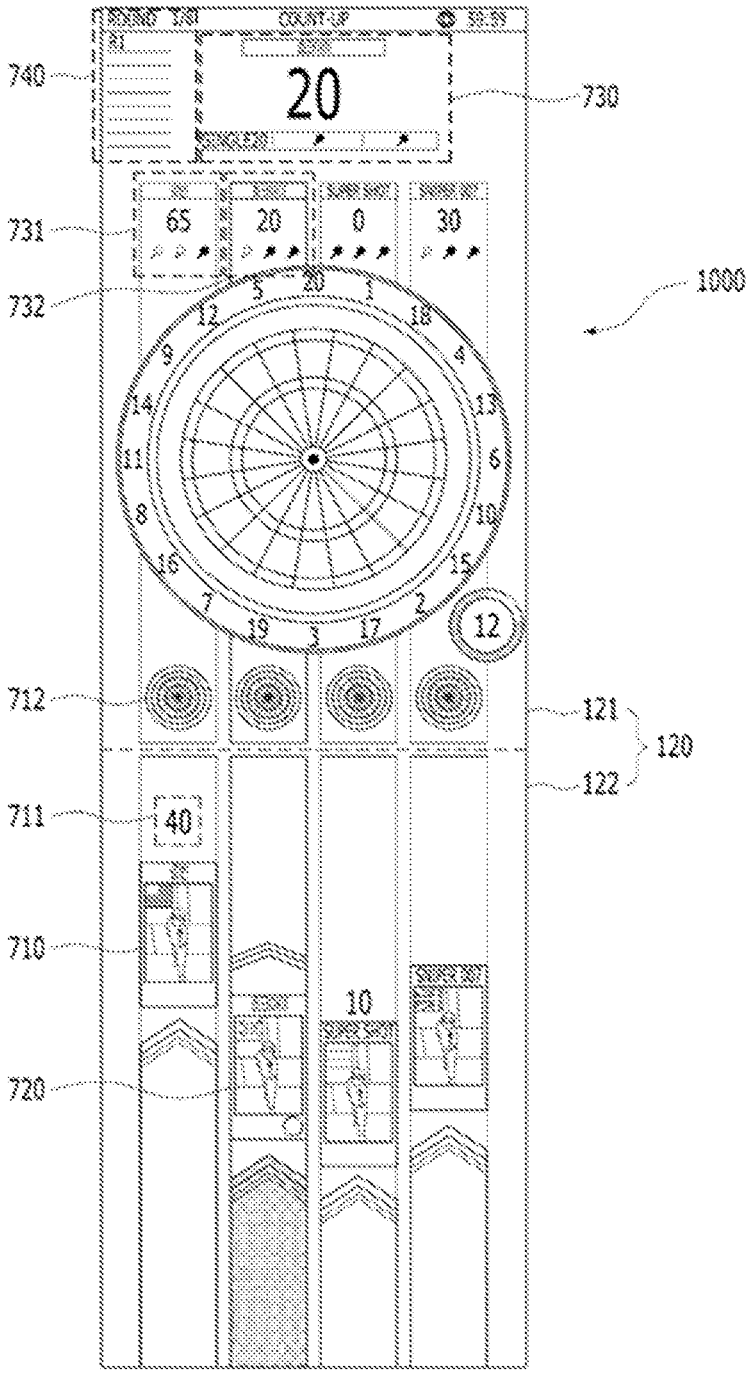
FIG. 27 is a diagram describing another example of information related to a play session displayed by a display unit of the dart game device according to some embodiments of the present disclosure.

FIG. 27 is a diagram describing another example of information related to a play session displayed by a display unit of the dart game device according to some embodiments of the present disclosure.

Prior to describing FIG. 27, a first object and a second object in FIG. 27 are distinguished for convenience of description related to FIG. 27. In an embodiment, the object may mean any type of component displayed in the dart game device 1000.

Referring to FIG. 27, the display unit 120 of the dart game device 1000 may include a first display region 121 and a second display region 122.

The first object 710 related to the first device and the second object 720 related to the second device may be displayed in the second display region 122. Here, the first device and the second device may be other devices 2000 which participate in the play session in which the dart game device 1000 participates. Alternatively, one of the first device or the second device may also be the dart game device 1000.

When the first object 710 and the second object 720 are described, it can be seen that a location at which the first object 710 is displayed in the second display region 122 and a location at which the second object 720 is displayed in the second display region 122 are different. According to the embodiment, the control unit 100 may determine the locations of the first object 710 and the second object 720 based on the play related data of the first device related to the first object 710 and the play related data of the second device related to the second object 720.

For example, a height at which the first object 710 is displayed in the second display region 122 and a height at which the second object 720 is displayed in the second display region 122 may be different. The control unit 100 may determine the height of each object based on the score which the first device related to the first object 710 acquires in the play session and the score which the second device related to the second object 720 acquires in the play session.

In FIG. 27, it is exemplarily illustrated that heights of objects corresponding to each other are different, but it may also be considered that locations of the objects in a horizontal perspective in addition to heights in a vertical perspective are different.

As an example, when a first score information region 731 of the first display region 121 related to the first object 710 is described, a score which the first player related to the first object 710 acquires while playing a current round may be 65 points. Information related to the round may also be provided to the player through a round region 740 of the first display region 121. When a second score information region 732 of the first display region 121 related to the second object 720 is described, a score which the second player related to the second object 720 acquires while playing the current round may be 20 points. Since the score acquired by the first player is higher than the score acquired by the second player, the control unit 100 may determine the first object 710 to be displayed in a relatively higher region than the second object 720.

When the first score information region 713 is described more, the first score information region 713 may include the number of dart pins thrown by the first player or a text for identifying the first player in addition to the score which the first player acquires in the current round.

A first score 711 which the first player acquires by throwing the dart pin may be displayed above the first object 710. The score displayed in the first score information region 713 may be an accumulated score which the first player acquires in the current round by throwing the dart pin, and the first score 711 may be a score for dart pin throwing of each of N times in the round which permits the dart pin throwing of N times.

An image related to the dart target unit may be displayed in one region of the first display region 121. As an example, an image 712 related to a first dart target unit of the first object 710 may be displayed in the first display region 121. Here, the image related to the first dart target unit of the first object 710 may be one of a prestored dart target unit related virtual image corresponding to the play related data of the first device or an actual image in which the dart pin thrown by the first player hits the dart target unit.

The first display region 121 may include a player score information region 750 in which information related to the score of the player of the dart game device 1000 is displayed. The accumulated score which the player of the dart game device 1000 acquires in the round may be displayed in the player score information region 750. Further, the respective scores which the player of the dart game device 1000 acquires by throwing the dart pin N times in the round may be displayed in the player score information region 750. Further, the number of dart pins which the player of the dart game device 1000 may throw in the round may be displayed in the player score information region 750. Further, the text for identifying the player of the dart game device 1000 may be displayed in the player score information region 750.

According to some embodiments of the present disclosure, the object displayed in the second display region 122 may include the object related to the player of the dart game device 1000. As an example, the second object 720 may be an object related to the player of the dart game device 1000. Referring to the second score information region 732 and the player score information region 750, it can be seen that the scores displayed in two regions and the texts for identifying the player are the same as each other.

According to some embodiments of the present disclosure, the dart game device 1000 or the dart game server 3000 may change the relative locations of the objects displayed in the first display region 121 of the dart game device 1000. Here, the relative locations may include left and right-direction locations in addition to heights between a plurality of objects. Relative heights between the plurality of objects may be determined based on a score in a current play session in which the dart game device 1000 participates. As an example, the relative heights between the plurality of objects may be determined based on the scores which the dart game device 1000 and other devices acquire in the second sub play session. According to the embodiment, the second sub play session may be a play session for the round which permits dart pin throwing of N times. Relative left and right-direction locations between the plurality of objects may be determined based on the scores which the dart game device 1000 and other devices acquire in the third sub play session. Alternatively, the relative left and right-direction locations between the plurality of objects may be determined based on relative rankings between the dart game device 1000 and other devices in the third sub play session. The third sub play session may be a play session for the set including K rounds. Hereinafter, a method for changing the relative locations of the plurality of objects by the dart game device 1000 according to the present disclosure will be described through FIG. 28.

FIG. 28 is a diagram describing an example of a method for changing relative locations of a plurality of objects by the dart game device according to some embodiments of the present disclosure.

Figures 28A, 28B, 28C, 28D:
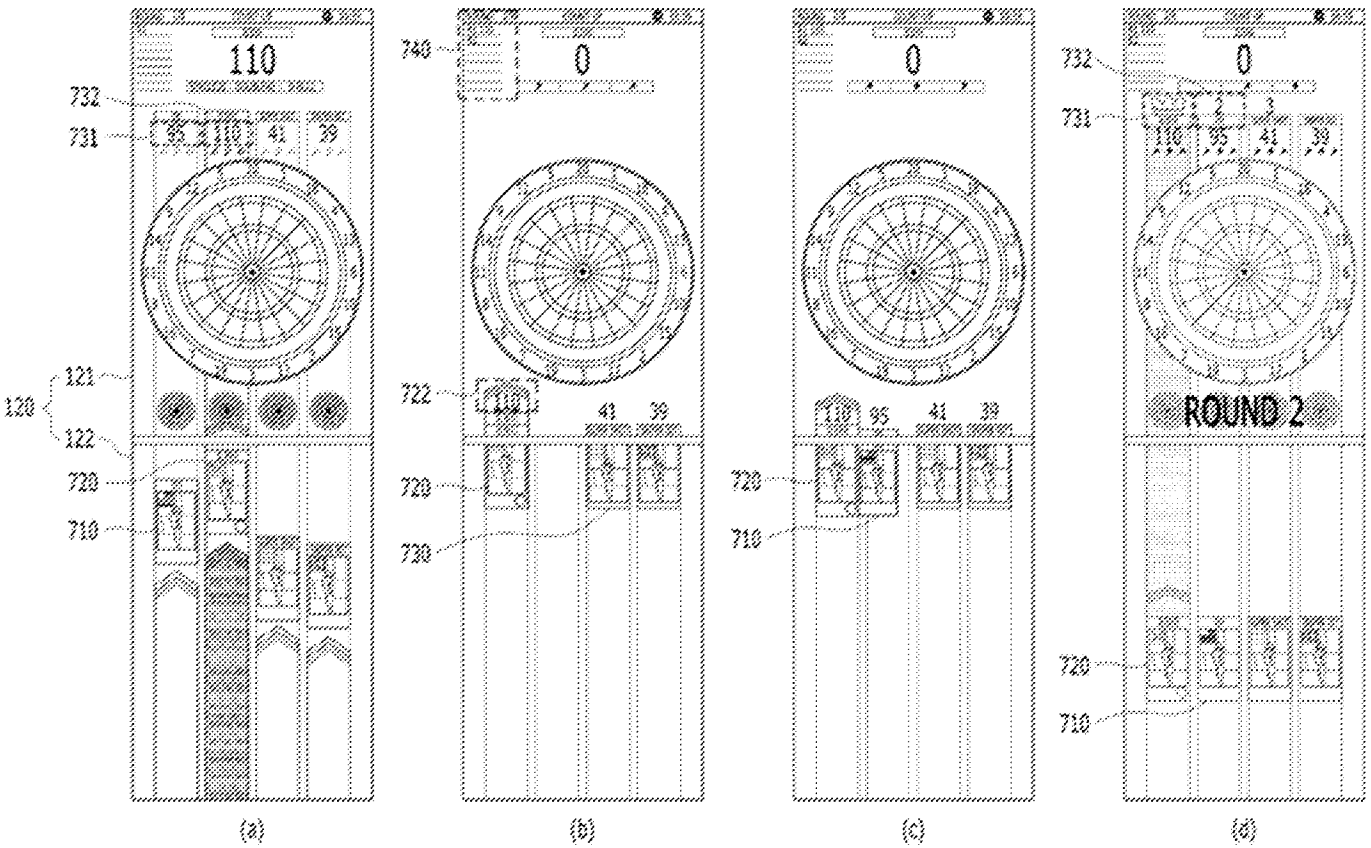
FIG. 28A is a diagram describing an example of a method for changing relative locations of a plurality of objects by the dart game device according to a first embodiment of the present disclosure.
FIG. 28B is a diagram describing an example of a method for changing relative locations of a plurality of objects by the dart game device according to a second embodiment of the present disclosure.
FIG. 28C is a diagram describing an example of a method for changing relative locations of a plurality of objects by the dart game device according to a third embodiment of the present disclosure.
FIG. 28D is a diagram describing an example of a method for changing relative locations of a plurality of objects by the dart game device according to a fourth embodiment of the present disclosure.

Referring to FIG. 28A, objects related to a plurality of other devices which participates in the play session in which the player of the dart game device 1000 participates or an object related to the dart game device 1000 may be displayed in the second display region 122. As an example, the first object 710 may be an object related to the first player of the first device, and the second object 720 may be an object related to the second player of the second device. When the first score information region 713 related to the first object 710 is described, a score which the first player acquires in a first round may be 95 points. When the second score information region 732 related to the second object 720 is described, a score which the second player acquires in the first round may be 110 points.

Referring to FIG. 28B, the control unit 100 may move the second object 720 to the location at which the first object 710 is displayed as a second round starts. Specifically, the control unit 100 may change the relative locations of the first object 710 and the second object 720 based on the play related data related to the first device and the second device, respectively. As illustrated in the first score information region 713 and the second score information region 732, the second player related to the second object 720 may acquire a higher score than the first player related to the first object 710. As a result, the control unit 100 may move the second object 720 to the location at which the first object 710 is displayed. Information related to the round may also be updated and provided to the player through a round region 740 of the first display region 121.

The control unit 100 may display scores which the players related to the plurality of objects, respectively acquire in a previous round at upper ends of the plurality of objects displayed in the second display region 122 as the round is changed. When the second object 720 is described, it can be seen that a score 722 which the second player related to the second object 720 acquired in the first round is displayed above the second object 720.

According to some embodiments of the present disclosure, the control unit 100 of the dart game device 1000 may vary a size, a color, or a shape of each of the first object 710 and the second object 720, in changing the relative locations of the first object 710 and the second object 720.

As an example, the control unit 100 may determine that a vertical virtual center line is present between the first object 710 and the second object 720 displayed in FIG. 28A. The control unit 100 may change the second object 720 in a mode in which as the second object 720 and the virtual center line are closer, a size of the second object 720 increases (or the shape or color is changed) in changing the second object 720 to the location at which the first object 710 is displayed. The change of the object may include variation of the size. In FIGS. 27 and 28, the changes of the size and the location are described as an example in relation to the change of the object, but a feature for any type of change such as the change of the color or the shape will also be included in the scope of the present disclosure.

For example, the control unit 100 may vary the size of the second object 720 in a mode in which the second object 720 and the virtual center line are further from each other, the size of the second object 720 is reduced to an original size in changing the second object 720 to the location at which the first object 710 is displayed. For example, referring to FIG. 27(*b*), it can be seen that the size of the second object 720 are larger than the sizes of other objects. In this case, the player of the dart game device 1000 may feel that the location of the second object 720 is dynamically changed while the second object 720 moves forward.

Referring to FIG. 28C, the control unit 100 may vary the size of the first object 710 in a mode in which as the first object 710 and the virtual center line are closer, the size of the first object 710 decreases in changing the first object 710 to the location at which the second object 720 is displayed. The control unit 100 may vary the size of the first object 710 in a mode in which the second object 720 and the virtual center line are further from each other, the size of the first object 710 is enlarged to an original size in changing the first object 710 to the location at which the second object 720 is displayed.

The control unit 100 of the dart game device 1000 may also change the locations of the first object 710 and the second object 720 simultaneously, and change the locations of the first object 710 and the second object 720 sequentially, in changing the relative locations of the first object 710 and the second object 720.

Referring to FIG. 28D, as the first round is ended, the control unit 100 of the dart game device 1000 may display an image for indicating rankings in the first round. As an example, the first score information region 713 may include a gold crown image for indicating that a highest score is acquired in the first round. The second score information region 732 may include a silver text image for indicating that a second highest score is acquired in the first round. As the second round is started, the information displayed in the first score information region 731 may be information related to the second object 720. Further, as the second round is started, information displayed in the second score information region 732 may be information related to the first object 710. In other words, the control unit 100 may also change relative locations of the information displayed in the first score information region 731 and the information displayed in the second score information region 732 as changing the relative locations of the first object 710 and the second object 720.

According to the descriptions through FIGS. 1 to 28, a dart game system 10000 may provide the play session assigning the play time constraint to two or more devices to the dart game device 1000. In addition, the dart game device 1000 participates in the play session to provide a real-time online dart game to a player. Further, the dart game device 1000 may display information related to the play session in which the dart game device 1000 participates in the display unit 120 in real time. Accordingly, the dart game device 1000 may inspire an interest of the player who participates in the dart game.

The description of the presented embodiments is provided so that those skilled in the art of the present disclosure use or implement the present disclosure. Various modifications of the embodiments will be apparent to those skilled in the art and general principles defined herein can be applied to other embodiments without departing from the scope of the present disclosure. Therefore, the present disclosure is not limited to the embodiments presented herein, but should be interpreted within the widest range which is coherent with the principles and new features presented herein.

Related contents in the best mode for carrying out the present disclosure are described as above.

The present disclosure may be used in the dart game device, the dart game system, etc.

The invention claimed is:

1. A method for providing a dart game image performed by a dart game device participating in a play session assigning a play time constraint to two or more devices, the method comprising:

receiving play related data of another device which participates in the play session in which the dart game device participates, wherein the play related data comprises non-image play result data;

determining whether to display a display image comprising a play image in which a player of the another device throws a dart pin by comparing the play related data of the another device and prestored previous play related data of the another device; and displaying the display image based on determining whether to display the display image.

2. The method for providing a dart game image of claim 1, wherein the non-image play result data comprises at least one of information on a score which a player of another device acquires by throwing the dart pin, information on a score acquired in a round which permits dart pin throwing of N times, or information on a score acquired in a set comprising K rounds.

3. The method for providing a dart game image of claim 1, wherein the determining of whether to display the display image comprising the play image in which the player of the another device throws the dart pin by comparing the play related data of the another device and the prestored previous play related data of the another device comprises:

determining a score acquired by throwing the dart pin by the player of the another device based on the non-image play result data; and additionally determining a prestored image related to a dart target unit corresponding to the score as the display image.

4. The method for providing a dart game image of claim 1, wherein the determining of whether to display the display image comprising the play image in which the player of the another device throws the dart pin by comparing the play related data of the another device and the prestored previous play related data of the another device comprises:

determining a location at which the dart pin of the player of the another device is thrown based on the non-image play result data; and additionally determining a prestored image related to a dart target unit corresponding to the location as the display image.

5. The method for providing a dart game image of claim 3, wherein the prestored image related to the dart target unit includes one of a prestored dart target unit related virtual image or a prestored actual image in which the dart pin hits a region related to the dart target unit.

6. The method for providing a dart game image of claim 5, wherein the determining of whether to display the display image comprising the play image in which the player of the another device throws the dart pin by comparing the play related data of the another device and the prestored previous play related data of the another device further comprises:

determining a score acquired by throwing the dart pin by the player of the another device or a location at which the dart pin of the player of the another device is thrown based on the play related data, and additionally determining a prestored event image corresponding to the score or the location as the display image, and wherein the displaying of the display image based on determining whether to display the display image comprises:

displaying the prestored image related to the dart target unit and the prestored event image.

7. The method for providing a dart game image of claim 1, wherein the display image comprises a prestored previous play image in which the player of the another device throws the dart pin, and wherein the determining of whether to display the display image comprising the play image in which the player of the another device throws the dart pin by comparing the play related data of the another device and the prestored previous play related data of the another device comprises:

determining the prestored previous play image as the display image.

8. The method for providing a dart game image of claim 7, wherein the determining of whether to display the display image comprising the play image in which the player of the another device throws the dart pin by comparing the play related data of the another device and the prestored previous play related data of the another device comprises:

determining a score acquired by throwing the dart pin by the player of the another device based on the non-image play result data, and determining the prestored previous play image corresponding to the score in the prestored previous play image as the display image, and wherein the prestored previous play image comprises an image in which the player of the another device throws the dart pin.

9. The method for providing a dart game image of claim 7, wherein the determining of whether to display the display image comprises the play image in which the player of the another device throws the dart pin by comparing the play related data of the another device and the prestored previous play related data of the another device comprises:

determining a location at which the dart pin of the player of the another device is thrown based on the non-image play result data, and determining the prestored previous play image corresponding to the location in the prestored previous play image as the display image, and wherein the prestored previous play image comprises an image in which the player of the another device throws the dart pin.

10. The method for providing a dart game image of claim 7, wherein the prestored previous play image is stored in a mode of being grouped into a plurality of groups based on score information included in the non-image play result data, and wherein the determining of whether to display the display image comprising the play image in which the player of the another device throws the dart pin by comparing the play related data of the another device and the prestored previous play related data of the another device comprises:

determining a prestored previous play image included in a group to which the score information corresponding to the play related data belongs among the plurality of groups as the display image.

11. The method for providing a dart game image of claim 1, wherein the play related data is received again at a time when the play session is changed, and wherein the play session comprises at least one of a first sub play session comprising a time constraint for dart pin throwing, a second sub play session comprising a time constraint for a round which permits dart pin throwing of N times, or a third sub play session comprising a time constraint for a set comprising K rounds, and wherein the N and the K are natural numbers.

12. The method for providing a dart game image of claim 1, wherein the display image comprises at least one of a character image for identifying the player of the another device or an image comprising a text for identifying the player of the another device.

13. A method for providing a dart game image to a dart game device participating in a play session assigning a play time constraint to two or more devices, wherein the method is performed by a dart game server, the method comprising:

receiving play related data of another device which participates in the play session in which the dart game device participates, wherein the play related data comprises non-image play result data;

determining whether to display a display image comprising a play image in which a player of the another device throws a dart pin by comparing the play related data of the another device and prestored previous play related data of the another device; and transmitting, the display image to the dart game device based on determining whether to display the display image.

14. A dart game device participating in a play session assigning a play time constraint to two or more devices, comprising:

a network communication unit receiving play related data of another device which participates in the play session in which the dart game device participates, wherein the play related data comprises non-image play result data;

a control unit determining whether to display a display image comprising a play image in which a player of the another device throws a dart pin by comparing the play related data of the another device and prestored previous play related data of the another device; and a display unit displaying the display image based on determining whether to display the display image.

15. The method for providing a dart game image of claim 4, wherein the prestored image related to the dart target unit includes one of a prestored dart target unit related virtual image or a prestored actual image in which the dart pin hits a region related to the dart target unit.

16. The method of claim 15, wherein the determining of whether to display the display image comprising the play image in which the player of the another device throws the dart pin by comparing the play related data of the another device and the prestored previous play related data of the another device further comprises:

determining a score acquired by throwing the dart pin by the player of the another device or a location at which the dart pin of the player of the another device is thrown based on the play related data, and additionally determining a prestored event image corresponding to the score or the location as the display image, and wherein the displaying of the display image based on determining whether to display the display image comprises:

displaying the prestored image related to the dart target unit and the prestored event image.

17. The method of claim 13, wherein the non-image play result data comprises at least one of information on a score which a player of another device acquires by throwing the dart pin, information on a score acquired in a round which permits dart pin throwing of N times, or information on a score acquired in a set comprising K rounds.

18. The method of claim 13, wherein the determining of whether to display the display image comprising the play image in which the player of the another device throws the dart pin by comparing the play related data of the another device and the prestored previous play related data of the another device comprises:

determining a score acquired by throwing the dart pin by the player of the another device based on the non-image play result data; and additionally determining a prestored image related to a dart target unit corresponding to the score as the display image.

19. The method of claim 18, wherein the prestored image related to the dart target unit comprises one of a prestored dart target unit related virtual image or a prestored actual image in which the dart pin hits a region related to the dart target unit.

20. The method of claim 19, wherein the determining of whether to display the display image comprising the play image in which the player of the another device throws the dart pin by comparing the play related data of the another device and the prestored previous play related data of the another device further comprises:

determining a score acquired by throwing the dart pin by the player of the another device or a location at which the dart pin of the player of the another device is thrown based on the play related data, and additionally determining a prestored event image corresponding to the score or the location as the display image, and wherein the displaying of the display image based on determining whether to display the display image comprises:

displaying the prestored image related to the dart target unit and the prestored event image.

* * * * *